US011910935B1

(12) United States Patent
Lawlor et al.

(10) Patent No.: US 11,910,935 B1
(45) Date of Patent: Feb. 27, 2024

(54) BABY DIAPER CHANGING STATION

(71) Applicant: Foundations Worldwide, Inc., Medina, OH (US)

(72) Inventors: Joseph A. Lawlor, Medina, OH (US); David Stitchick, Wadsworth, OH (US); Connor Doris, Strongsville, OH (US)

(73) Assignee: FOUNDATIONS WORLDWIDE , INC ., Medina, OH (US)

( * ) Notice: Subject to any disclaimer, the term of this patent is extended or adjusted under 35 U.S.C. 154(b) by 309 days.

(21) Appl. No.: 17/234,907

(22) Filed: Apr. 20, 2021

Related U.S. Application Data

(60) Provisional application No. 63/013,169, filed on Apr. 21, 2020.

(51) Int. Cl.
*A47D 5/00* (2006.01)

(52) U.S. Cl.
CPC ..... *A47D 5/006* (2013.01); *A47D 5/003* (2013.01)

(58) Field of Classification Search
CPC ..... A47D 5/00; A47D 5/006; A47D 5/003
See application file for complete search history.

(56) References Cited

U.S. PATENT DOCUMENTS

2011/0283455 A1* 11/2011 Grainger ..... A47D 5/003 5/655
2012/0096647 A1* 4/2012 Presnell ..... A47D 5/006 5/655
2012/0198630 A1* 8/2012 Babikian ..... A47D 5/003 5/655
2017/0196372 A1* 7/2017 Babikian ..... A47D 5/006

* cited by examiner

*Primary Examiner* — Fredrick C Conley
(74) *Attorney, Agent, or Firm* — Ralph E. Jocke; WALKER & JOCKE

(57) ABSTRACT

An exemplary baby diaper changing station (260) includes a table (264) that is configured to be in operative supported connection with a wall (262) through a pair of transversely disposed mounting brackets (266, 268). The table is in movable rotatable connection with the mounting brackets. The table is rotatably movable between a use position in which a generally planar changing surface (280) extends generally horizontal and faces upward, and a stored position in which the table extends parallel to the wall and in outwardly overlying relation of the mounting brackets. A pair of torsion springs (348) that are associated with respective joints (276, 278) operate to rotationally bias the table toward the stored position once the table has been rotationally moved by the user away from the use position.

43 Claims, 52 Drawing Sheets

90
91
88
28
86
82
92
157
98
96
94
78
74
98
100
96
166
156
174
142
170
116
144
134
170
136
162
164
108
148
138
132
146
158
151
160

244
12
10
10
14

BABY DIAPER CHANGING STATION

TECHNICAL FIELD

Exemplary arrangements relate to baby diaper changing stations. Exemplary arrangements further relate to baby diaper changing stations that provide improved stability and load bearing capability and that can be retracted to a more compact configuration when not in use.

BACKGROUND

Baby diaper changing stations are needed in public restrooms and other facilities. Some existing changing stations may be bulky and difficult to use. Because such units must be openly accessible, they may be subject to vandalism and breakage. Some existing changing stations may also be difficult to keep clean and sanitize.

Baby diaper changing stations may benefit from improvements.

SUMMARY

Exemplary arrangements comprise a baby diaper changing station that includes a table and a pair of transversely spaced mounting brackets. The mounting brackets are affixed to a mounting surface such as a vertically extending wall. The table includes a substantially planar changing surface.

The table and the mounting brackets are movably connected through a pair of transversely disposed joints. A pair of side rails are in fixed operative engagement with a pair of transversely disposed side wall portions of the table. The side rails each include respective ends, each of which is part of a respective clevis of a respective joint. Each respective mounting bracket includes at least one projection that is in relatively rotatable engagement with a respective clevis through a respective pin.

The exemplary table is rotationally movable in supported connection with the mounting brackets between a use position and a stored position. In the use position the changing surface of the table extends substantially horizontally and outward in a direction perpendicular to the wall. In the use position the changing surface faces substantially upward. In the stored position the changing surface extends substantially vertically and parallel to the wall.

A respective stop on each respective clevis engages a stop surface on a respective mounting bracket and prevents the table from rotationally moving from the stored position beyond the use position. A respective torsion spring extends in surrounding relation of each respective pin and is in operative biasing engagement with the table and a respective mounting bracket. The torsion springs are configured so that when the table is in the use position it is subject to gravitational torque that is sufficient to maintain the table in the use position. In some arrangements a detent may be used to releasably hold the table in the use position. Manually moving the table away from the use position toward the stored position causes the spring torque applied by the torsion springs that acts to move the table toward the stored position, to exceed the counteracting gravitational torque. The spring torque is operative to rotationally move the table toward the stored position.

Numerous useful features of exemplary arrangements will be discussed in the following Detailed Description.

BRIEF DESCRIPTION OF DRAWINGS

FIG. 40 is an upper right side perspective view showing the relationship of the horizontally elongated mounting bracket and the base brackets, rails and axle shaft of the changing station.

DETAILED DESCRIPTION

Figure 1:
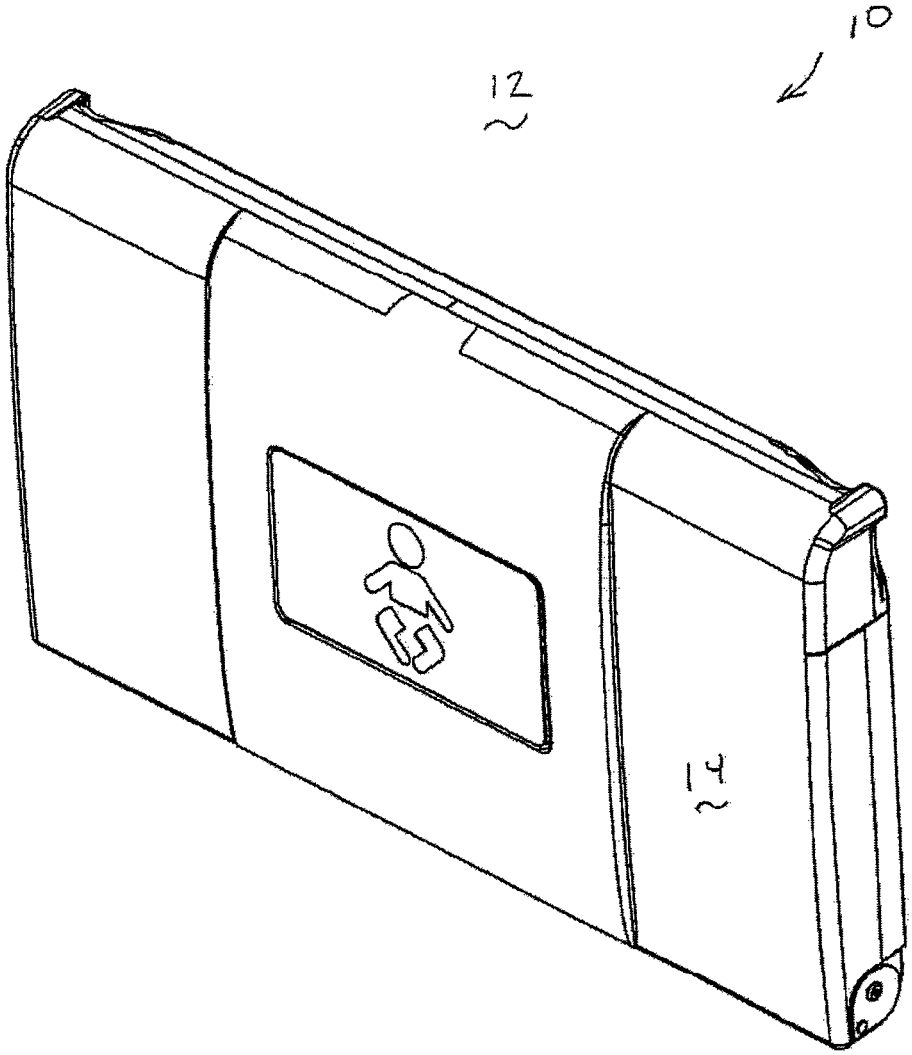
FIG. 1 is an upper front right perspective view of an exemplary arrangement of a baby diaper changing station in a stored position.
Figure 2:
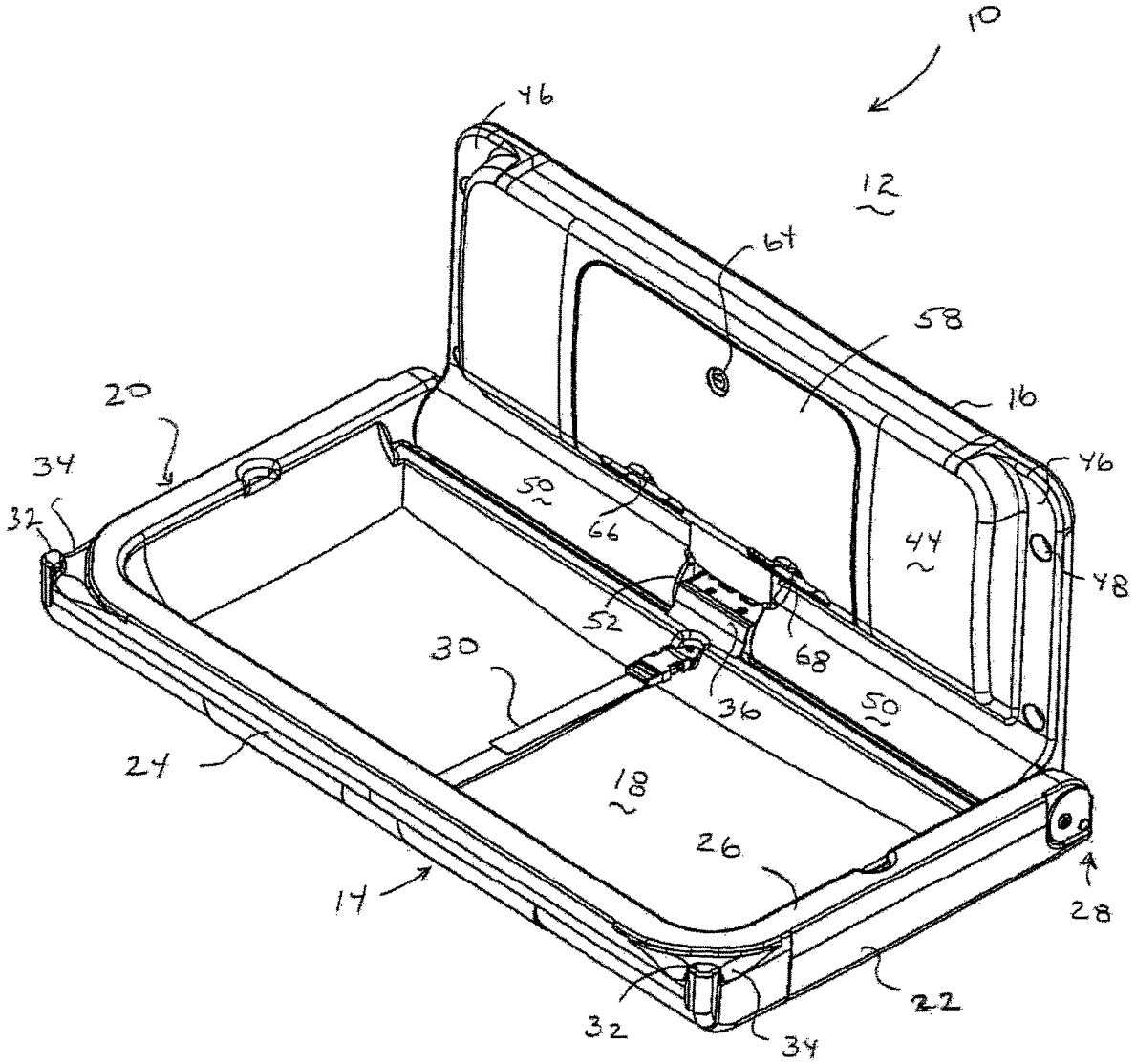
FIG. 2 is an upper front right perspective view of the baby changing station in a use position.
Figure 3:
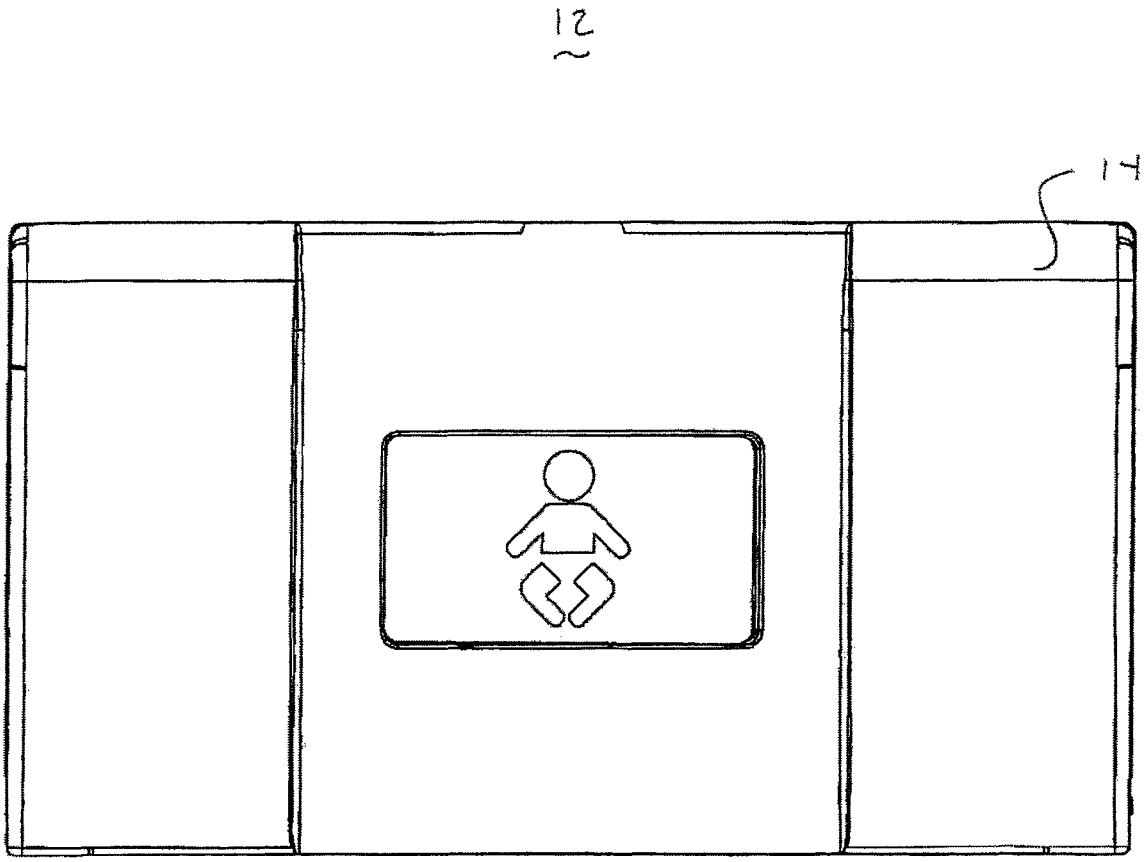
FIG. 3 is a front plan view of the baby diaper changing station in a stored position.
Figure 5:
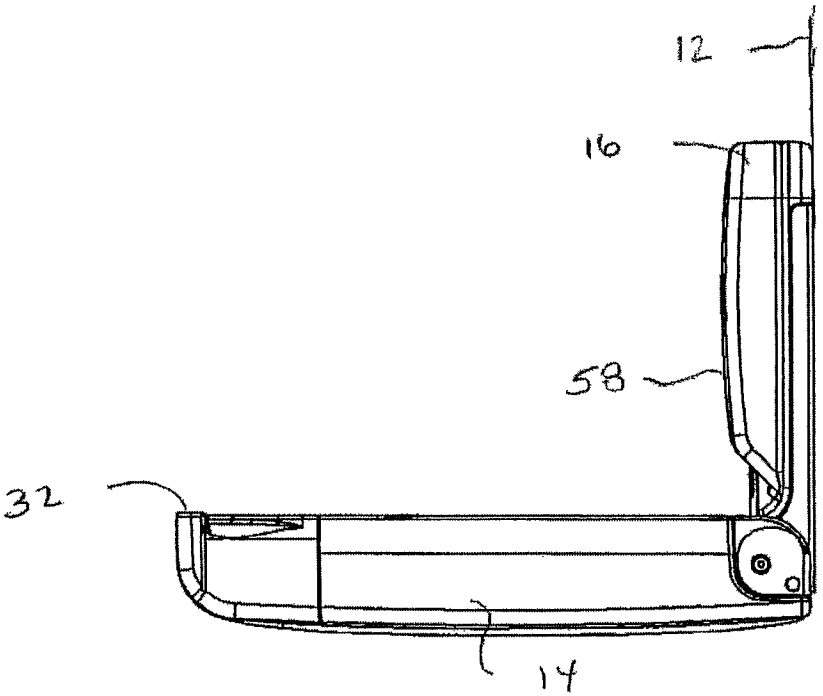
FIG. 5 is a right side view of the baby diaper changing station in the use position.
Figure 4:
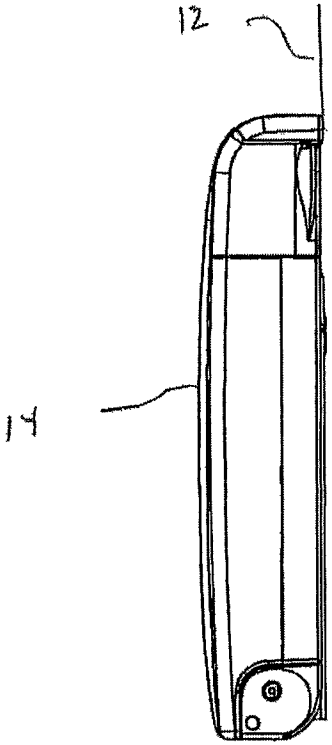
FIG. 4 is a right side view of the baby diaper changing station in the stored position.
Figure 6:
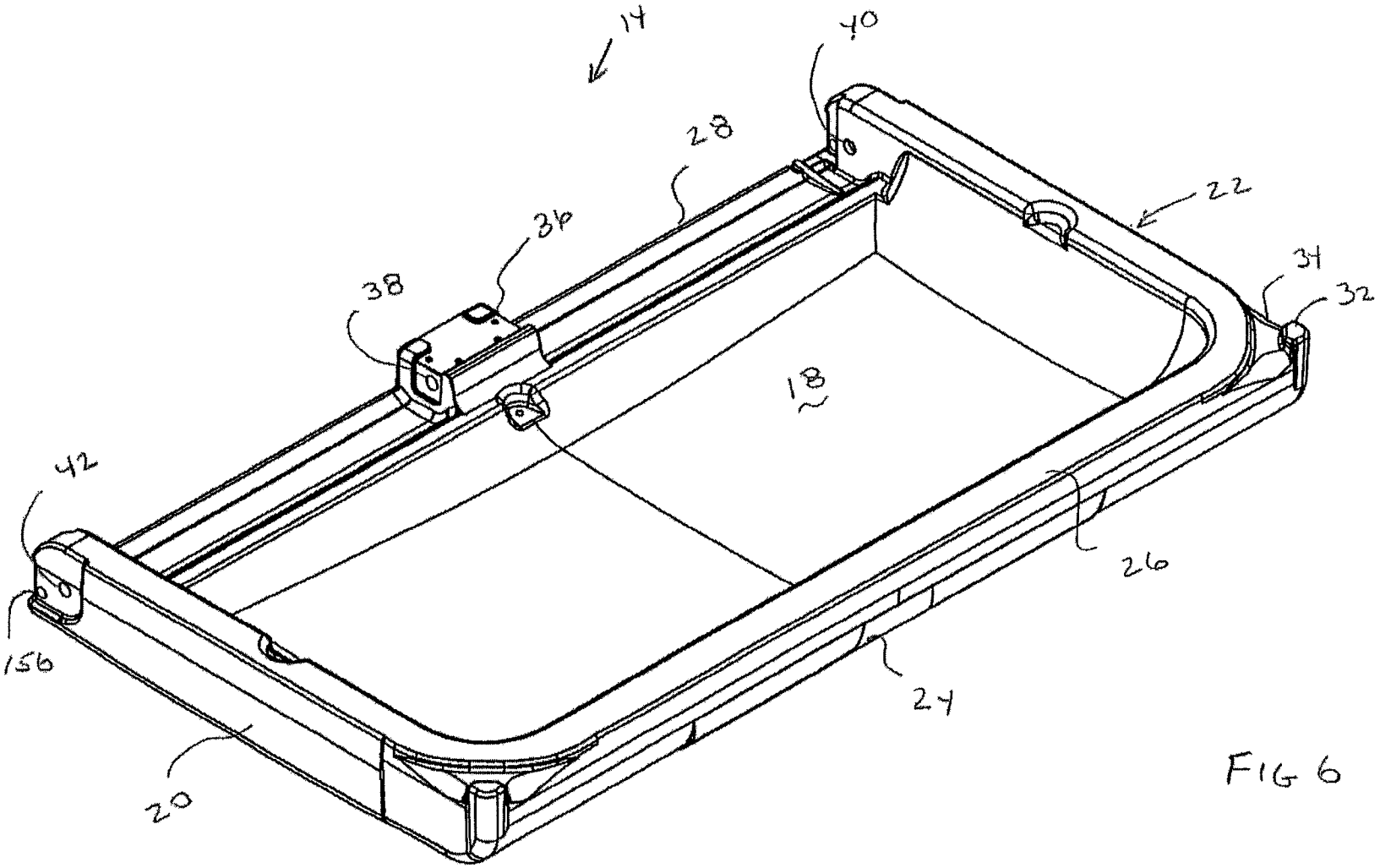
FIG. 6 is an upper front left perspective view of the table of the baby diaper changing station.
Figure 7:
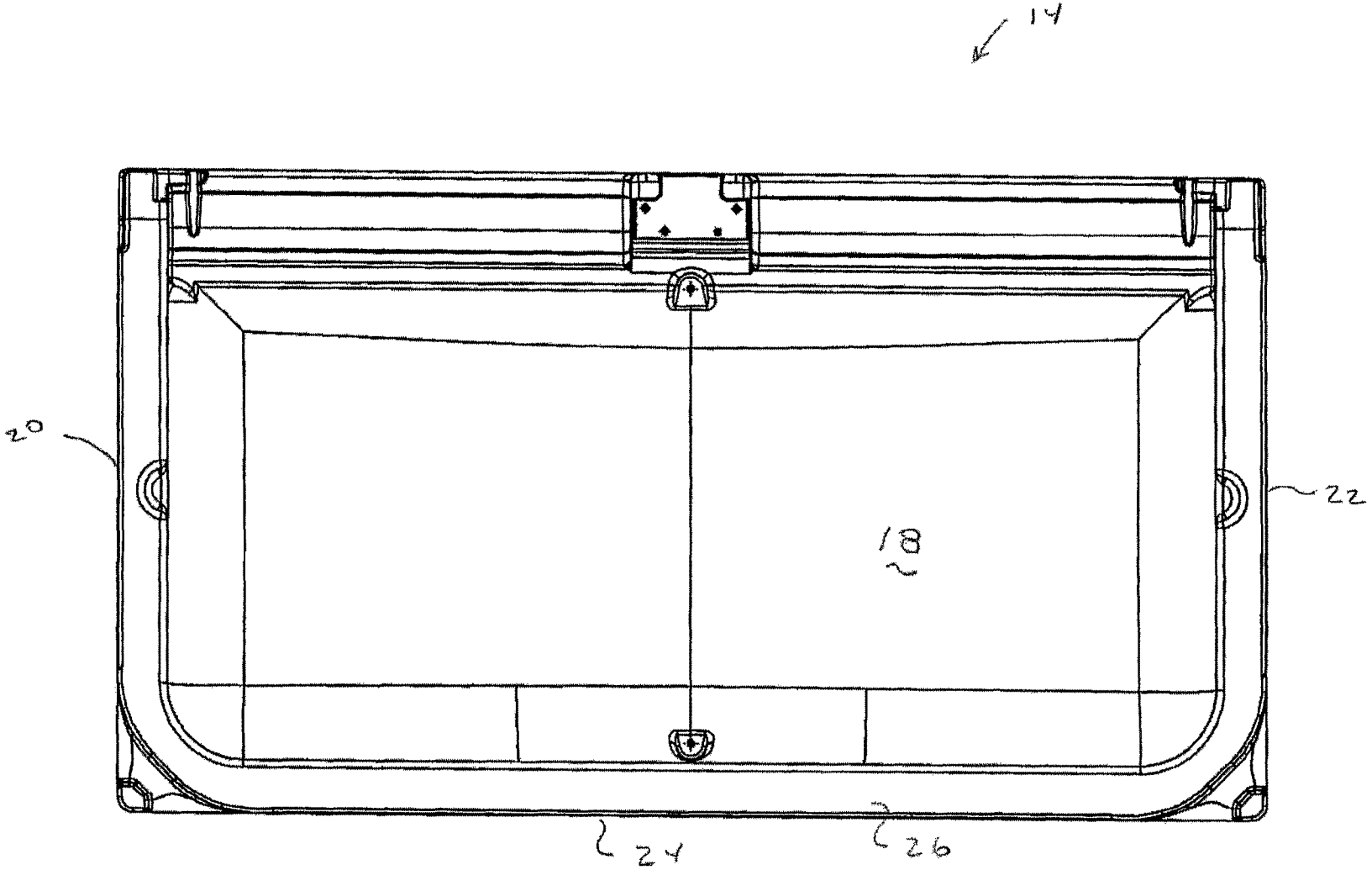
FIG. 7 is a top plan view of the table.
Figure 8:
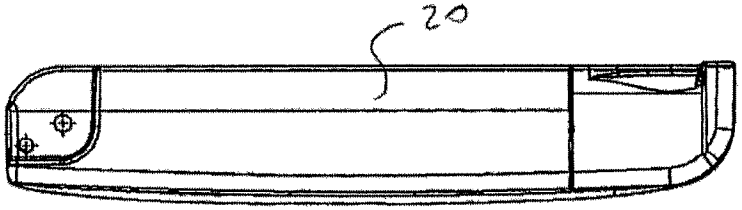
FIG. 8 is a left side view of the table.
Figure 9:
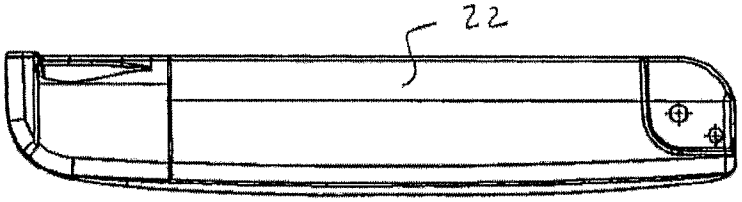
FIG. 9 is a right side view of the table.
Figure 10:
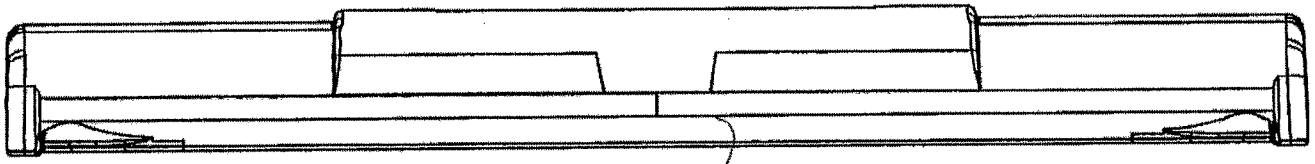
FIG. 10 is a front view of the table.

Referring now to the drawings and particularly to FIG. 1 there is shown therein an exemplary arrangement of a baby diaper changing station generally indicated 10. The exemplary changing station is mounted in operative attached connection with a vertically extending structure such as a wall 12. The exemplary changing station includes a table 14. As shown in FIG. 2, the changing station further includes a base 16 which is in direct attached connection with the wall 12. The table 14 is in rotatably movable operatively attached connection with the base in a manner that is later discussed in detail. In the exemplary arrangement the table is movable relative to the base between a stored position shown in FIG. 1 and a use position shown in FIG. 2. The table 14 includes a substantially planar changing surface 18. As used herein substantially planar means most of the surface extends in a common plane. The table further includes a pair of transversely disposed side wall surfaces 20, 22 and an outer end surface 24. A rim 26 bounds the changing surface 18 adjacent to the side wall surfaces 20, 22 and the front wall surface 24. The exemplary table 14 further includes an inner end surface generally indicated 28.

In the use position of the changing station 10 as represented in FIG. 2, the changing surface 18 extends substantially horizontally and faces substantially upward. As used herein facing substantially upward means that a majority of the surface area faces substantially vertically upward. By substantially or generally horizontally it is meant horizontal plus or minus 20° therefrom. As used herein generally or substantially vertically means vertical plus or minus 20° therefrom. In the use position the changing surface 18 also extends outward and substantially normal to the wall 12. As used herein generally or substantially normal as well as generally or substantially perpendicular means at 90° plus or minus 20° therefrom. When the table 14 is in the use position the rim 26 extends upwardly and bounds the changing surface on three sides. Further in the exemplary arrangement the table 14 includes a strap assembly 30. The rim 26 of the exemplary table further includes thereon a pair of pegs 32. The pegs 32 extend upward when the table is in the use position from a peripheral surface 34 of the rim that extends adjacent to each respective peg. In the exemplary arrangement the table is comprised of molded plastic material. Of course it should be understood that this configuration is exemplary and in other arrangements other configurations and materials may be used. As shown in greater detail in FIGS. 6-10 the exemplary table further includes a bearing block 36. The bearing block extends outward generally perpendicular to the changing surface 18 immediately adjacent to the inner end surface 28. The bearing block 36 includes a transverse opening 38 that extends therethrough. Opening 38 is sized for accepting an axle shaft therein as later discussed. Opening 38 is aligned with an opening 40 in the side wall surface 22 and an opening 42 in the side wall surface 20. Openings 40 and 42 are also configured for receiving outboard shaft portions of the axle shaft therein. Of course it should be understood that this configuration is exemplary and other arrangements other configurations may be used.

As shown in FIG. 2 and FIGS. 11-15, the exemplary base 16 includes a central portion 44 and a pair of outboard flange portions 46. The central portion 44 extends forwardly of the flange portions. The flange portions 46 include openings 48 that are configured to have fastening anchors extend therethrough so that the base 16 is held in fixed engagement with the wall 12. The exemplary base 16 further includes forward projecting portions 50. The forward projecting portions 50 are separated by a gap 52.

Figure 11:
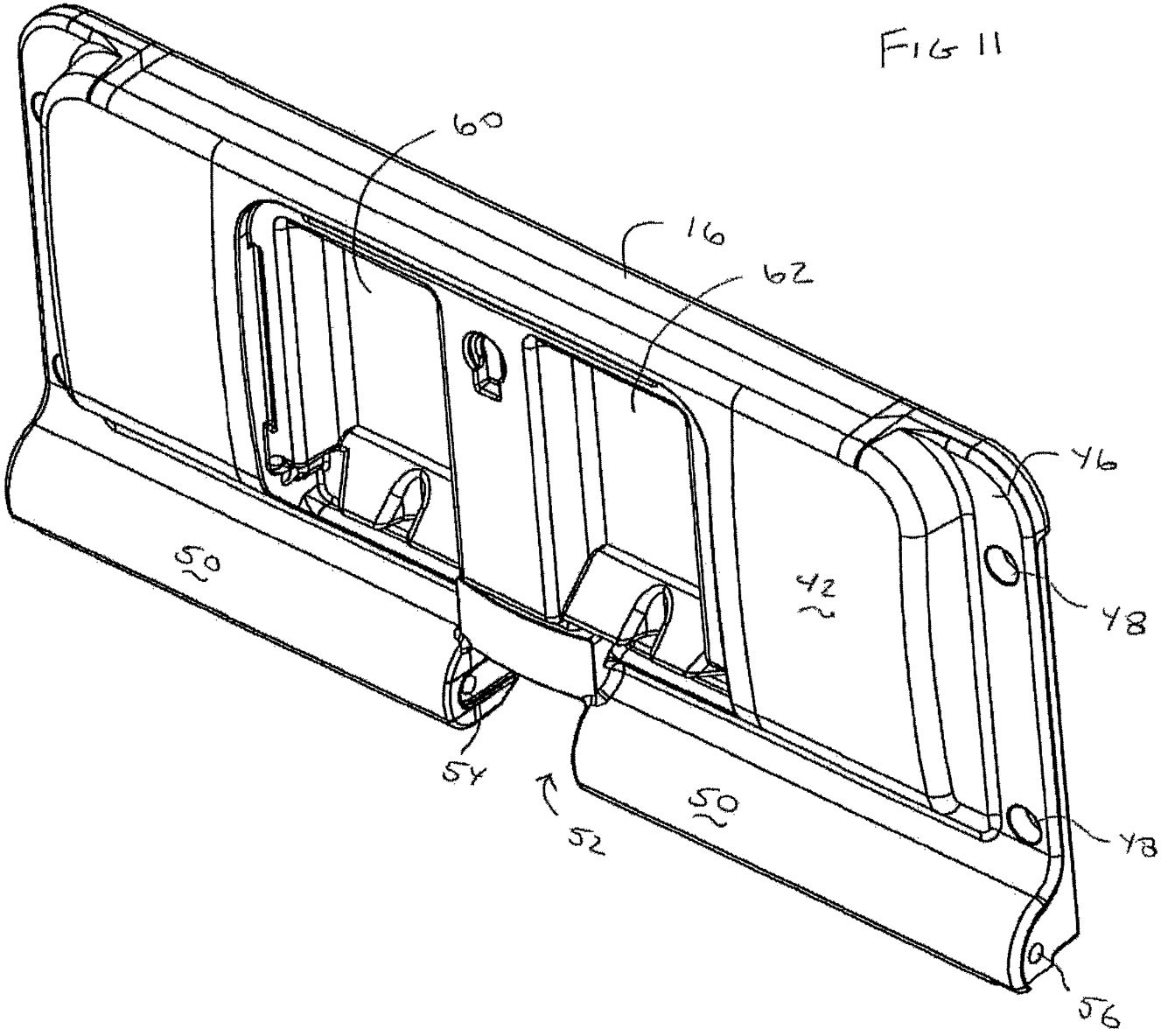
FIG. 11 is an upper right perspective view of the base.
Figure 12:
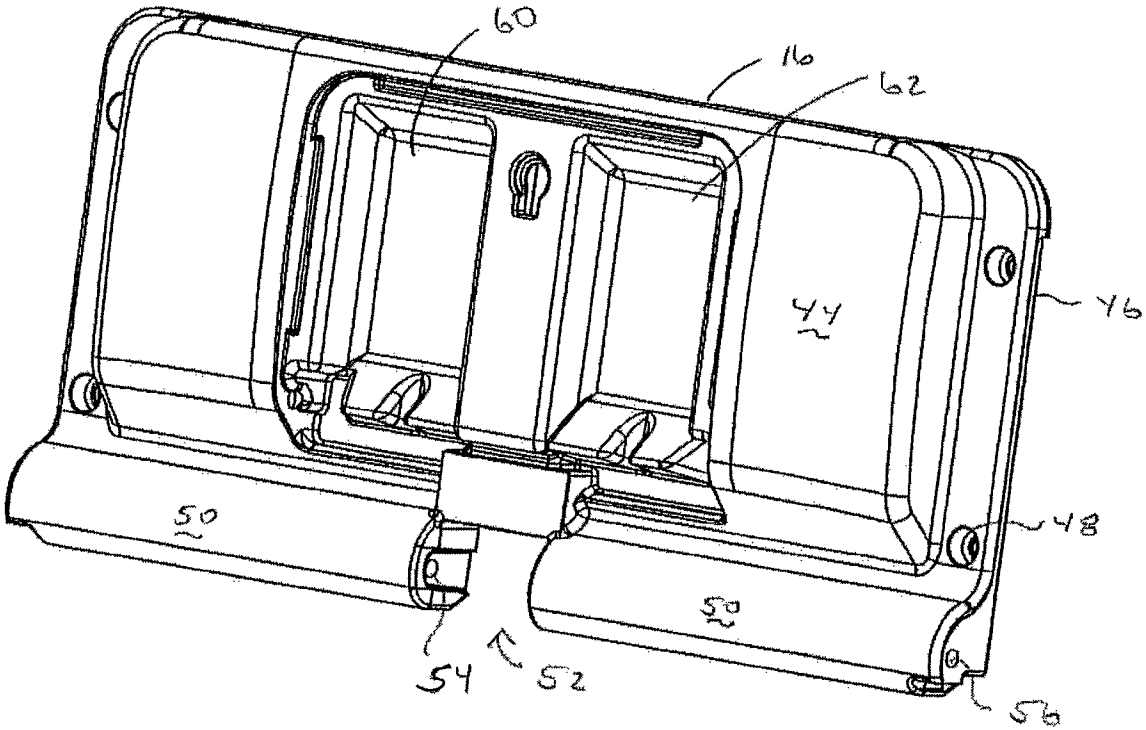
FIG. 12 is a lower right perspective view of the base.
Figure 13:
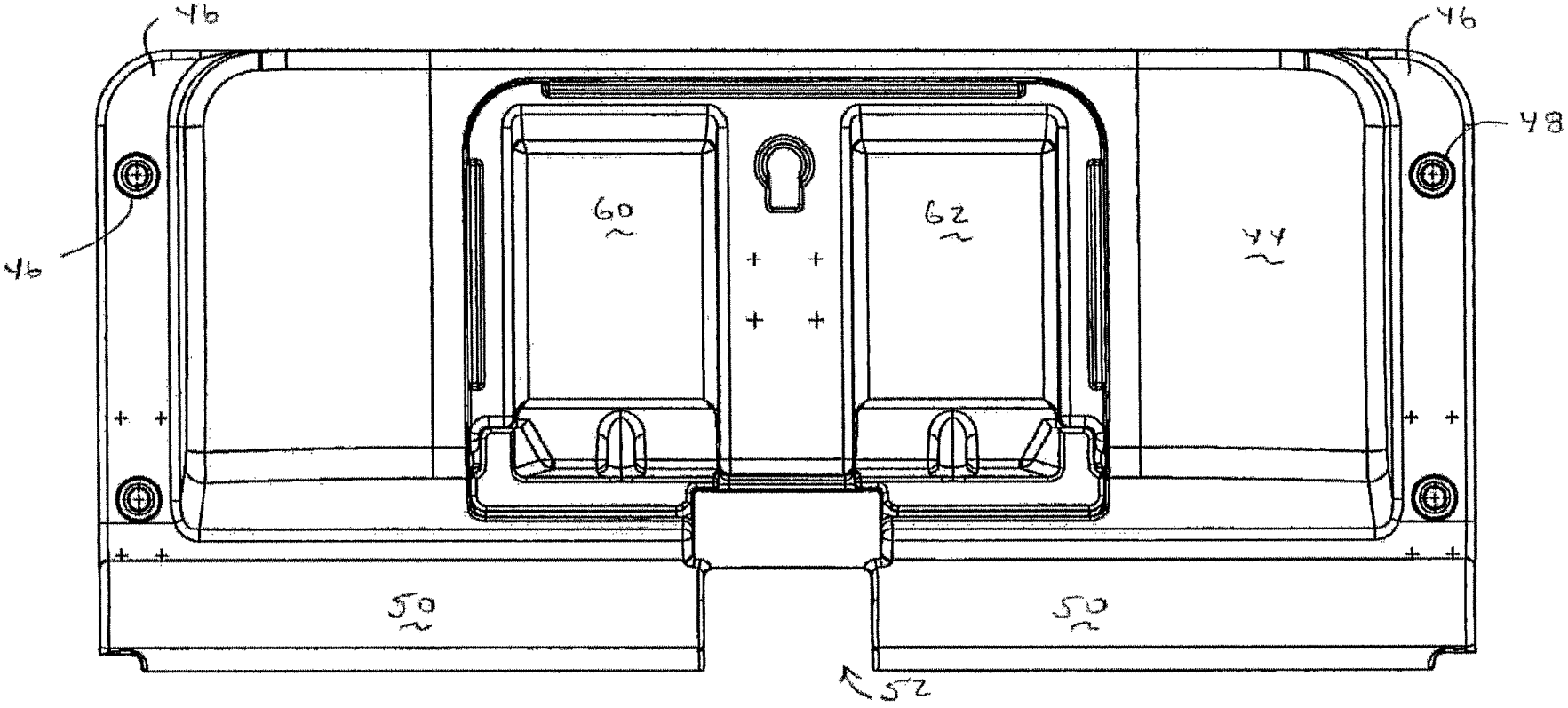
FIG. 13 is a front plan view of the base.

The gap 52 is sized for accepting the bearing block 36 therein in relatively rotatably movable connection. The forward projecting portions 50 each include openings 54 and 56 therein as shown in FIG. 11. Openings 54 and 56 are aligned with openings 38, 40 and 42 to enable an axle shaft to extend therein in the manner later discussed. As shown in FIG. 2 with the changing station in the use position, the forward projecting portions 50 upwardly bound the changing surface 18 at the inward side adjacent to the base 16.

Figure 35:
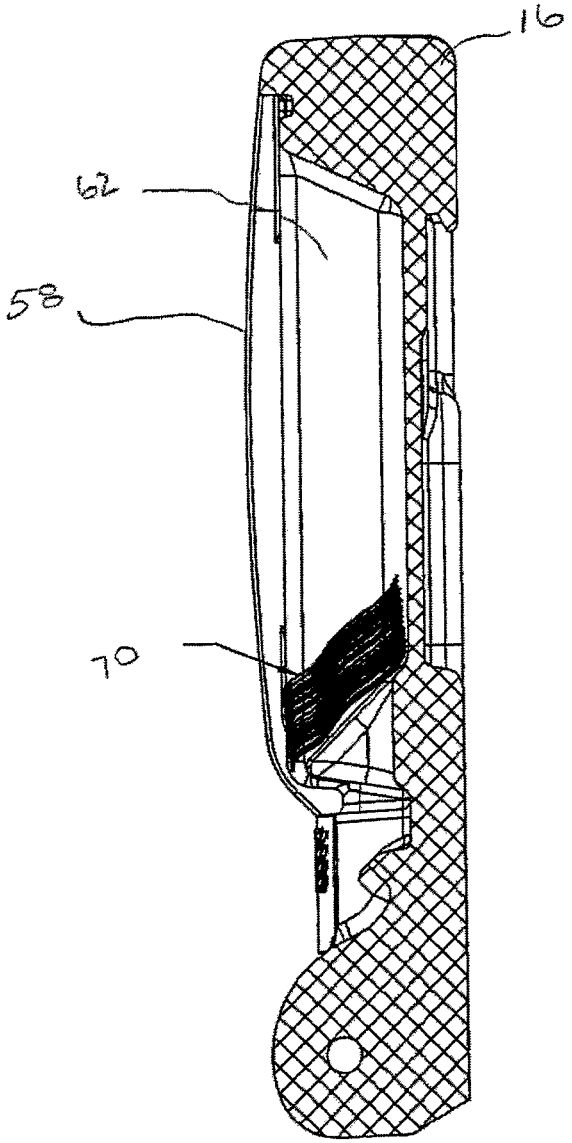
FIG. 35 is a transverse cross-sectional view of the base along line 35-35 in FIG. 34.
Figure 36:
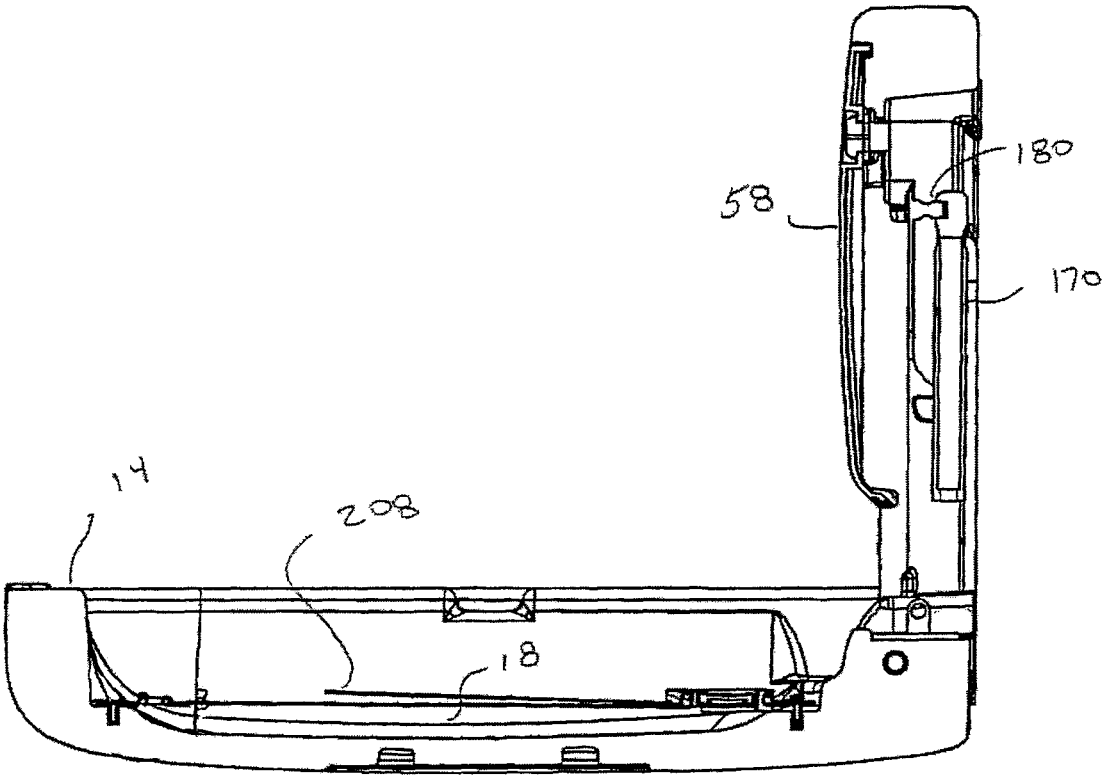
FIG. 36 is a right side transparent view of the baby diaper changing station in a use position and showing the exemplary holding strap assembly arrangement.
Figure 38:
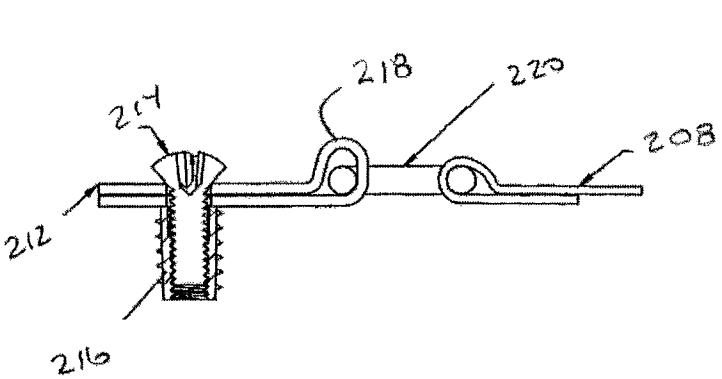
FIG. 38 is a transverse cross-sectional view of the mounting structures at one end of the strap assembly.
Figure 37:
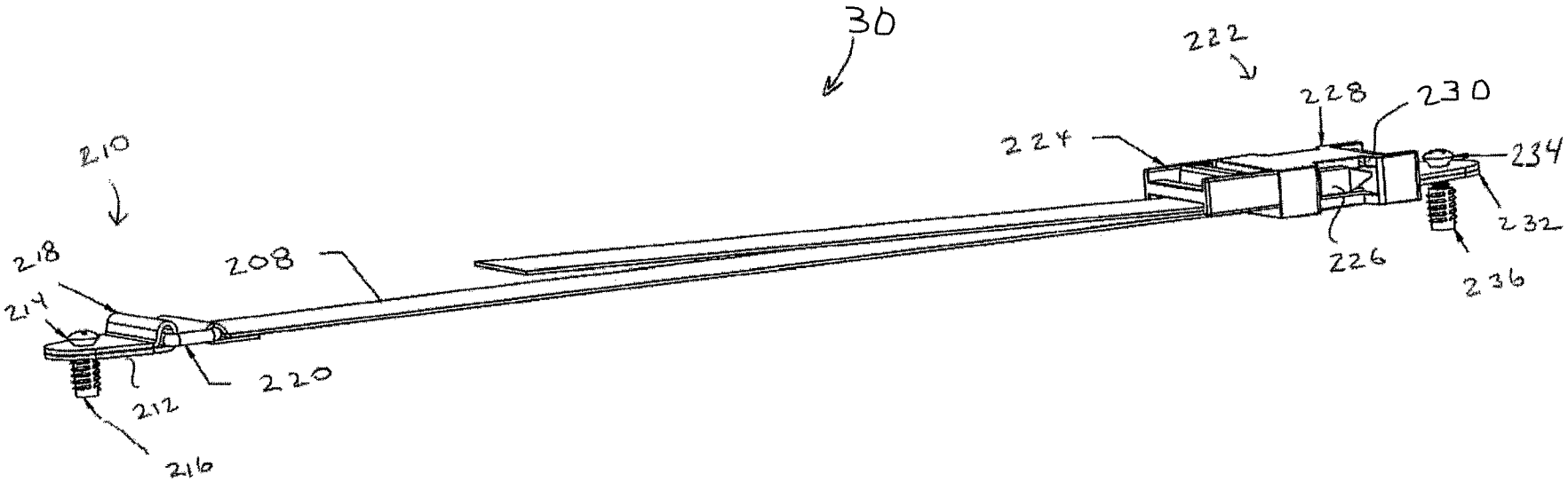
FIG. 37 is a perspective view of the exemplary holding strap assembly.

The exemplary base 16 further includes a removable cover 58. The cover 58 is configured to overlie a pair of storage compartments 60, 62 that extend in the central portion 44. The cover 58 is releasably secured by a lock 64 in the exemplary arrangement. Storage compartments 60 and 62 are connected to respective slots 66, 68 at the lower end thereof. As later discussed, disposable liners that can be placed on the changing surface 18 may be stored in the storage compartments 60, 62 and can be removed one at a time by users of the changing station through the slots 66, 68 when the cover 58 is in position. FIG. 35 shows a stack of liners 70 which are positioned in the storage compartment 62. Of course it should be understood that this configuration is exemplary and other arrangements other approaches may be used.

In the exemplary arrangement the base 16 is comprised of molded plastic material similar to the table 14. Further the base is configured so that the table extends in outwardly overlying relation of the base 16 when the table is in the stored position. In the stored position of the exemplary arrangement, the central portion 44 of the base extends within the recess of the table that is bounded by the rim 26. This provides for the exemplary changing station to be compact and to extend only a relatively small distance from the wall 12 when in the stored position. Of course this construction is exemplary and in other arrangements other approaches may be used.

Figure 14:
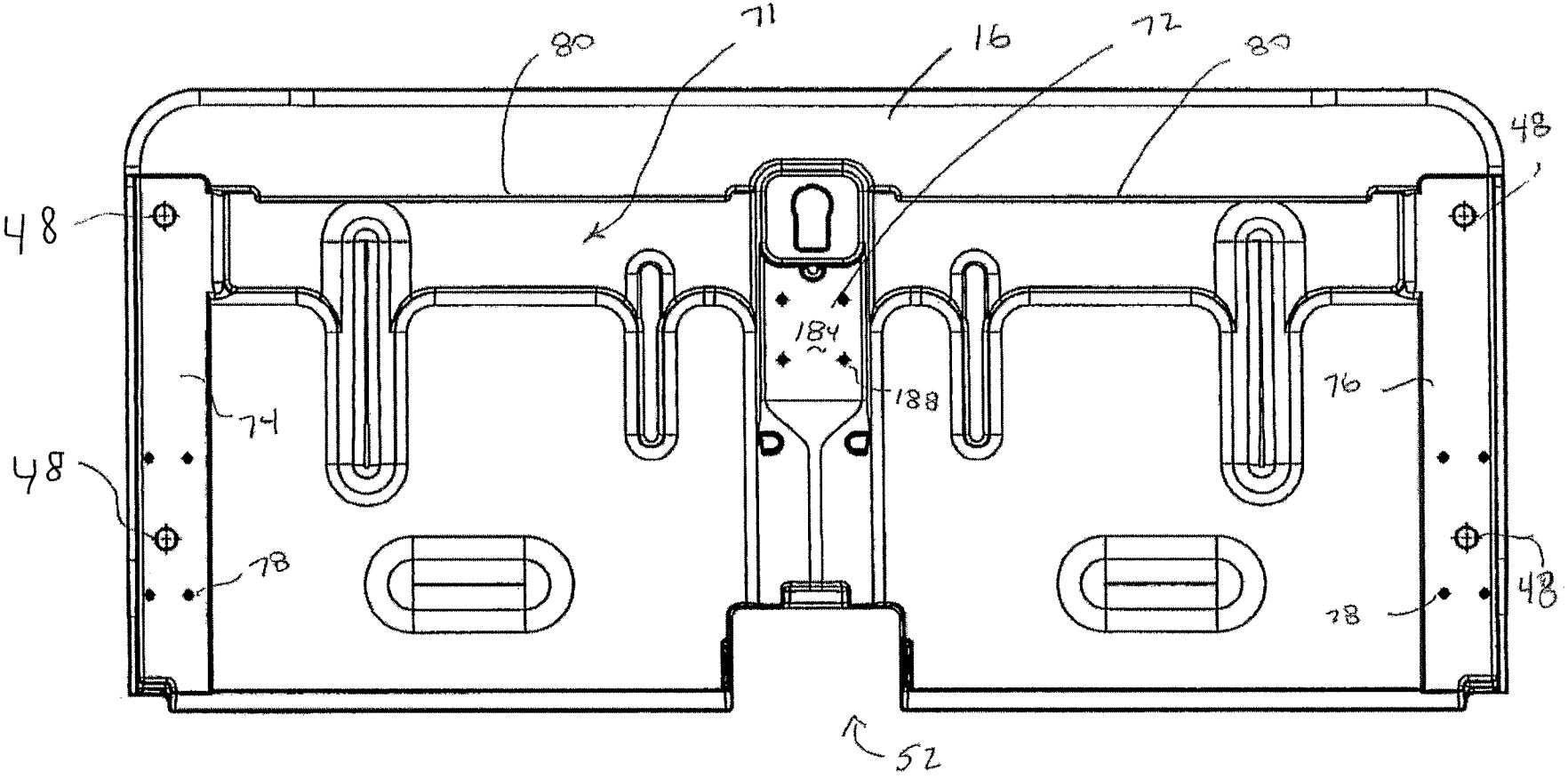
FIG. 14 is a back view of the base.
Figure 15:
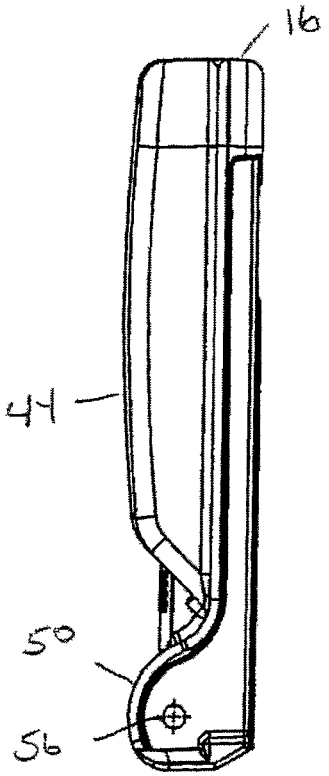
FIG. 15 is a right side view of the base.
Figure 41:
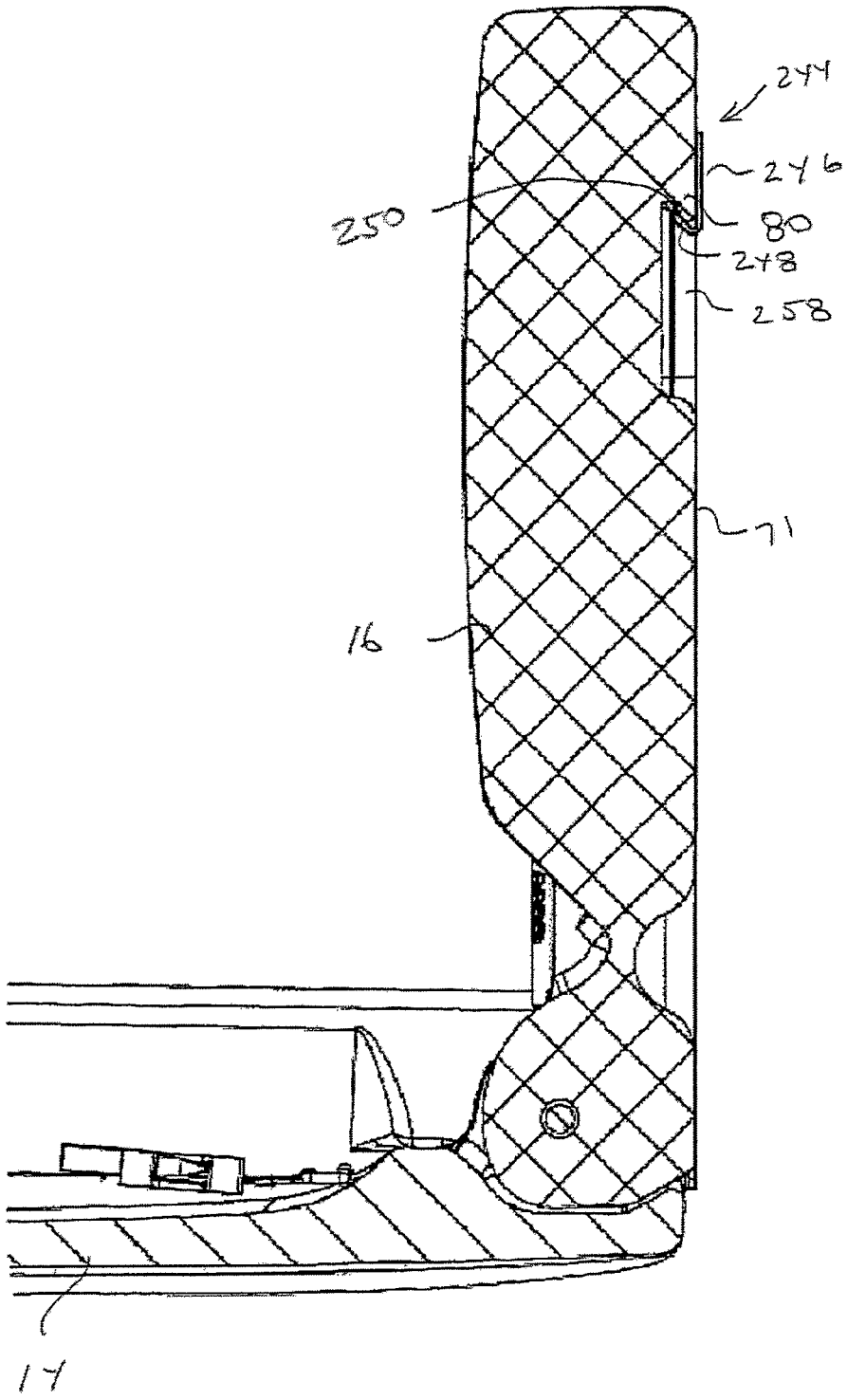
FIG. 41 is a transverse cross-sectional view of the base and the table, showing the base in engagement with the mounting bracket.

FIG. 14 shows the back side of the exemplary base 16. The back of the exemplary base includes a back surface 71. The back surface 71 includes a central recess 72. The central recess 72 extends in substantially aligned relation with the gap 52. As used herein substantially aligned means that there is at least some transverse overlap between the area of the central recess and the gap. The central recess 72 is operative to hold components of a spring assembly which are later discussed in detail. The back surface 71 of the base further includes a rectangular side recess 74 at a first transverse side of the base 16, and a rectangular recess 76 at an opposed transverse side of the base surface 71. The openings 48 are used for mounting anchors that extend in the recesses. Fastener openings 78 also extend into the base surface within the recess for purposes of mounting the base brackets thereto as later discussed. The exemplary base surface further includes on the rear wall, an edge surface 80. The edge surface 80 extends on both transverse sides of the central recess 72. The edge surface also overlies a horizontal recess 258 that extends below and underlies the edge surface (as shown in FIG. 41). The edge surface 80 extends downward in the operative position and is used in mounting of the changing station to a wall or other supporting structure in a manner that is later discussed. Of course it should be understood that this arrangement is exemplary and other configurations may be used.

Figure 26:
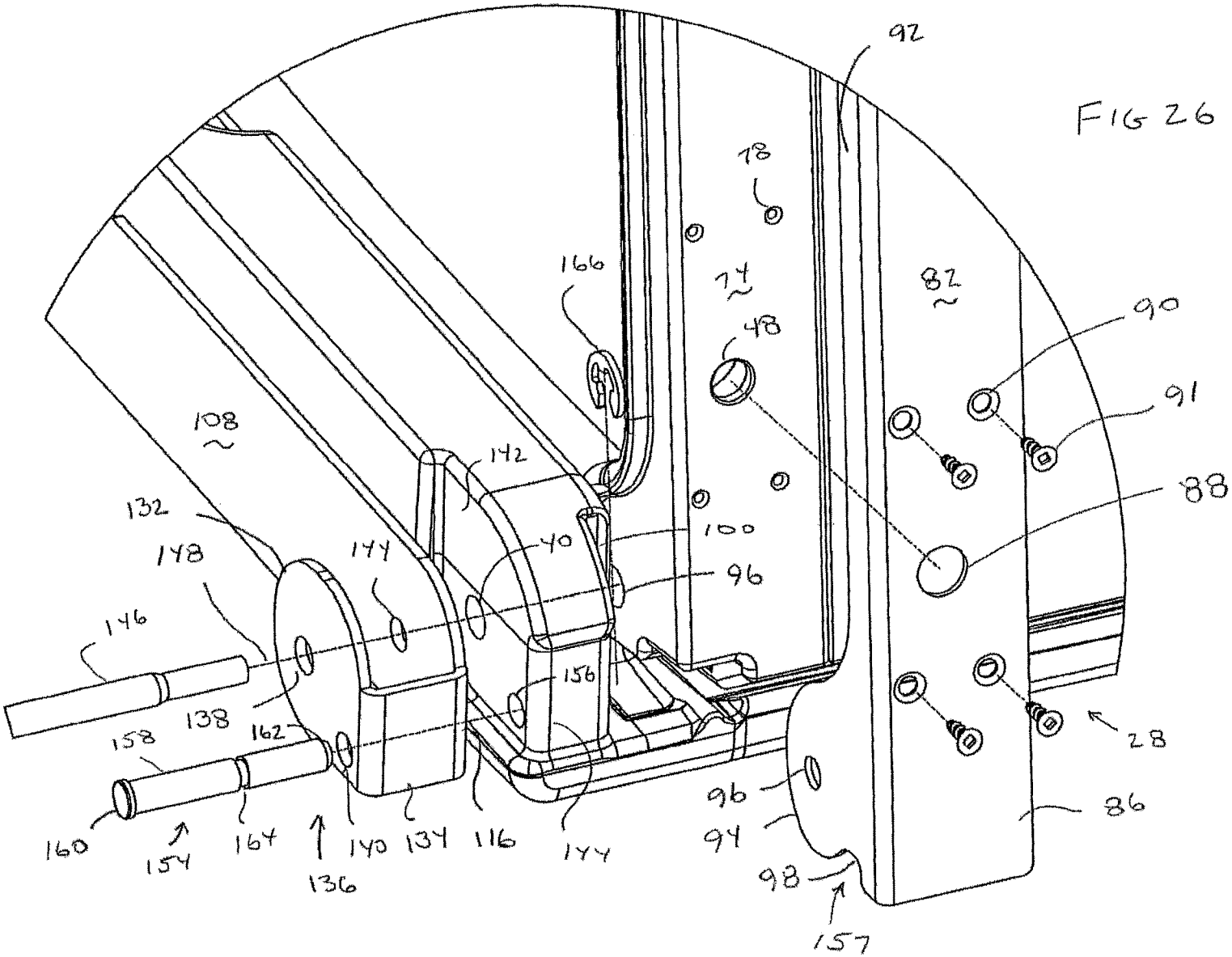
FIG. 26 is an exploded view showing the table and a channel therein, a rail, a clevis and a bridge piece, the base, the base bracket, an axle shaft portion and a stop pin.
Figure 27:
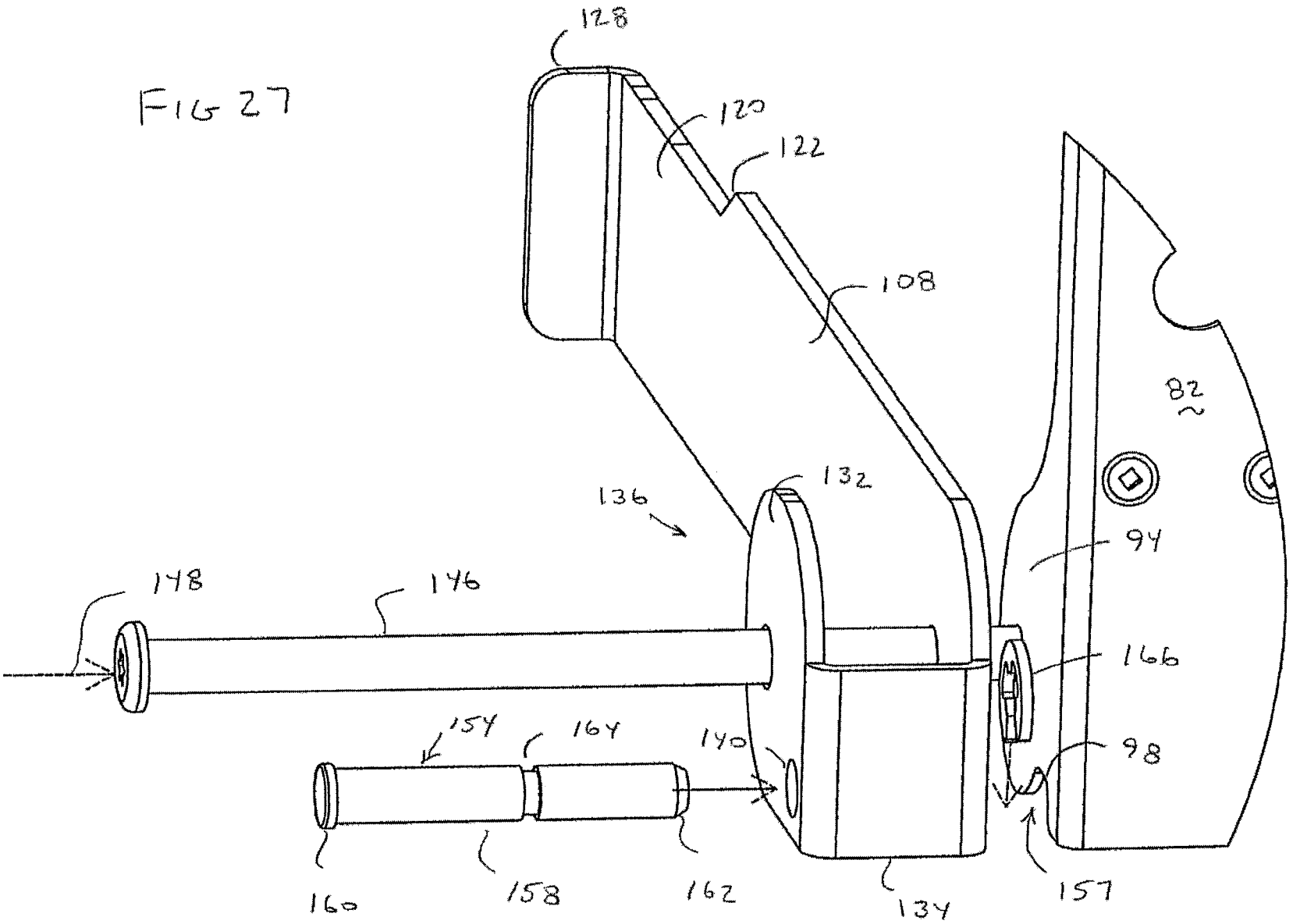
FIG. 27 is a view similar to FIG. 26 but with the table and base structures not shown.
Figure 28:
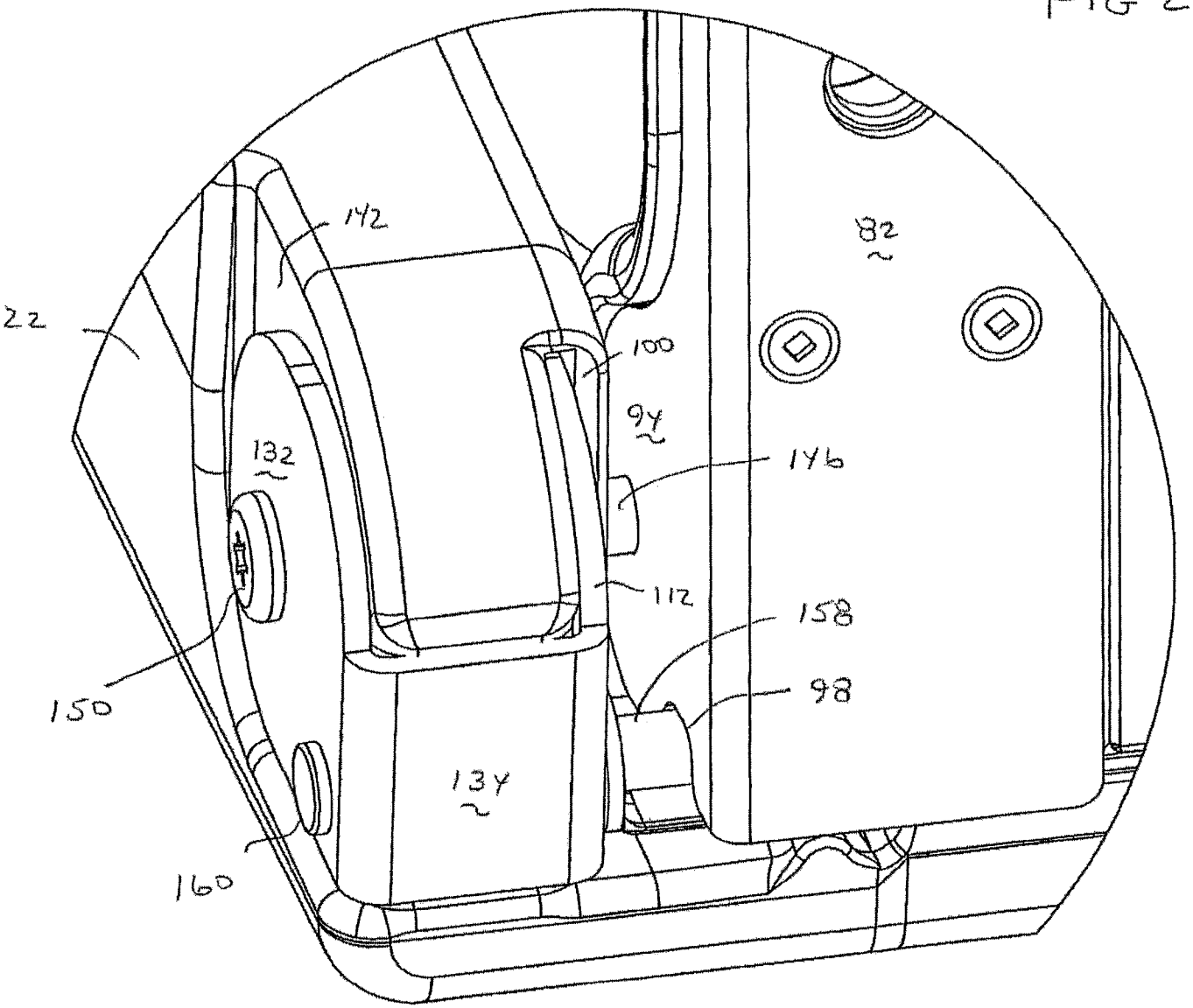
FIG. 28 is a back upper right perspective view showing the table, the base, the base bracket and the rail, the clevis and the bridge piece in an assembled condition.
Figure 29:
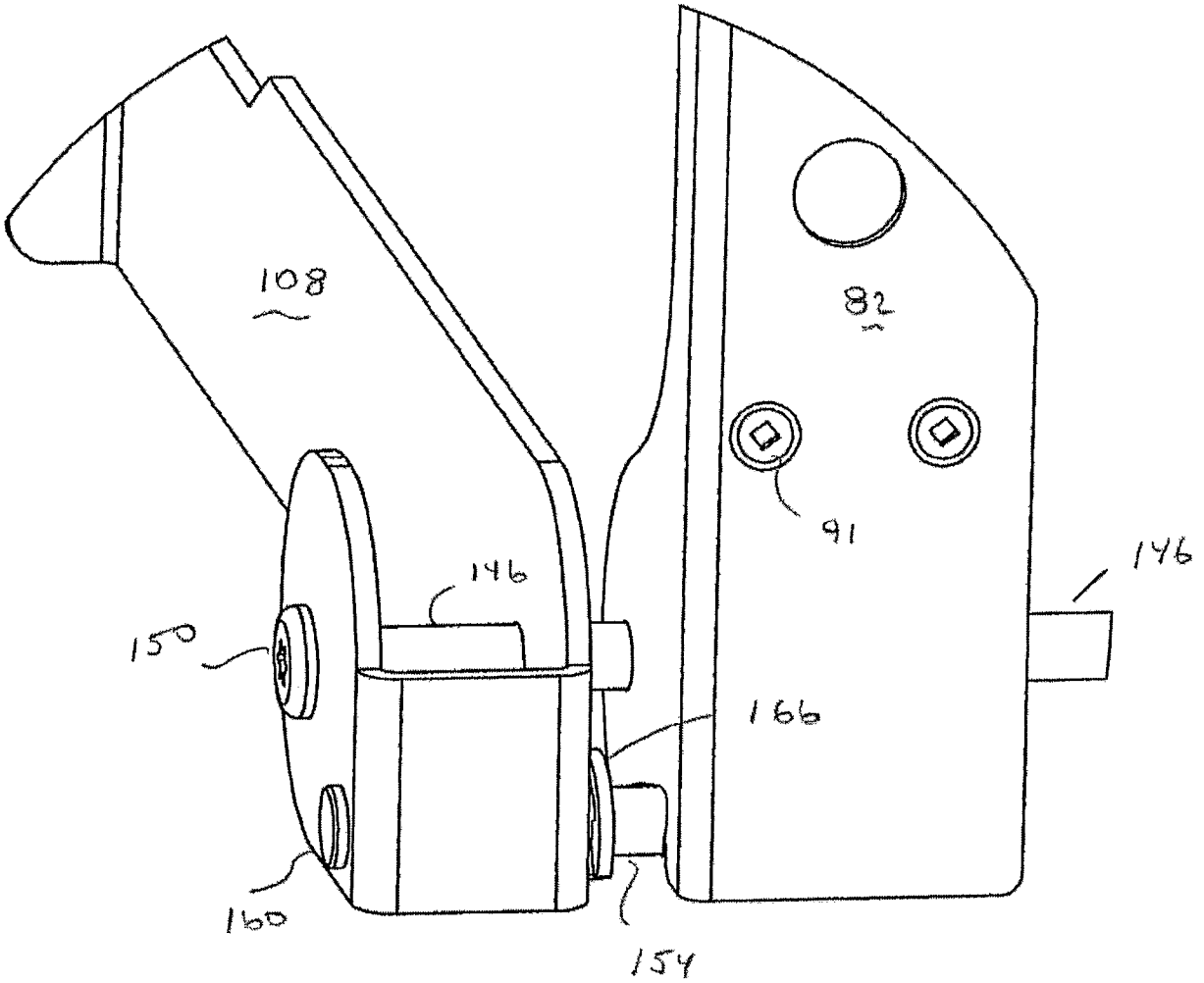
FIG. 29 is a view similar to FIG. 28 except with the table and base structures not shown.

A base bracket 82 extends in side recess 74. A base bracket 84 which is a mirror image of base bracket 82 extends in side recess 76. Each base bracket is generally L-shaped in transverse cross-section which for purposes hereof means that the legs of the bracket extend substantially perpendicular to one another. Each bracket includes a back leg 86. The back leg extends substantially parallel to the wall 12 in the mounted position of the base 16. As used herein substantially or generally parallel will be deemed to mean parallel plus or minus 20°. Each back leg includes openings 88 that are in alignment with openings 48 through which the anchors extend. The back legs further include fastener accepting openings 90. The fastener accepting openings 90 are aligned with the openings 78 in the base. As shown in FIG. 26, fasteners such as screws 91 are used to hold each base bracket in engagement with the base.

Each exemplary base bracket further includes a forward leg 92. Each forward leg extends substantially perpendicular to the respective back leg of the base bracket. Each forward leg includes an ear 94. Each ear extends substantially normal to the wall in the operative position of the changing station. Each ear 94 includes an outwardly curved contour that includes an opening 96 therein. The opening 96 in each ear 94 is in aligned relation with a respective opening 56 in the forward projecting portion 50 of the base.

Each opening 96 is further configured to have a portion of the axle shaft extend therethrough. Each exemplary forward leg 92 includes a curved recess 157 that is bounded by a stop surface 98 thereon. In the exemplary arrangement the stop surface 98 is configured to engage a stop pin that is in operative connection with the table 14. The engagement of the stop pin and the stop surface 98 is operative to hold the table in the use position, and to prevent the table from rotating downward beyond the use position in a manner that is later discussed. Of course it should be understood that this configuration is exemplary and in other arrangements other approaches may be used.

The exemplary table 14 includes a pair of transversely disposed linearly straight channels 100, 102 therein. Each channel extends within the interior of the rim 26. Channel 100 extends transversely inwardly and substantially parallel to side wall surface 22, while channel 102 extends transversely inwardly and substantially parallel to side wall surface 20. Channel 100 extends from a channel opening 104 in the inner end surface 28 at one transverse side of the table 14. Channel 102 extends from a channel opening 106 at an opposed transverse side of the inner end surface.

Each channel opening is configured to receive a rail therein. Channel 100 receives a rail 108 while channel 102 receives a rail 110. In the exemplary arrangement the rails 108, 110 are mirror images of each other. As the rails are mirror images, only rail 108 will be described in detail. The details of each of rails 108 and 110 will be referred to using the same reference numerals except as otherwise noted.

Figure 23:
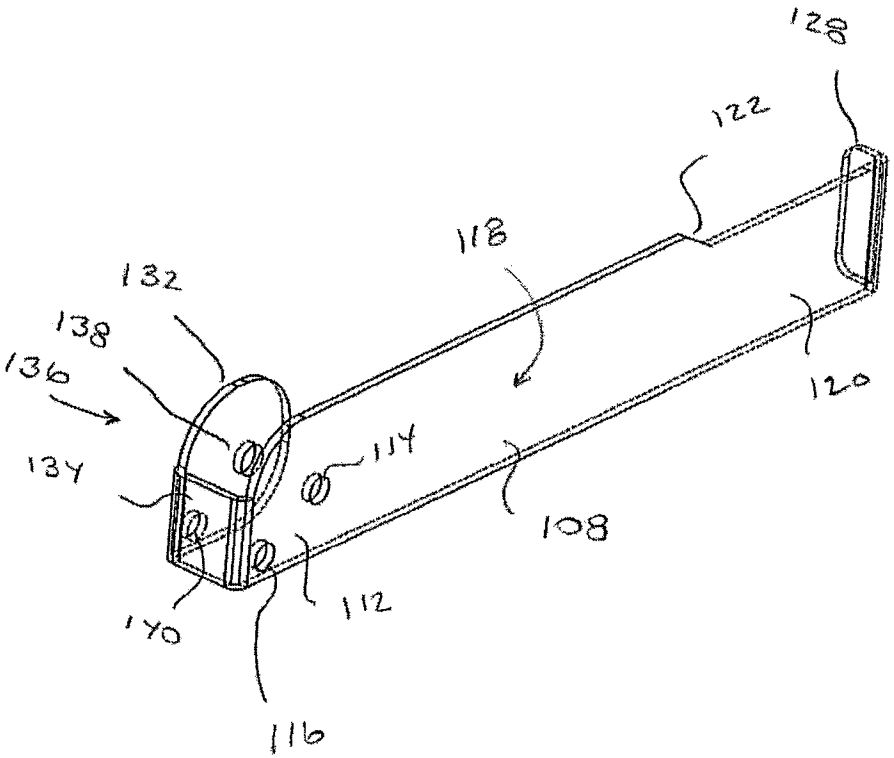
FIG. 23 is an upper left back perspective view of an exemplary rail, clevis and bridge piece.
Figure 24:
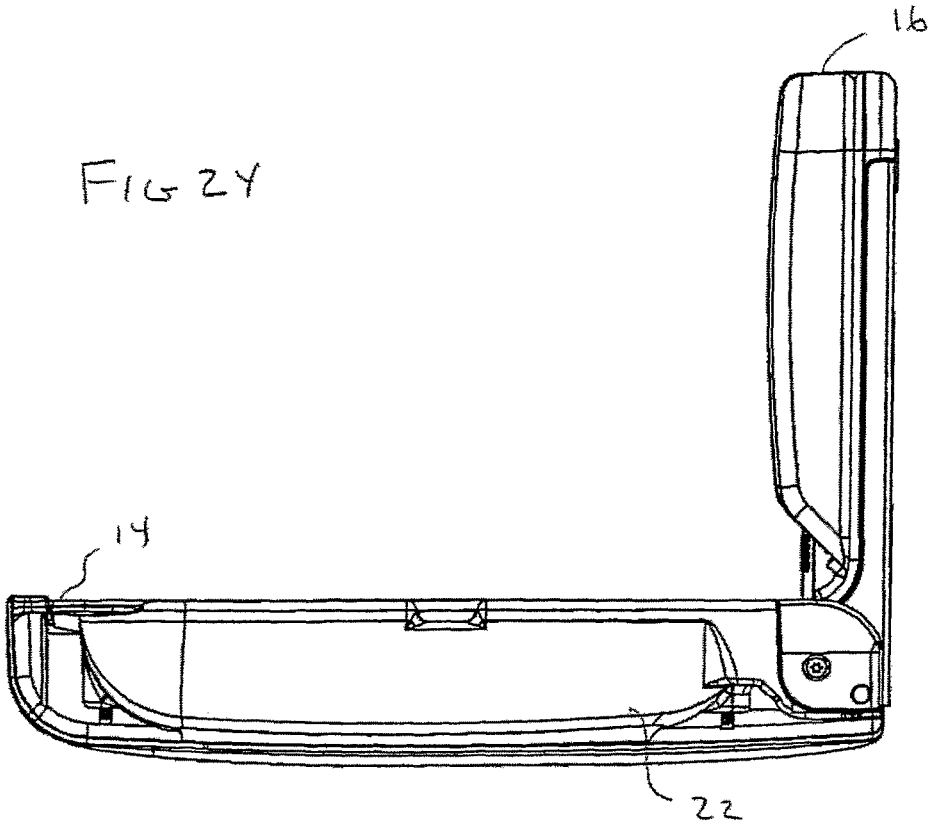
FIG. 24 is a right side view of the exemplary baby changing station in a use position.

As shown in FIG. 23 the exemplary rail 108 includes a rail end 112. When the rail is positioned in the operative position within the respective channel, the rail end is proximate to the respective channel opening and is accessible from the outside of the table. The exemplary rail end 112 of rail 108 includes a shaft opening 114 and a stop pin opening 116. The shaft opening 114 is aligned with the opening 96 of an adjacent ear 94 of an immediately adjacent base bracket. The shaft opening 114 is configured to receive an axle shaft portion therein and to rotate about an axis 148 when the unit is in the operative assembled condition as later discussed.

Figure 21:
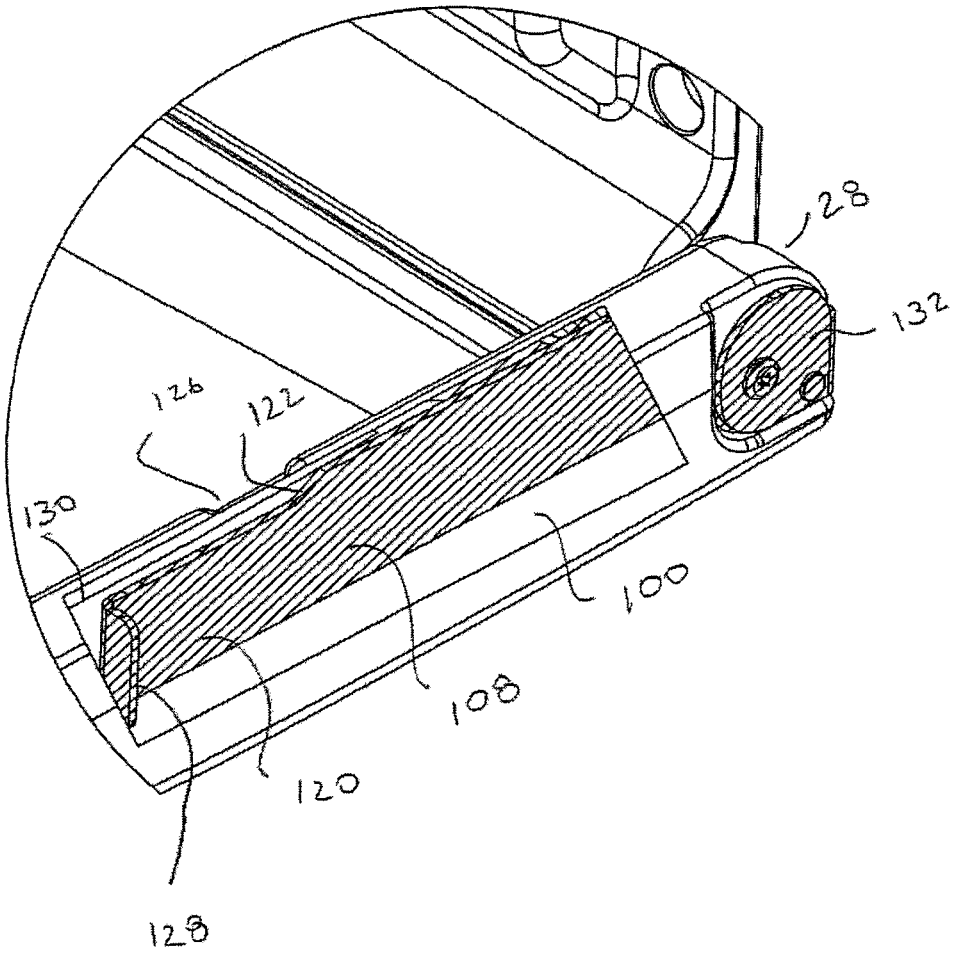
FIG. 21 is an enlarged partial cutaway perspective view of a side of the table showing a rail in a channel that extends in the channel.

The exemplary rail 108 includes an elongated plate 118. The elongated plate 118 is configured to extend within the respective channel substantially perpendicular to the axis and substantially parallel to the outwardly overlying side wall. In the case of rail 108 the elongated plate extends in channel 100 substantially parallel to side wall surface 22. This is shown for example in FIGS. 21 and 22. The exemplary rail 108 further includes a reduced area 120. The reduced area extends at an end of the rail that is disposed inwardly in the channel from the rail end 112. The reduced area 120 is reduced in at least one dimension relative to the rail end. In the exemplary arrangement the reduced area is reduced in a height dimension relative to the rail end. A tapered step engagement surface 122 provides the dimensional transition from the outer portion of the rail which includes the rail end to the reduced area 120.

Figure 22:
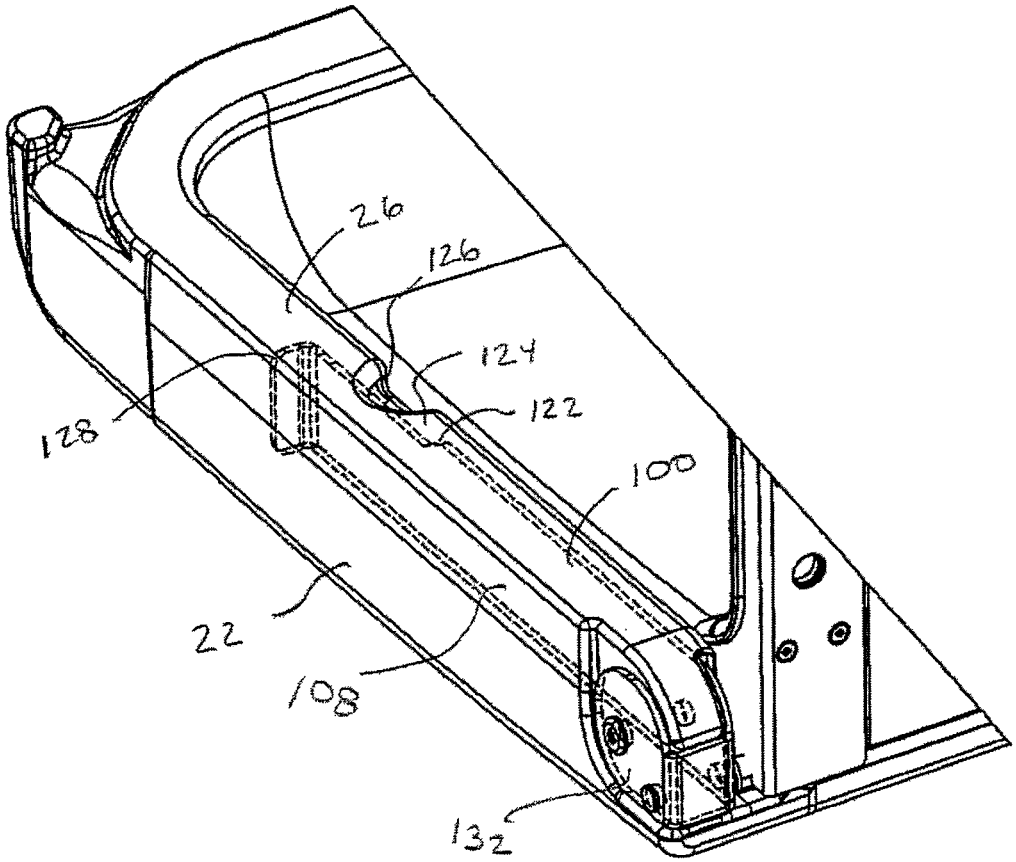
FIG. 22 is a rear right top perspective view showing in phantom a rail extending in a channel of the table.

In the exemplary arrangement the respective channel in which the rail extends includes an internal step 124. As shown in FIG. 22 the internal step 124 underlies a side recess 126 that extends inwardly in the rim 26. The step engagement surface 122 of the rail engages the internal step 124 within the channel 100. The engagement of the internal step 124 and the step engagement surface 122 helps to maintain engagement of the table and the respective rail within the channel. This engagement also helps to assure proper positioning of the rail within the respective channel. Of course it should be understood that this approach is exemplary and in other arrangements other approaches may be used.

Figure 25:
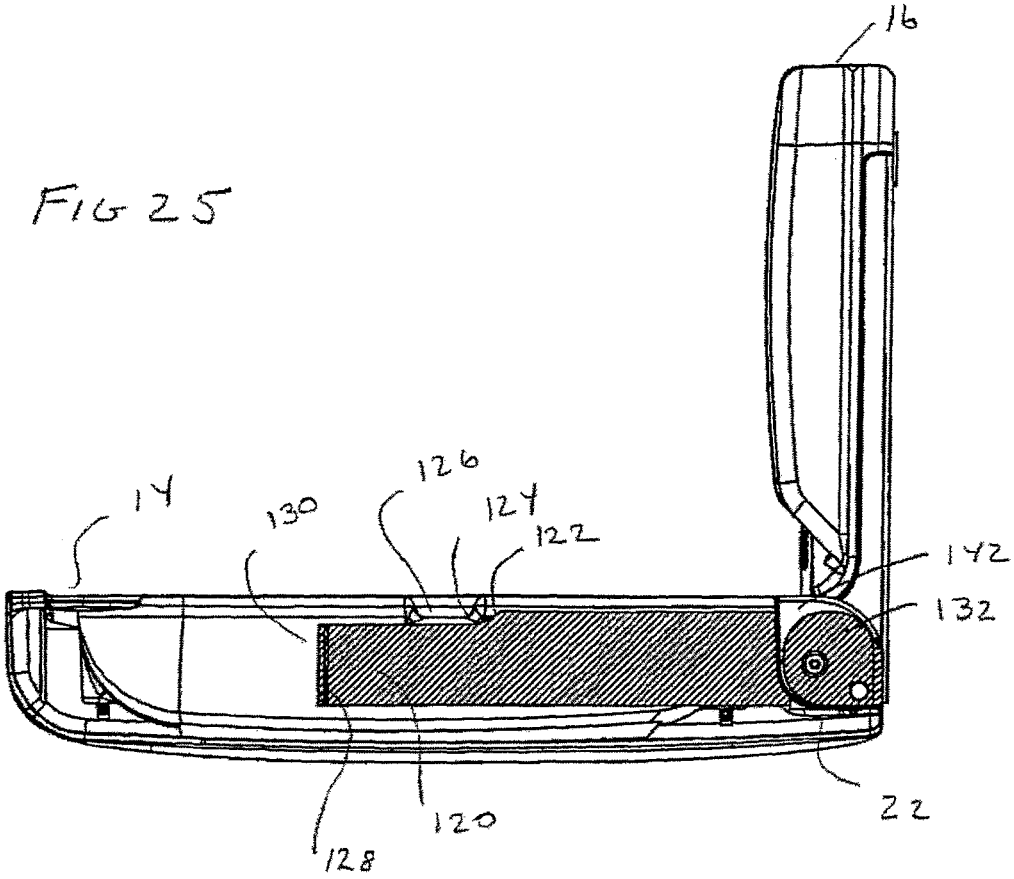
FIG. 25 is a view similar to FIG. 24 but with the side of the table partially cutaway to show a rail extending in a channel therein.

In the exemplary rail configuration the reduced portion 120 terminates inwardly within the respective channel at a turned inside end 128. The turned inside end 128 extends substantially perpendicular to the reduced area 120 of the elongated plate 118. The turned inside end 128 also extends substantially perpendicular to the side wall surface 22 that is in immediately adjacent relation with the channel 100. In the exemplary arrangement the channel 100 in which the respective rail 108 extends is bounded inwardly from the channel opening 104 within the rim by a channel end generally indicated 130 (see FIG. 25). In the exemplary arrangement the channel end 130 is at least halfway from the inner end surface 28 of the table to the outer end surface 24. In exemplary arrangements the channel end 130 is the furthest inward point within the channel into which the respective rail extends. In some exemplary arrangements the inward channel end 130 is an area within the interior of the rim 26 which is reduced in size, curved or otherwise constricted so that each substantially linearly extending straight rail cannot extend further inwardly in the table from the inner end surface. As used herein the term substantially linearly extending means that a majority of the element may extend along or about a straight line. In some exemplary arrangements the channel end 130 may include one or more walls, projections or other structures that are configured to engage the rail at the turned inside end 128 thereof. Such structures may provide further points of contact for solid engagement between the table and the rail, and also serve to position the rail within the channel. Of course these approaches are exemplary and other arrangements other approaches may be used.

The exemplary rail 108 is attached to an outboard end 132. The outboard end is attached to the respective rail end 112 by a bridge piece 134. This arrangement produces a clevis generally indicated 136. The outboard end 132 is disposed transversely outwardly from the rail end 112 and extends substantially parallel thereto. The outboard end 132 includes an opening 138 that is axially aligned with shaft opening 114 in the rail end and is configured for receiving an outboard portion of the axle shaft therethrough. The outboard end 132 further includes a stop pin opening 140 therethrough. The stop pin opening 140 is aligned with stop pin opening 116 in the rail end. In the exemplary arrangement in the operative position of the changing table, each outboard end 132 outwardly overlies the immediately adjacent side wall surface of the table 14. In the case of rail 108, the outboard end 132 transversely overlies side wall surface 22. In the exemplary arrangement each side wall surface includes a recess 142 in which the outboard end 132 extends. In the exemplary arrangement side wall surface 20 also includes a similar recess 142 which receives the outboard end 132 of rail 110.

Figure 20:
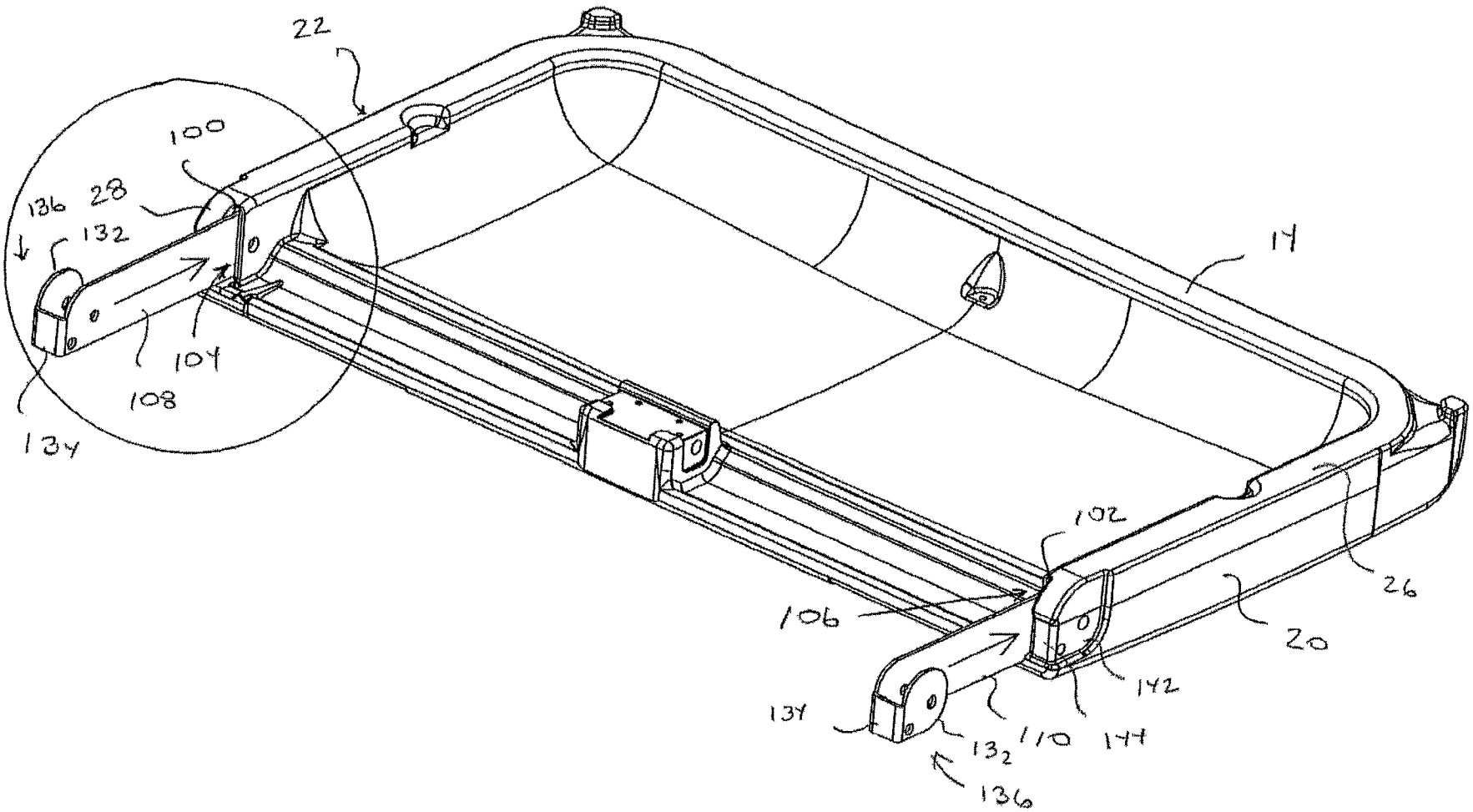
FIG. 20 is a rear top perspective view of the table showing exemplary rail structures being extended into respective straight linear channels within the table.

The inboard end 28 of the table 14 includes on each respective transverse side a recessed notch 144. Each notch 144 extends substantially parallel to the axis 148 and transversely between the immediately adjacent channel opening 104 or 106 and the immediately adjacent side wall surface 22 or 20. Each recessed notch 144 is configured to receive therein in nested relation a respective bridge piece 134 which also extends substantially parallel to the axis. This configuration of the exemplary arrangement further helps to assure that the rails 108 and 110 and the outboard ends 132 are in operatively fixed engagement with the table. As represented in FIG. 20, when the rails are inserted in the respective channels during assembly of the changing station, the bridge portions 134 fully nest within the respective recessed notch 144 at each lateral side of the inner end surface. This exemplary construction further helps to position the openings for the axle and the stop pins in alignment when the table is assembled. Of course this approach is exemplary and in other arrangements other approaches may be used.

Figure 16:
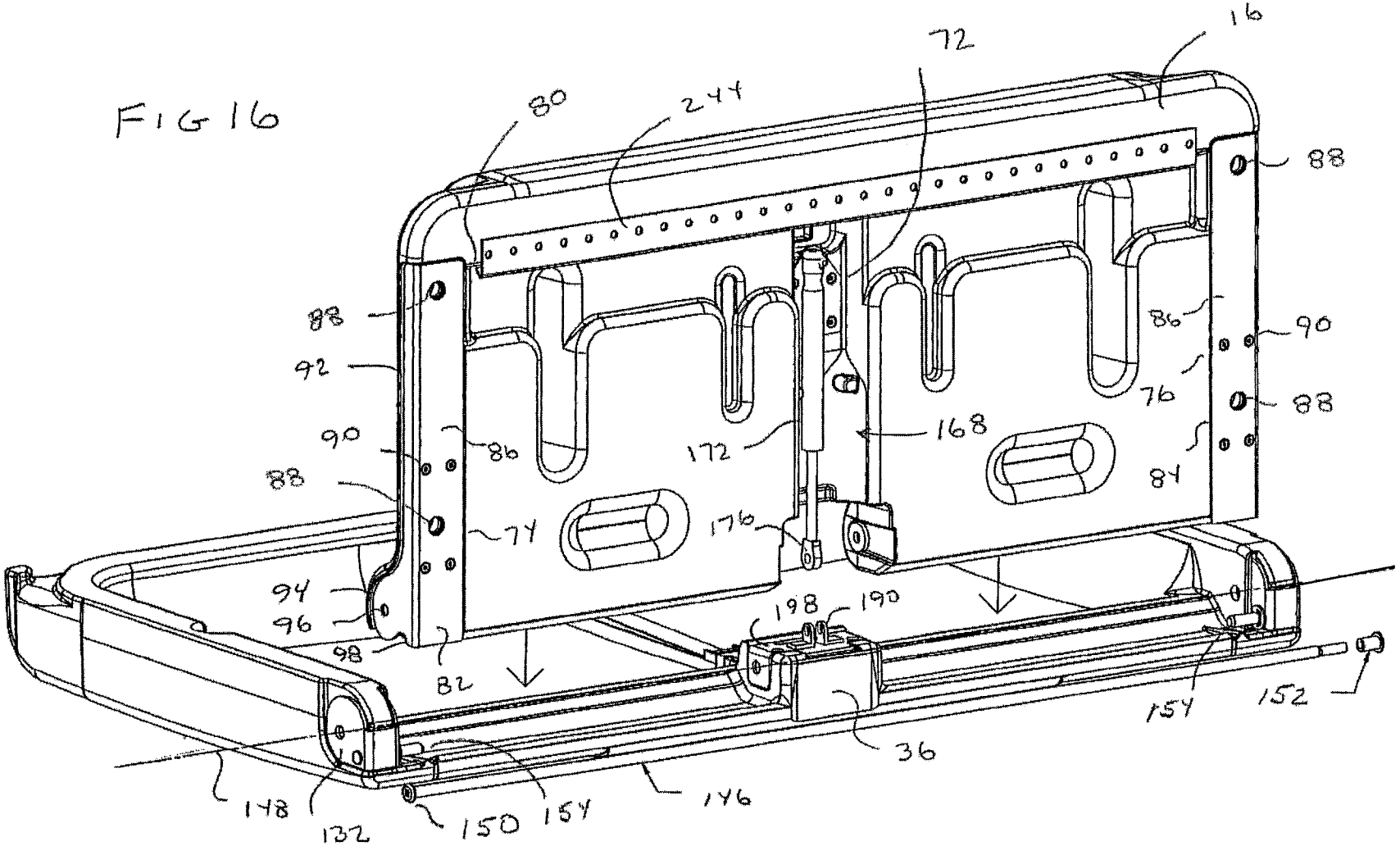
FIG. 16 is a rear partially exploded view of the baby diaper changing station including the base and the table.
Figure 17:
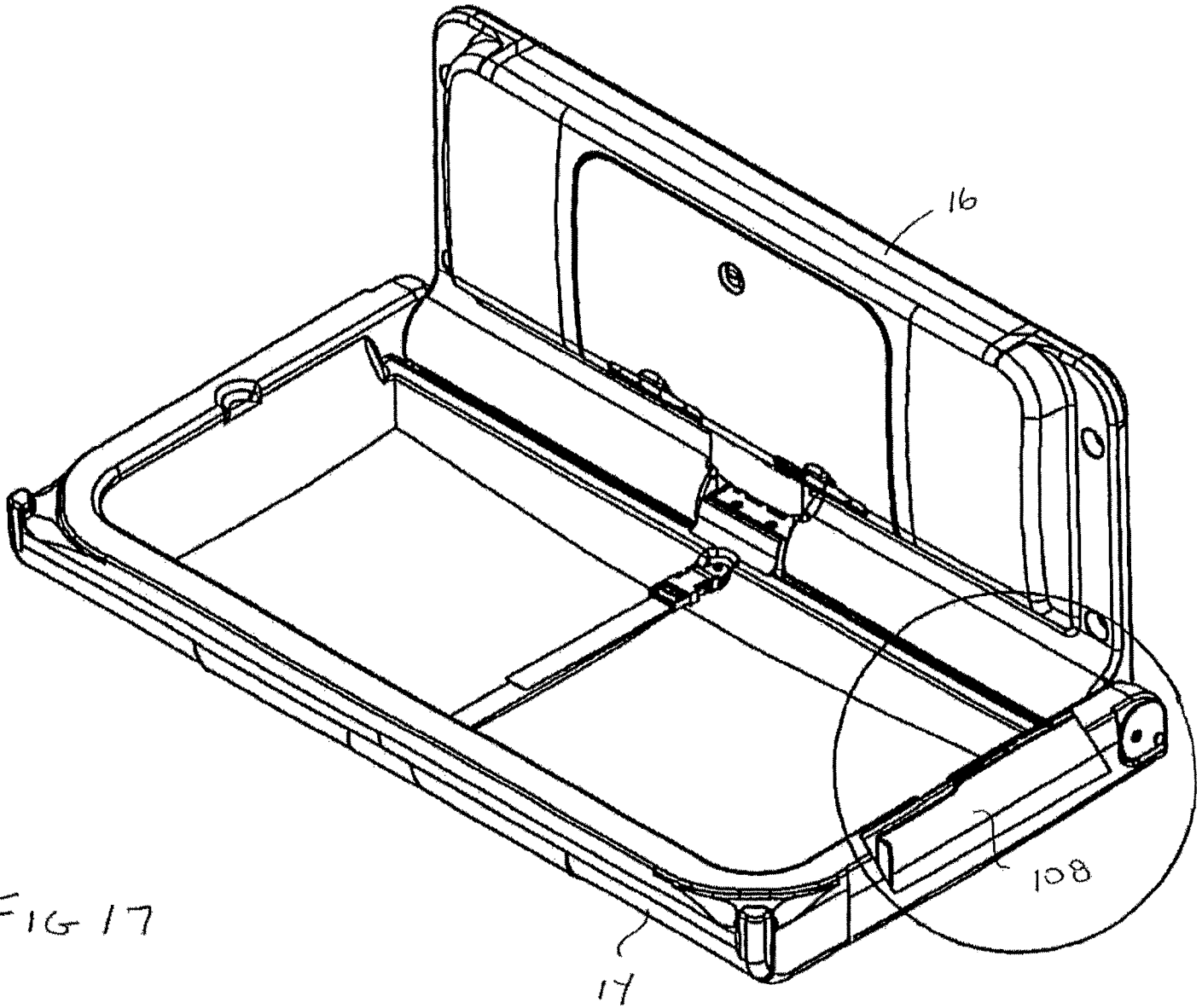
FIG. 17 is a front upper right perspective view of the baby diaper changing station in a use position with a portion of a circled area partially cutaway.
Figure 18:
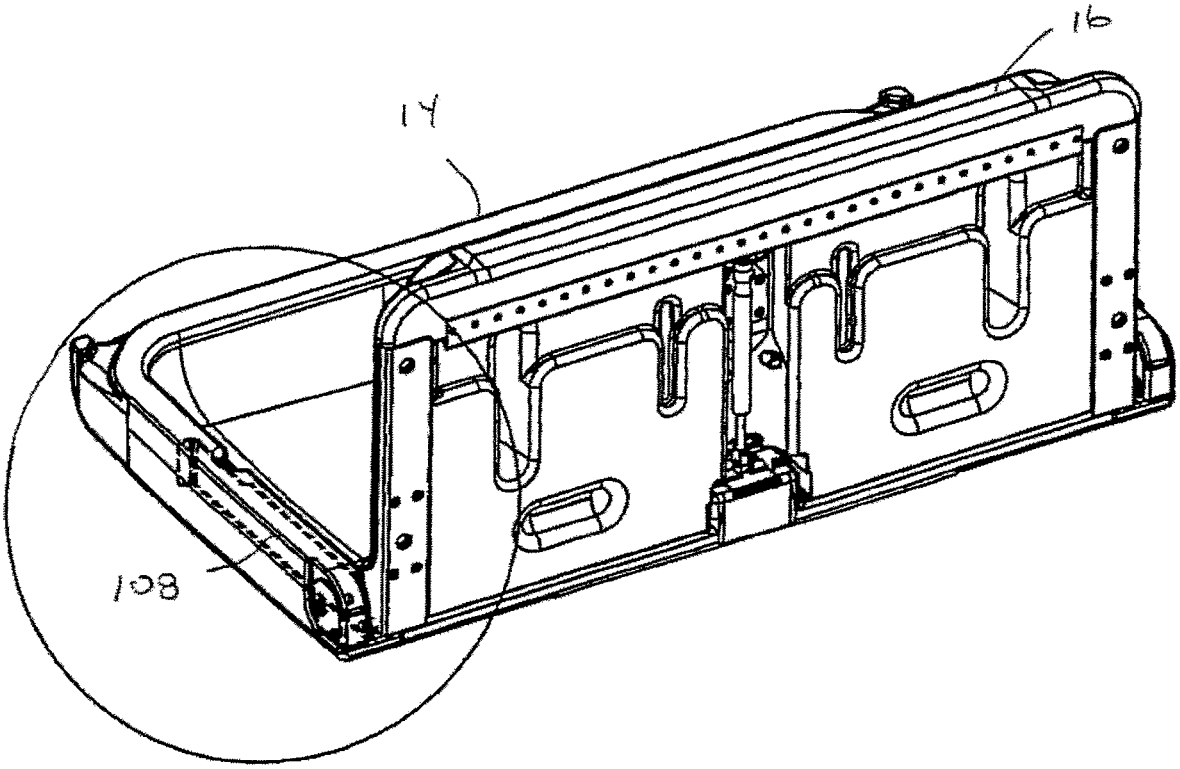
FIG. 18 is a top right rear perspective view of the baby diaper changing station in a use position and showing through hidden edge lines a support rail that extends within the table.
Figure 19:
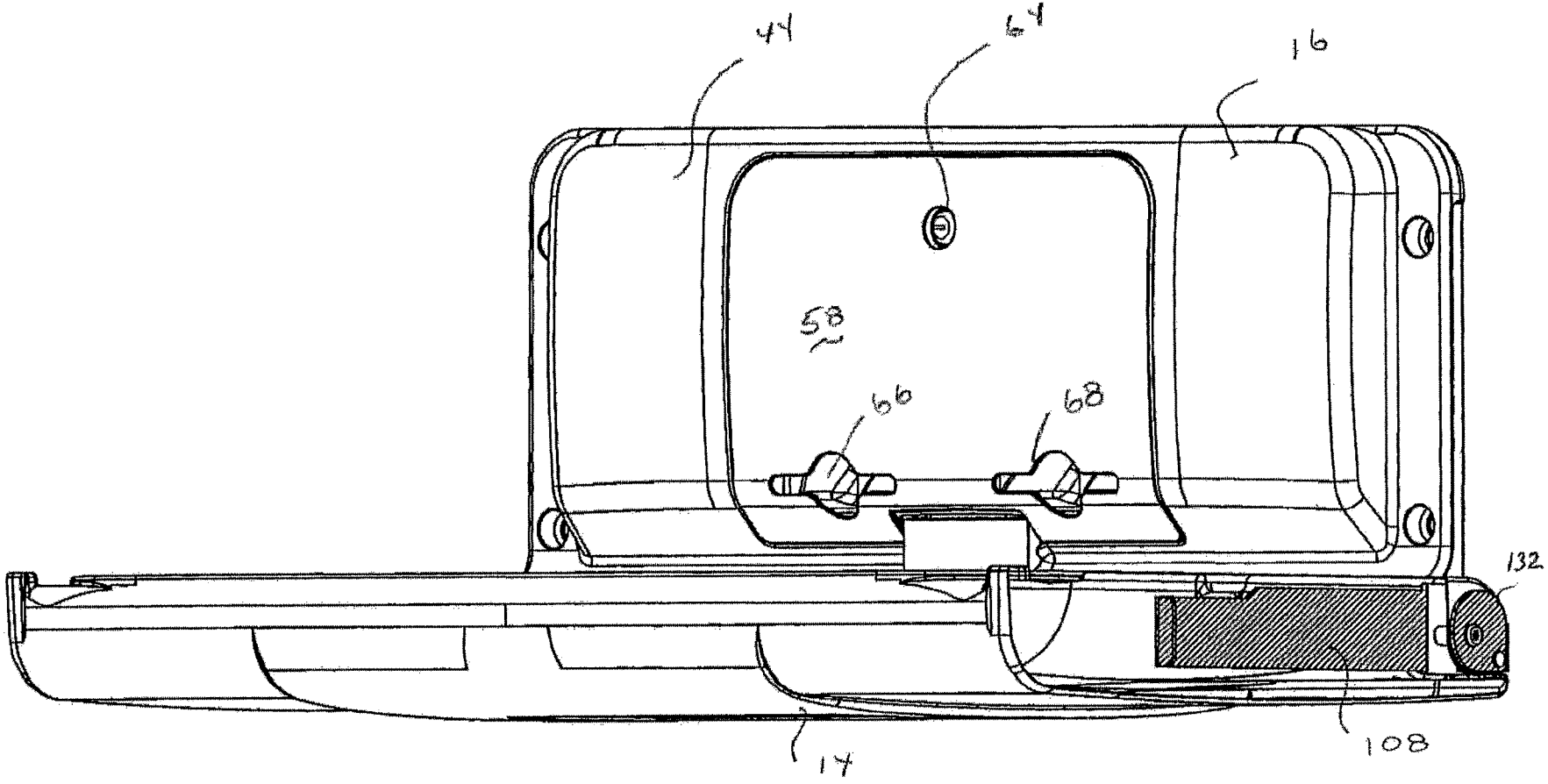
FIG. 19 is a front right perspective view of the baby diaper changing station with a portion of the table structure partially cutaway.

As represented in FIGS. 16 and 26 an axle shaft 146 extends through the aligned openings in the table and the base along an axis 148. In the installed position the axle shaft 146 extends through each clevis 136 associated with rails 108, 110 as well as the opening 96 in each ear 94 of base brackets 82, 84. In the installed position the axle shaft 146 also extends through the openings 38 in the bearing block 36, the openings 54, 56 in the forward projecting portion 50 of the base, and the openings 40, 42 at the inner end surface 28 of the table. This enables the table 14 to rotate about the axis 148 between the use position and the stored position. In the exemplary arrangement the axle shaft 146 when installed is maintained in position by an enlarged head 150 at one transverse end that engages one outboard end 132, and a retaining nut 152 which is positioned at the opposed transverse end of shaft 146 and engages the other outboard end 132. Of course this configuration is exemplary and in other arrangements other configurations may be used.

In the exemplary arrangement stop pins 154 extend through each clevis 136 and are radially disposed from and substantially parallel to the axis 148. The stop pins operate to limit the rotational movement of the table relative to the base to the use position at which the table extends substantially normal to the base and the wall. In the exemplary arrangement the stop pins are configured to deform in the event that an excessive vertical load is applied to the table beyond what should reasonably be supported thereon. Normally such an excessive load is associated with attempted vandalism of the changing station. In exemplary arrangements the stop pins deform and are frangible so as to break when an excessive load is encountered. The exemplary arrangement is configured so that if the stop pins are fractured, other components of the unit remain intact. The stop pins can then be readily replaced and the baby diaper changing station returned to service.

In the exemplary arrangement as represented for example in FIG. 26, each stop pin extends through stop pin opening 140 in the outboard end 132 as well as stop pin opening 116 in the rail end 112. The stop pin also extends through aligned stop pin openings 156 adjacent to the inner end surface 28 of the table. Each exemplary stop pin 154 includes an elongated cylindrical body 158. The body extends from a radially enlarged outboard head 162 to a transversely inboard end 162. An annular recess 164 is positioned transversely intermediate of the radially enlarged head 160 and the inboard end 162. A retainer clip 166 is engageable in the recess 164 of the body 158. The engagement of the retainer clip 166 in the recess 164 limits transverse movement of the stop pin. Thus, in the installed position of the stop pin 154, the head 160 of the stop pin is in abutting relation with the respective outboard end 132 of the clevis 136 in which the stop pin is installed.

Figure 30:
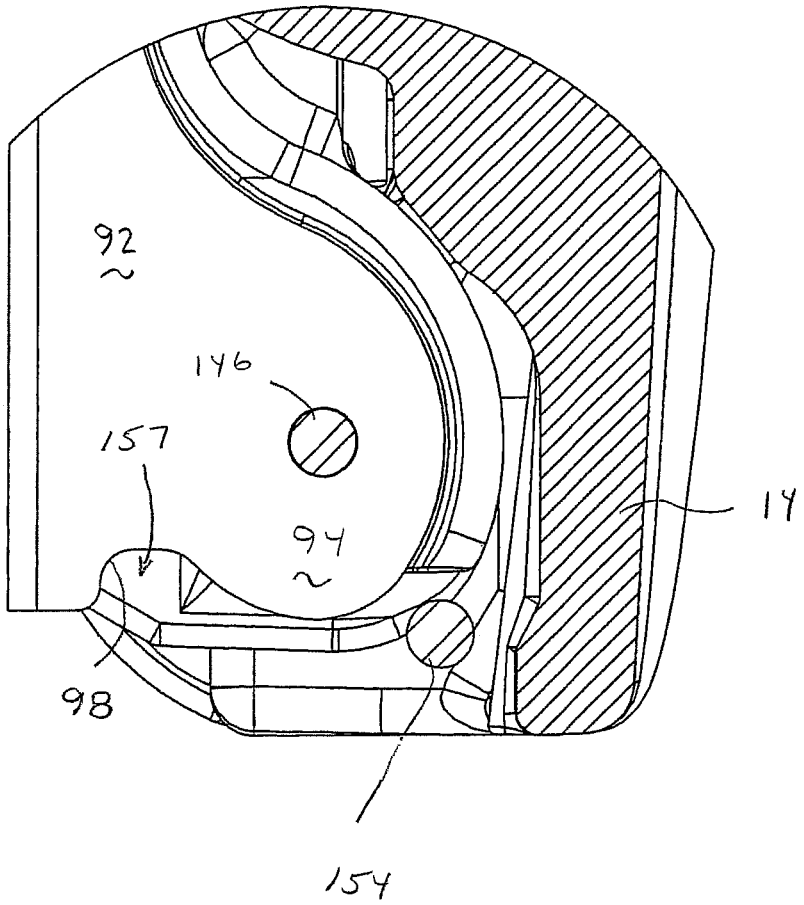
FIG. 30 is a right side partially sectioned view of the table and base in a stored position and with the stop surface on the forward leg of the base bracket disposed from the stop pin.
Figure 31:
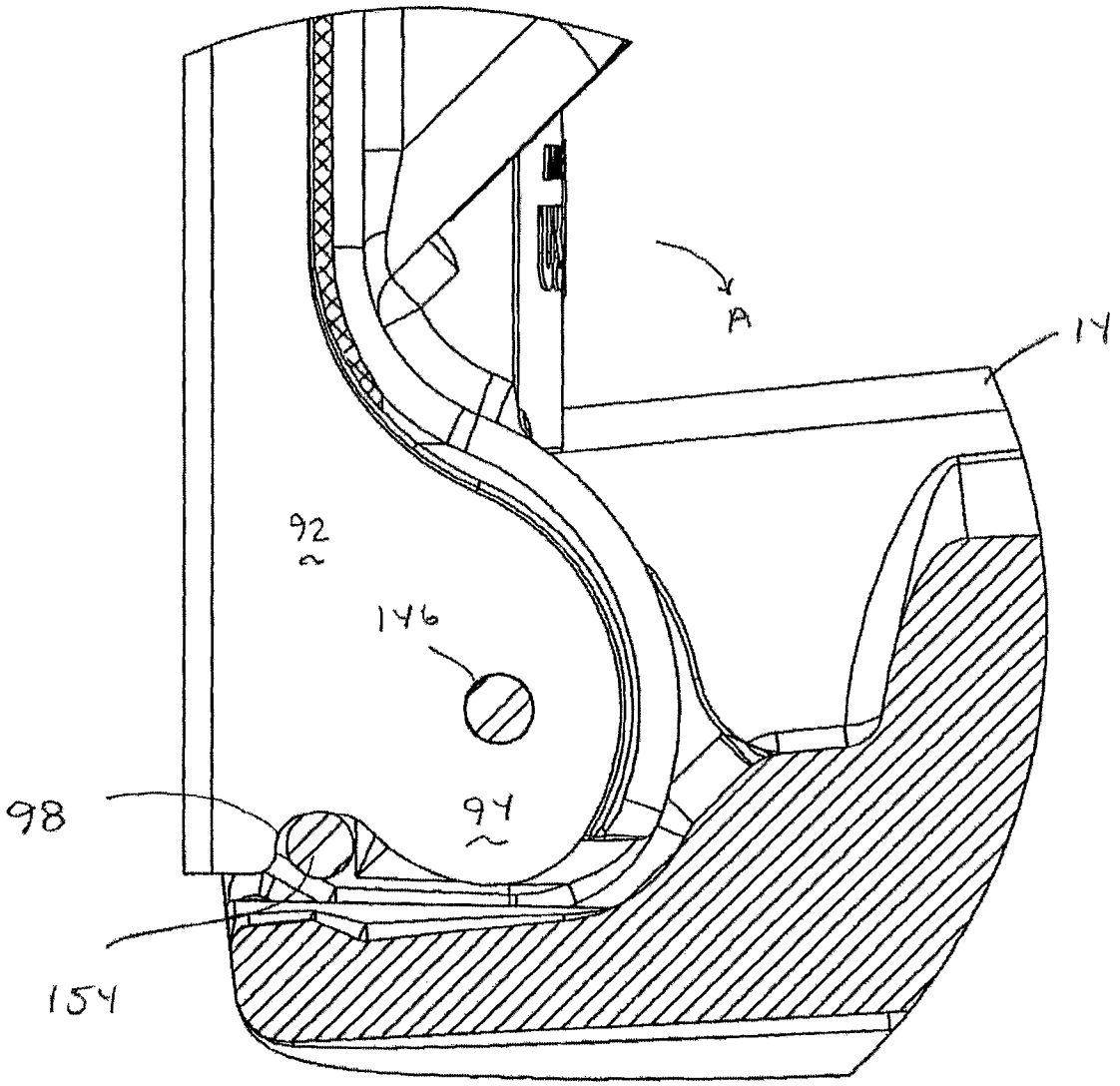
FIG. 31 is a right side partially sectioned view of the table and base in a use position and with the stop surface on the forward leg of the base bracket in engagement with the stop pin.
Figure 32:
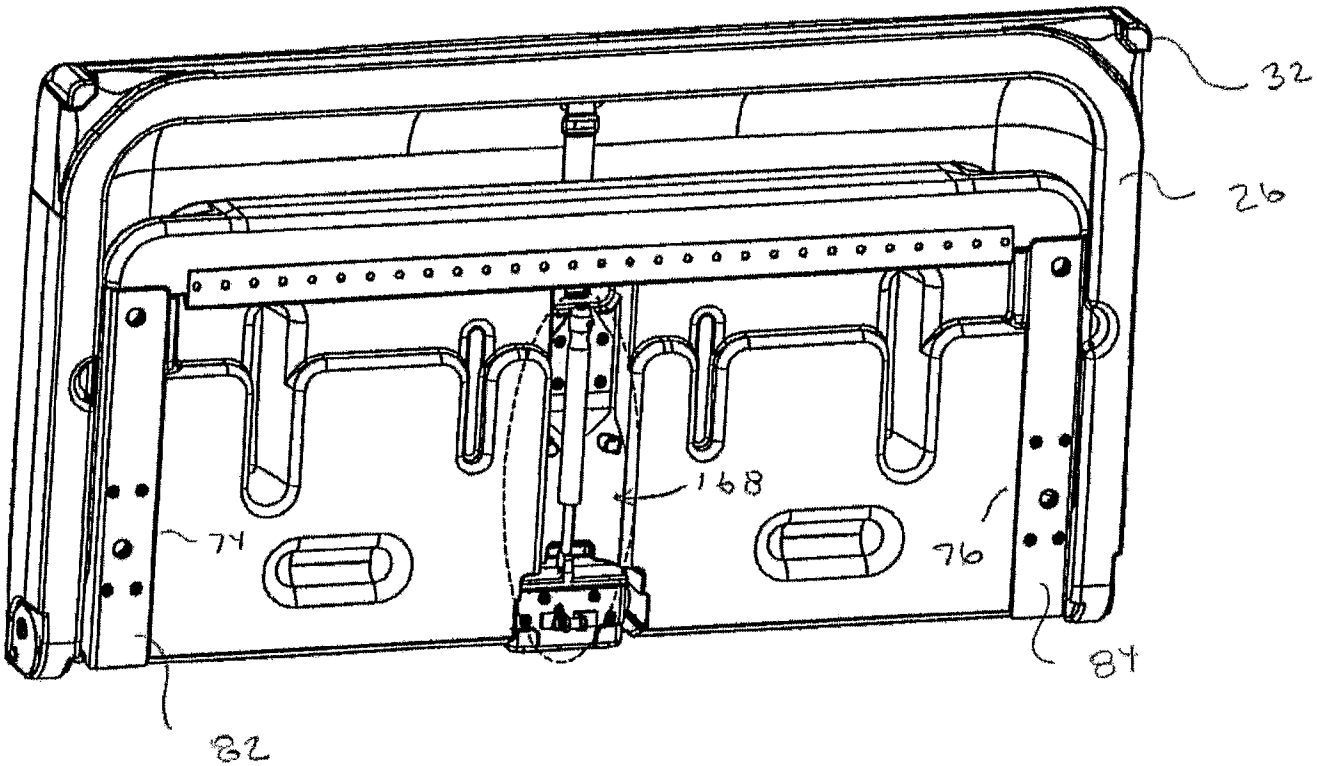
FIG. 32 is a rear view of the baby diaper changing station in a stored position and showing the spring assembly thereof bounded by a broken line.

As represented in FIGS. 30 and 31 the stop pins 154 are operative to limit the rotational movement of the table 14 relative to the base from the stored position to the use position. As shown in FIG. 30, when the table 14 is in the stored position the stop pins 154 are disposed away from the stop surfaces 98 on the forward legs 92 of the base brackets. When the table 14 is rotated to the use position shown in FIG. 31, each of the stop pins 154 extend in curved recesses 157 which are bounded by the stop surfaces 98 on the forward legs 92 of the base brackets. The inboard ends 162 of the stop pins engage the stop surfaces 98. The engagement of the stop pins and the stop surfaces provide more than the normally required supporting force to prevent the table 14 from rotating in the opening direction represented by Arrow A from the stored position beyond a position substantially normal to the base.

In the event that vandalism or other anomalous conditions are encountered which result in the table 14 having applied thereto an excessive downward force above a limit, that acts to move the table in the direction of Arrow A beyond the use position, the stop pins 154 will deform longitudinally intermediate of the stop surfaces 98 and the devises 136. In the exemplary arrangement the stop pins 154 are configured to be frangible so that deformation causes the pins to separated at the recess 164. Once the stop pins have fractured and separated at the recesses, the table may rotate in the direction of Arrow A beyond the use position without causing damage to other components of the changing station. As a result the exemplary arrangement may be returned to service by replacing the stop pins 154 and the retaining clips 166. Of course it should be understood that this arrangement is exemplary and other arrangements other approaches may be used.

Figure 33:
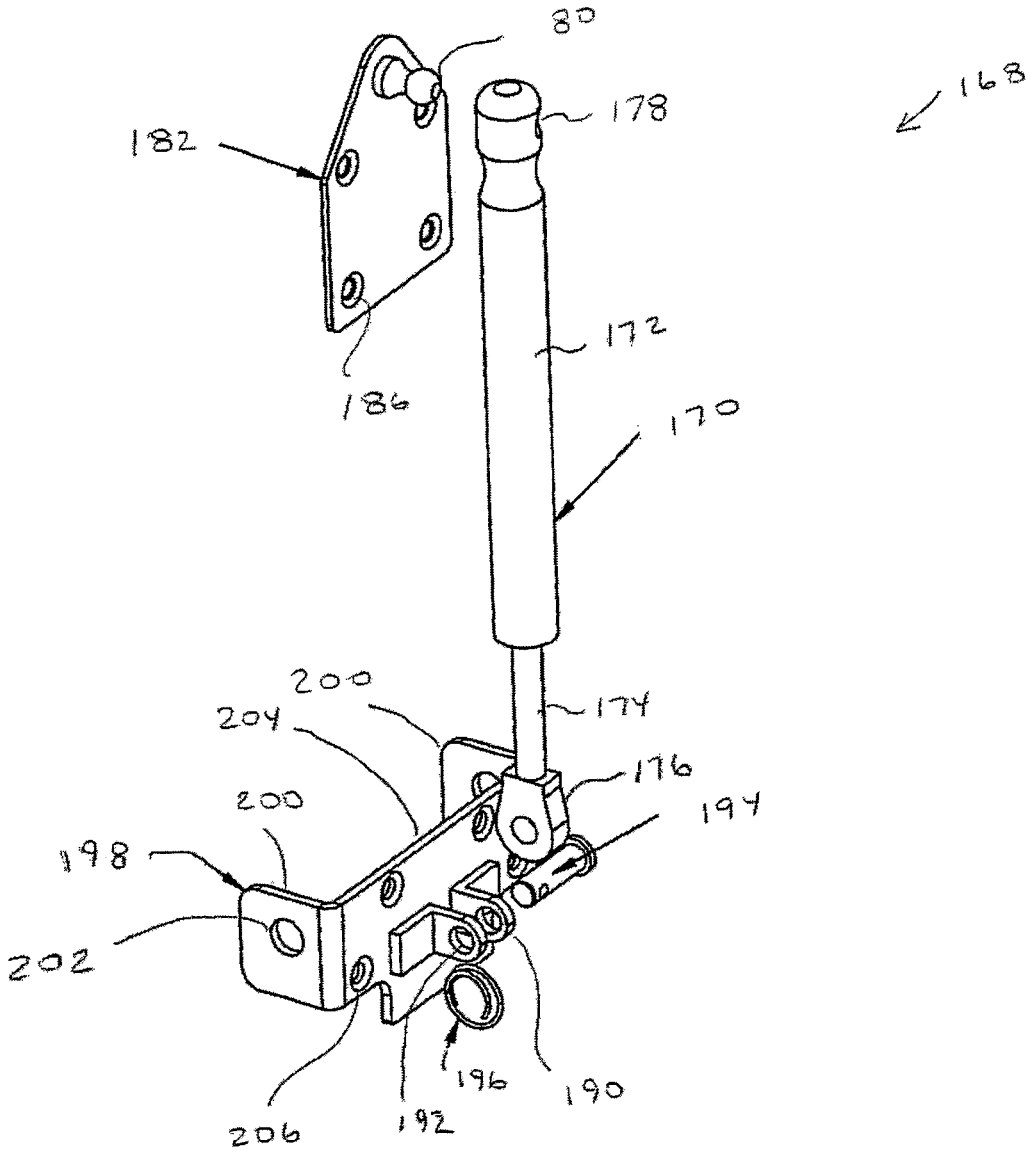
FIG. 33 is an exploded view of the exemplary spring assembly.
Figure 34:
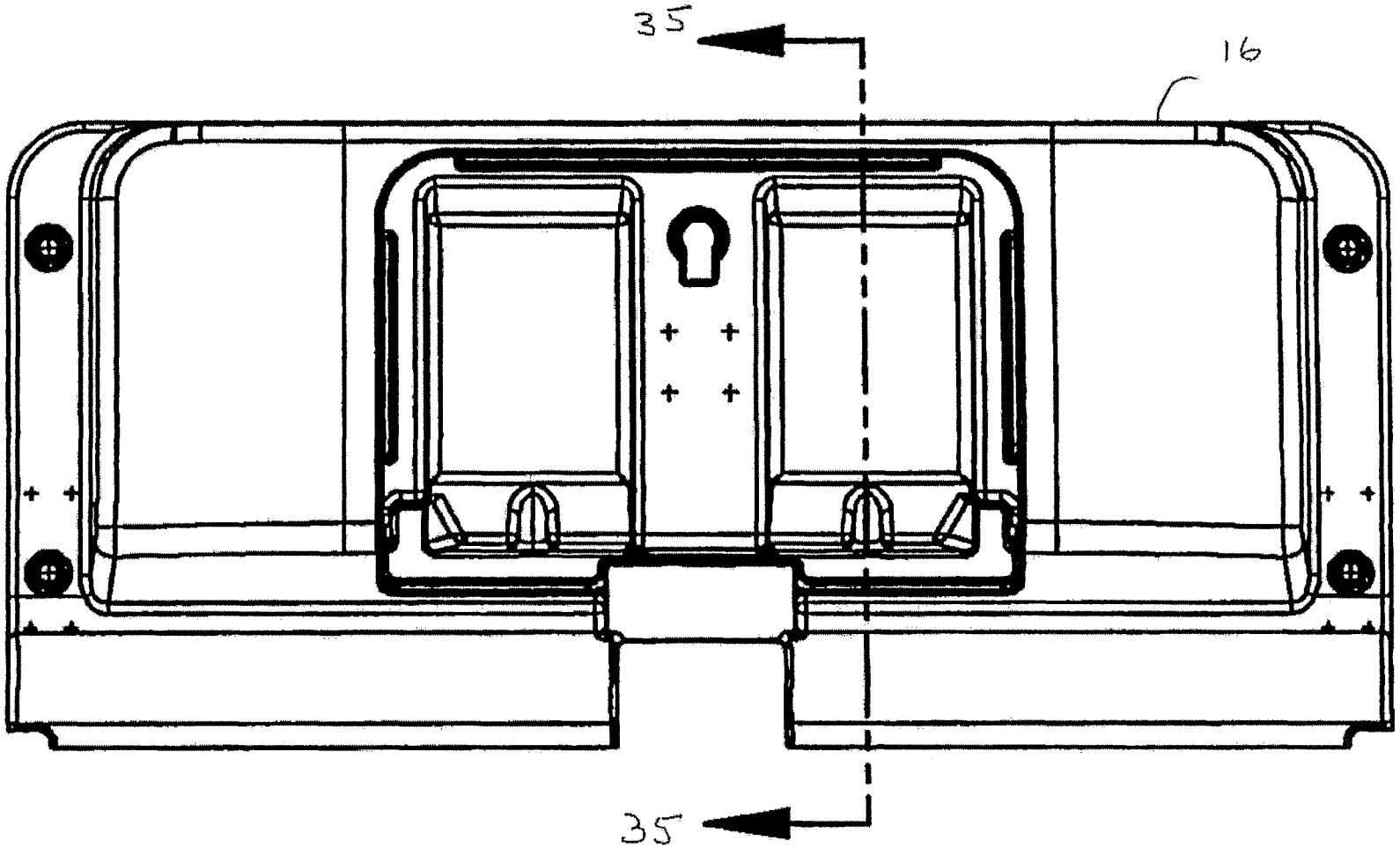
FIG. 34 is a front plan view of the base.

In the exemplary arrangement a spring assembly generally indicated 168 is operative to assist a user in moving the table from the use position to the stored position. In the exemplary arrangement the spring assembly 168 is positioned in the central recess 72 on the back of the base 16. The spring assembly acts between the base and the table so that when the table is moved toward the stored position the spring assembly will assist in such movement by biasing the table toward the stored position and then maintain the table in the stored position. When it is desired to move the table from the stored position to the use position, the table can be rotated about the axis 146 into the use position. As shown in FIG. 33 the exemplary spring assembly 168 includes an air spring 170. The air spring 170 includes a cylinder portion 172 and an outwardly biased rod portion 174. The rod portion 174 is attached to an end portion 176 at a distal end that includes an opening therethrough. The cylinder portion includes a ball joint which includes an opening 178 that is configured to receive and hold the circular head of a pin 180.

The pin 180 extends outward from a plate 182. The plate 182 is a substantially planar, flat plate that is configured to be attached in overlying relation with a land 184 on the backside of the base in the recess 72 (see FIG. 14). The plate 182 includes a plurality of openings 186. The openings 186 are alignable with openings 188 in the land 184 so that fasteners such as screws may be extended therethrough. The screws or other fasteners are operative to hold the plate 182 in engaged relation with the base 16.

The end portion 176 that is attached to the rod is configured to extend between a pair of disposed ears 190. Each of the ears 190 include an opening 192 therethrough. Each of the openings 192 is sized for receiving a pin 194 therein. A spring retainer 196 is configured to releasably extend through a hole in the pin 194. As a result the pin 194 is enabled to hold the end portion 176 of the rod 174 in engagement with the ears 190.

The ears are attached to a generally C-shaped bracket 198. The bracket includes a disposed pair of end portions 200. Each end portion includes an opening 202 therethrough. The openings 202 are sized to enable the axle shaft 146 to extend therethrough. The bracket 198 further includes a middle portion 204 which extends between the end portions. The middle portion 204 includes a plurality of fastener accepting openings 206 therethrough.

In the exemplary arrangement the bracket 198 is attached to the bearing block 36 of the table. The middle portion 204 of the bracket is fastened to the bearing block through fasteners that extend through the openings 206. The axle shaft 146 extends through the openings 202 in the end portions 200 on each side of the bearing block 36. The end portion 176 which is attached to the distal end of the rod 174 of the air spring is operatively engaged with the ears 190 of the bracket.

Thus as can be appreciated from FIG. 16, when the table 14 is in the use position the force of the air spring 172 acts generally in a direction through the axis 148 of rotation, and does not bias the table toward the closed position. However in the use position the force applied by the air spring does not inhibit a user of the changing station from moving the table from the use position toward stored position. As the table is manually rotated toward the stored position from the use position, the ears 190 on the bracket 198 move rotationally so that the air spring acts in a direction that is further disposed away from the axis 148. As a result the force of the air spring urges the table toward the stored position. FIG. 33 shows the air spring assembly 168 with the bracket 198 in a position that corresponds to the stored position of the table. As can be appreciated, the force of the air spring provides greater torque in the range intermediate of the use position and the stored position urging the table toward the stored position due to the position of the centerline of the ears 190 being radially disposed from the axis 148. Thus in the exemplary arrangement the spring assembly operates to urge the table toward the stored position but enables the user to readily move the table between the stored and use positions without the need to apply excessive force. Of course it should be understood that these arrangements are exemplary and in other arrangements other approaches may be used.

In some exemplary arrangements the strap assembly 30 includes a flexible retaining strap 208 that is attached to the table 14 and extends substantially across the changing surface 18. In an exemplary arrangement the retaining strap 208 extends in a direction generally perpendicular to the wall 12 when the table 14 is in the use position. At an outer end 210 that is disposed furthest away from the wall, an anchor piece 212 is attached by a fastener 214 to the table via an opening in the table. A threaded insert 216 extends in the opening to further secure the fastener 214 and anchor piece 212 to the table.

Anchor piece 212 further includes a loop 218. The loop 218 engages a ring shaped connector 220. The ring shaped connector 220 is attached to the flexible strap 208. At an inner end 222, the strap 208 is attached to a buckle 224. The buckle enables selectively adjusting the length of the strap to suit the requirements of the user. The exemplary buckle 224 includes biased clip projections 226 that are releasably engageable in an end piece 228. The exemplary end piece 228 includes openings 230 that enable accessing the clip projections 226 to manually release the buckle from the end piece when desired. The exemplary end piece 228 is attached to an anchor piece 232. The anchor piece 232 is held to the table by a fastener 234 that extends in an opening in the table. A threaded insert 236 extends in the opening so as to further secure the anchor piece 232 to the table.

Thus the exemplary arrangement enables a user of a changing station to adjust the length of the flexible strap 208 to accommodate the size of the child, and to then secure the child in position on the changing surface by engagement of the buckle 224 with the end piece 228. To release the strap assembly 30 the user need only manually engage the clip projections 226 through the openings 230, to release the buckle and the end piece. The exemplary arrangement provides a secure connection that can be readily engaged and disengaged by users of the changing station. Of course these structures and approaches are exemplary and in other arrangements other approaches may be used.

Figure 43:
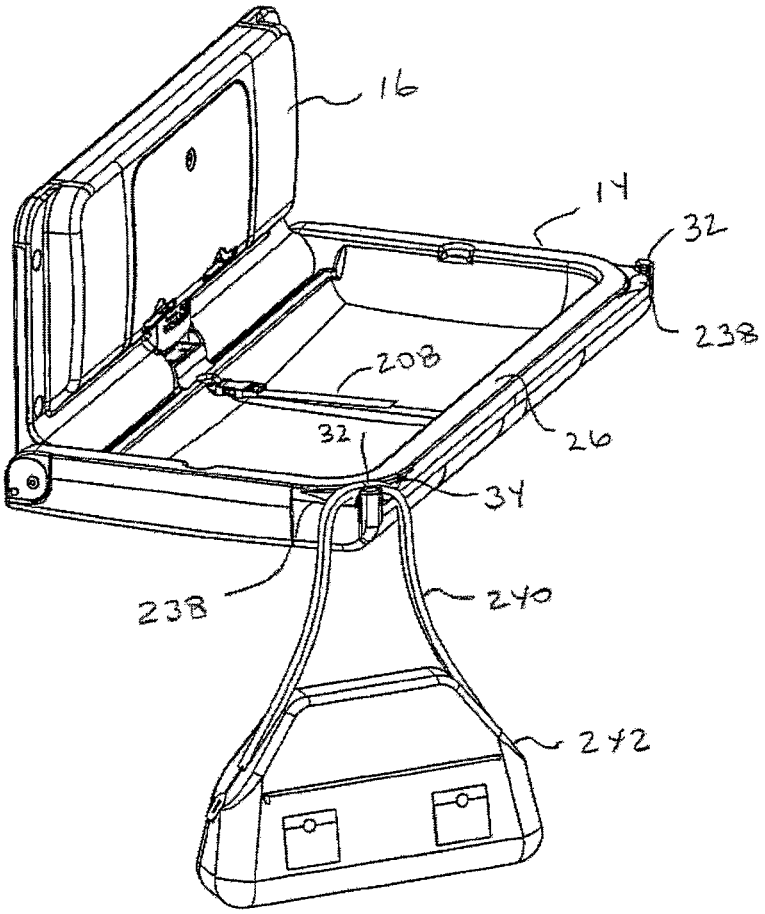
FIG. 43 is an upper right perspective view of the baby diaper changing station in a use position and showing a strap of a bag or other article carrying device in supported connection with an upward extending peg at a corner of the table.
Figure 44:
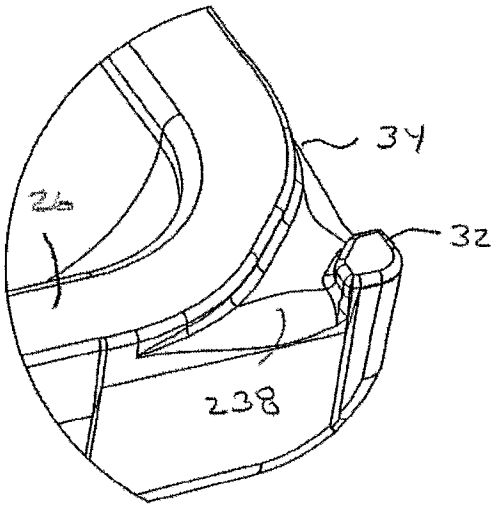
FIG. 44 is an enlarged perspective view of a portion of the rim of the table including the upward extending peg.
Figure 45:
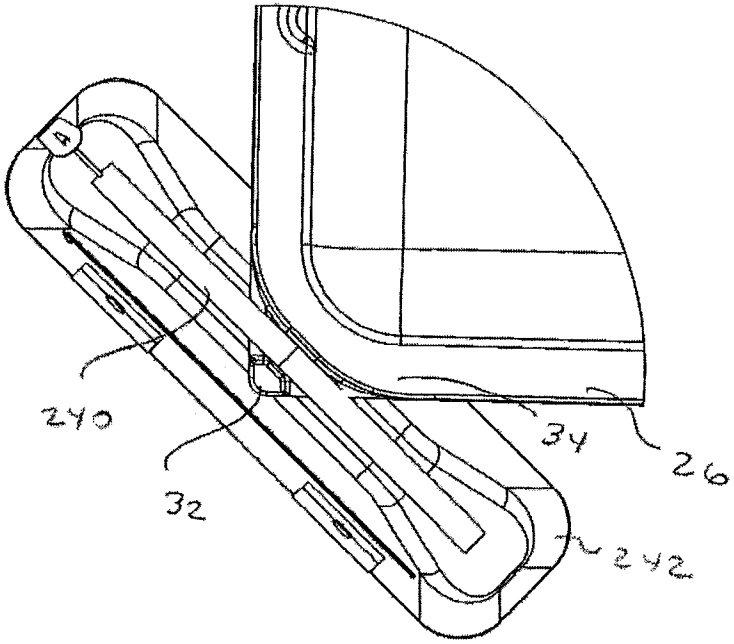
FIG. 45 is a top view showing the upward extending peg in engaged relation with the strap.

As shown in FIGS. 43-45 the exemplary arrangement provides enhanced holding capabilities for users who may have purses, diaper bags or containers for holding other items that they need to keep close or access while using the baby diaper changing station. In the exemplary arrangement the pegs 32 are configured to extend upwardly when the table 14 is in the use position. In the exemplary arrangement the peripheral surface 34 which bounds the rim 26, is configured adjacent to the pegs 32 to provide a recess 238 that extends inwardly around the pegs. As can be appreciated from FIGS. 43 and 45, the configuration of the pegs 32 and the recesses 238 enables securely engaging a strap 240 attached to a purse or other container 242, to be engaged with the upward extending peg 32. This configuration enables secure engagement of the strap 240 so that it is less likely to inadvertently disengage from the table. Further the exemplary arrangement enables the user to readily disengage the strap and the table when the user is done using the changing station. Of course it should be understood that this configuration is exemplary and other arrangements other approaches may be used.

In exemplary arrangements the baby diaper changing station is readily securely mounted to the wall 12 or other vertically extending supporting surface. This is accomplished in exemplary arrangements as described in connection with FIGS. 39-42. The exemplary changing station is initially mounted to the wall 12 using a horizontally elongated mounting bracket 244. The exemplary mounting bracket 244 is a J shaped mounting bracket in transverse cross-section. The mounting bracket includes a back wall bracket side 246 that extends substantially parallel to the wall 12 as shown in FIG. 41. The bracket further includes in cross-section a front wall bracket side 248 that extends upward and outward from the back wall bracket side 246. The front wall bracket side extends further upwardly with increased distance outwardly away from the wall, and terminates in upward directed lip 250.

Figure 42:
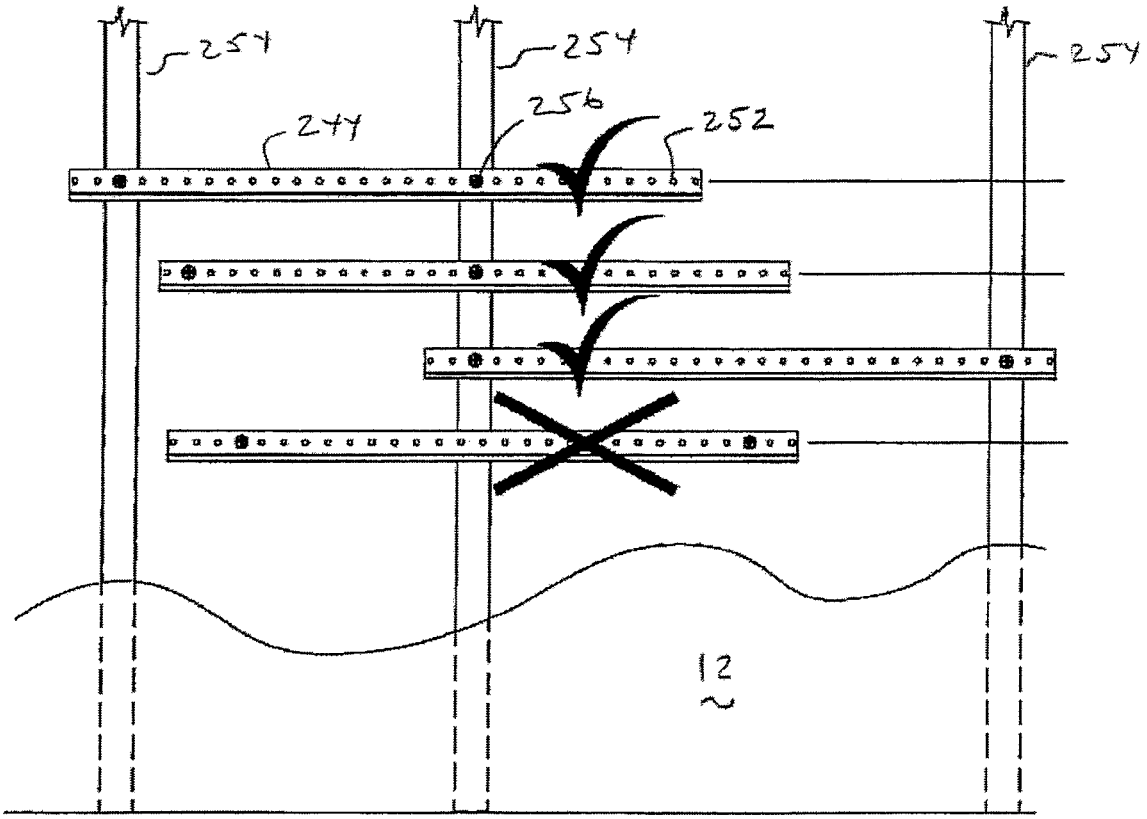
FIG. 42 shows a plurality of different possible mounting arrangements for the horizontally elongated mounting bracket relative to wall studs.

In the exemplary arrangement the back wall bracket side 246 includes a plurality of spaced openings 252. In the exemplary arrangement the spaced openings are configured for receiving fasteners therethrough such as screws. The openings are configured to enable the bracket 244 to be attached to at least one stud 254 which underlies the surface of wall 12. As represented in FIG. 42 the exemplary bracket 244 can be attached satisfactorily for mounting the changing station to one or more studs 254. In the exemplary arrangement fasteners 256 extend through the openings 252 and engage at least one stud. As represented in FIG. 42 satisfactory mounting of the exemplary baby diaper changing station 10 can be achieved as long as the mounting bracket 244 is engaged with at least one vertical stud 254. Examples of such mounting are represented by the top 3 mounting examples in FIG. 42. The lowermost example shown represents a situation where the mounting bracket 244 is not in direct connection through a fastener 256 with at least one stud. As indicated, this is generally not an acceptable mounting arrangement where the changing station is to be attached to a conventional stud frame wall. Of course it should be understood that in some exemplary arrangements, the changing station will be attached to a formed concrete wall, a block wall or other construction that is not a stud frame wall, in which case the mounting bracket 244 can be satisfactorily mounted as long as it is fastened in at least one location to a suitable high vertical load bearing structure.

In the exemplary arrangement the changing station 10 is initially mounted by the engagement of the front wall bracket side 248 and the lip 250 with the downward extending edge 80 on the back side of the base 16. As previously discussed in connection with FIG. 14, the edge 80 extends substantially continuously across the back surface 71 of the base between the back legs 86 of the base brackets 82, 84. For purposes hereof substantially continuously means that the edge is present for a majority of the transverse distance between the back legs. The edge 80 in cross-section has an underlying recess 258 which enables the front wall bracket side 248 and the lip 252 to extend in the recess 258 and securely engage the edge 80. As can be appreciated from FIG. 16, the mounting bracket 244 in engagement with the edge 80 extends transversely across the central recess 72 and provides supporting engagement substantially continuously across the entire horizontal span between the base brackets of the base as a result of engagement with the edge for a majority of such transverse distance.

Figure 39:
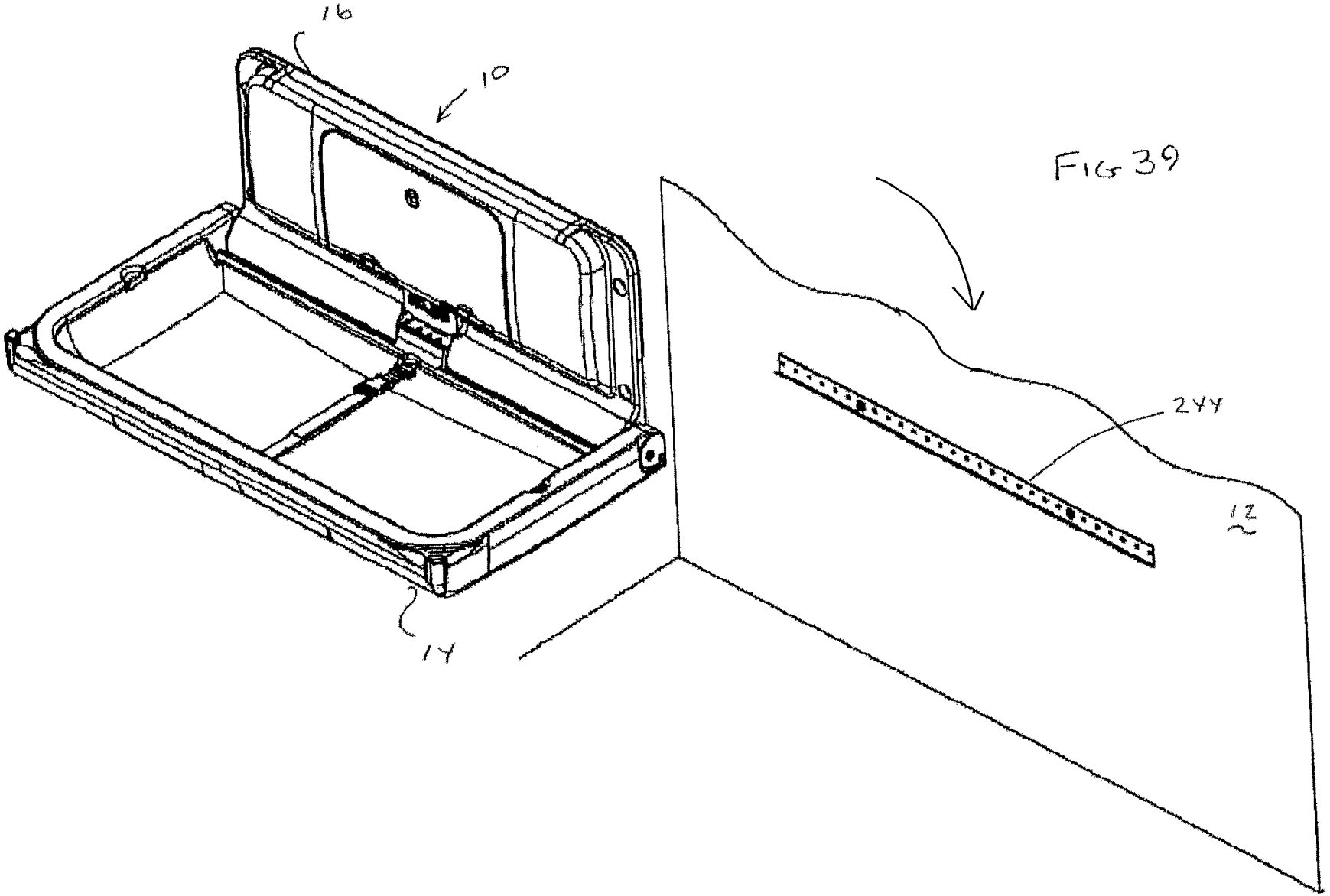
FIG. 39 is an exploded view showing the baby diaper changing station and a horizontally elongated mounting bracket attached to a wall.
Figure 90:
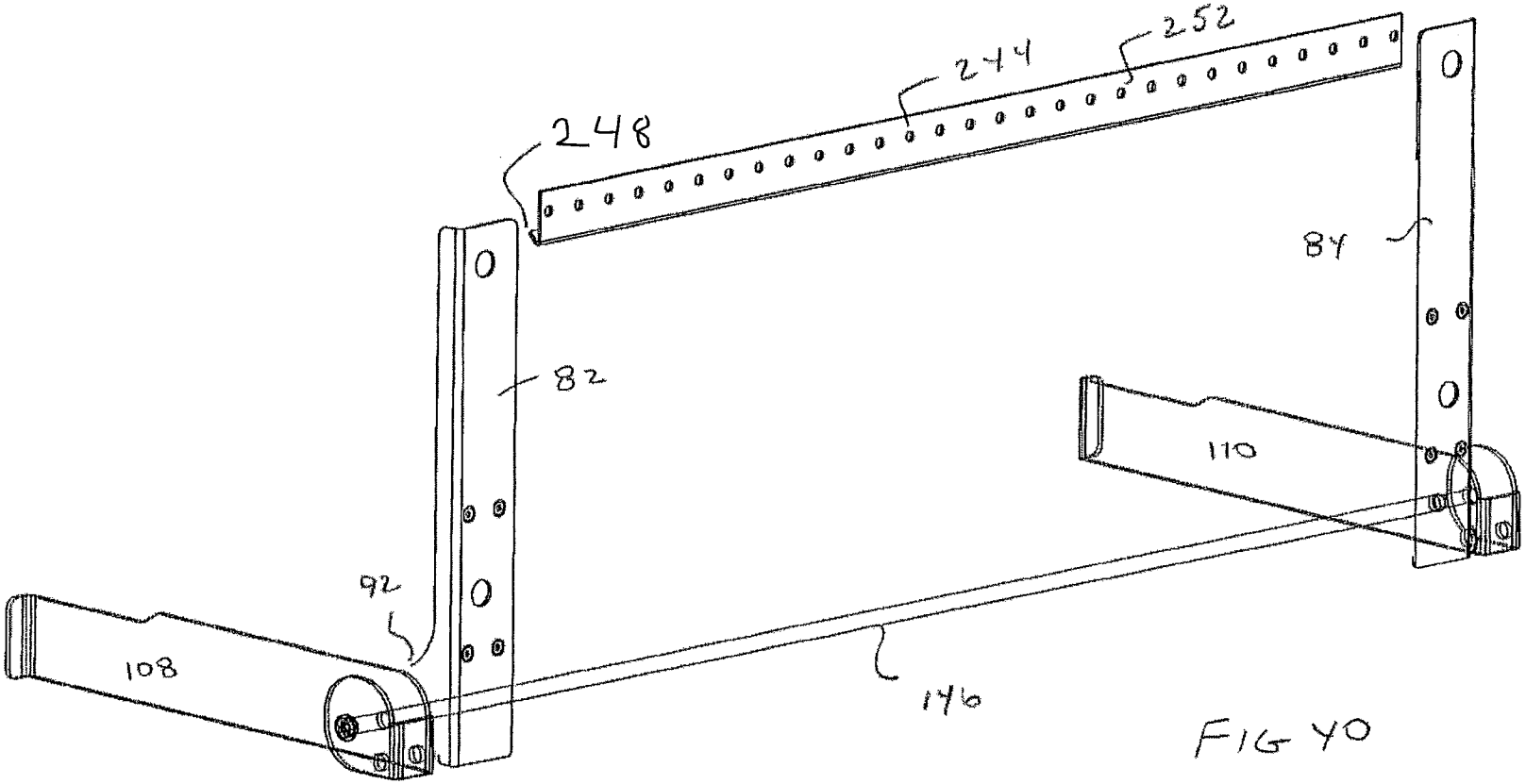

Thus in exemplary arrangements the mounting bracket 244 may be attached by fasteners 256 to the wall 12 in a horizontally level configuration such as is shown in FIG. 39. The changing station 10 may then be moved adjacent to the wall and the mounting bracket so that the edge 80 engages the lip 250 of the bracket in hook-like fashion. Once the base 16 is in hooked engagement with the mounting bracket 244, the base may be secured by using four anchors that extend through the openings 48 and into the wall 12. These anchors may be appropriate type wall anchors for the particular type of wall surface to which the changing station is to be engaged. As can be appreciated, the engaging structures of the exemplary arrangement which include the mounting bracket 244 which attaches to the base across a wide span in addition to the four mounting anchors that extend through the base, provide a solid mounting engagement of the base to the wall and for supporting the changing station. Of course it should be understood that these mounting structures are exemplary, and in other arrangements other structures and arrangements may be used.

FIGS. 46-60 show an alternative baby diaper changing station generally indicated 260. The exemplary changing station 260 is in operative attached connection with a vertically extending wall 262. While a planar vertically extending wall is shown, for purposes hereof a wall shall also be deemed to include other types of support structures. Changing station 260 includes a table 264. The changing station is in operatively engaged connection with the wall 262 through a pair of transversely spaced mounting brackets 266, 268. It should be understood that the use of two transversely disposed mounting brackets is exemplary, and in other arrangements a single mounting bracket or more than two mounting brackets may be used. Each of the exemplary mounting brackets includes respective front facing surfaces 270, 272. Each front facing surface includes wall fastener accepting openings 274 therethrough. Fasteners such as anchors, screws or bolts extend through the wall fastener openings 274 to hold the respective mounting brackets in attached operative connection with the wall 262.

Figure 46:
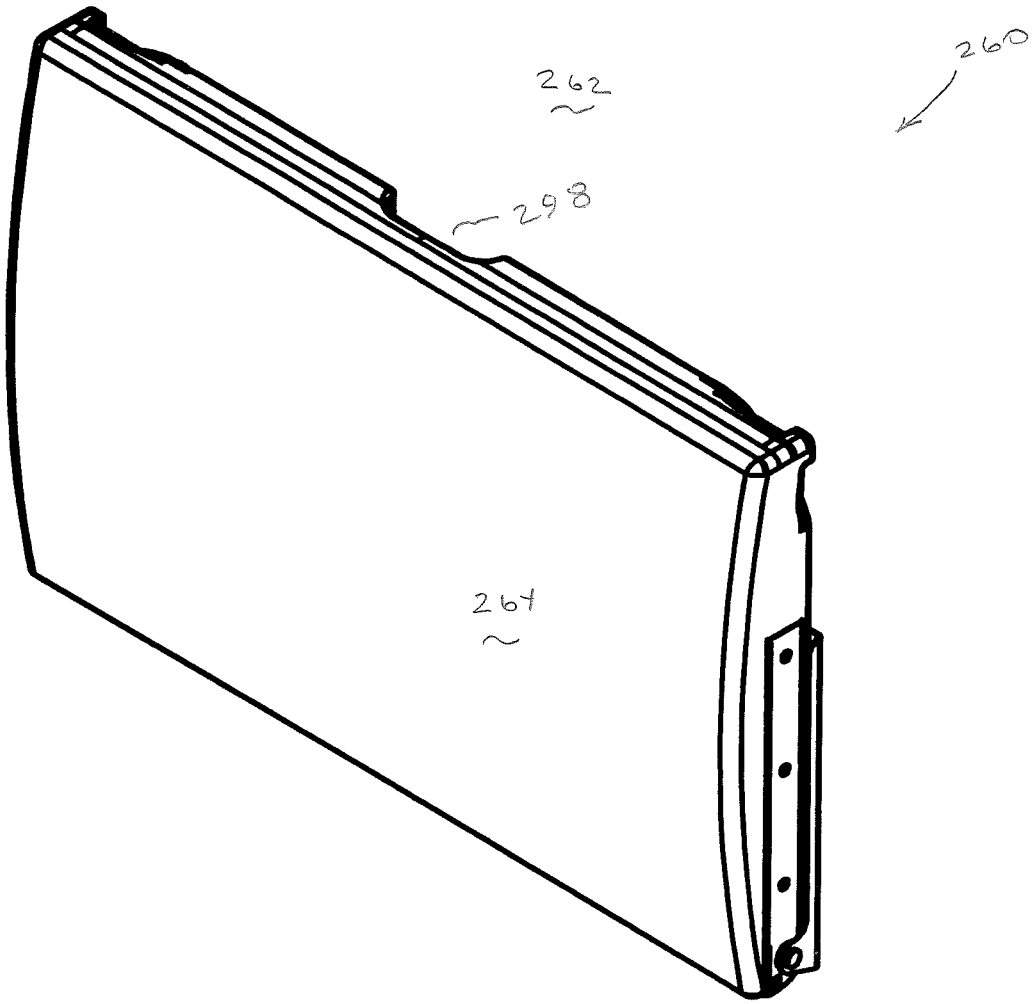
FIG. 46 is a front top right perspective view of an alternative baby changing station shown in a stored position.

The exemplary changing station 260 includes a pair of joints 276, 278. As later described in detail, each joint enables the table 264 to be rotatably movable in operative supported connection with the mounting brackets 266, 268. The exemplary joints 276, 278 enable the table to be manually movable between a use position shown in FIG. 47 and a stored position which is shown in FIG. 46.

Figure 47:
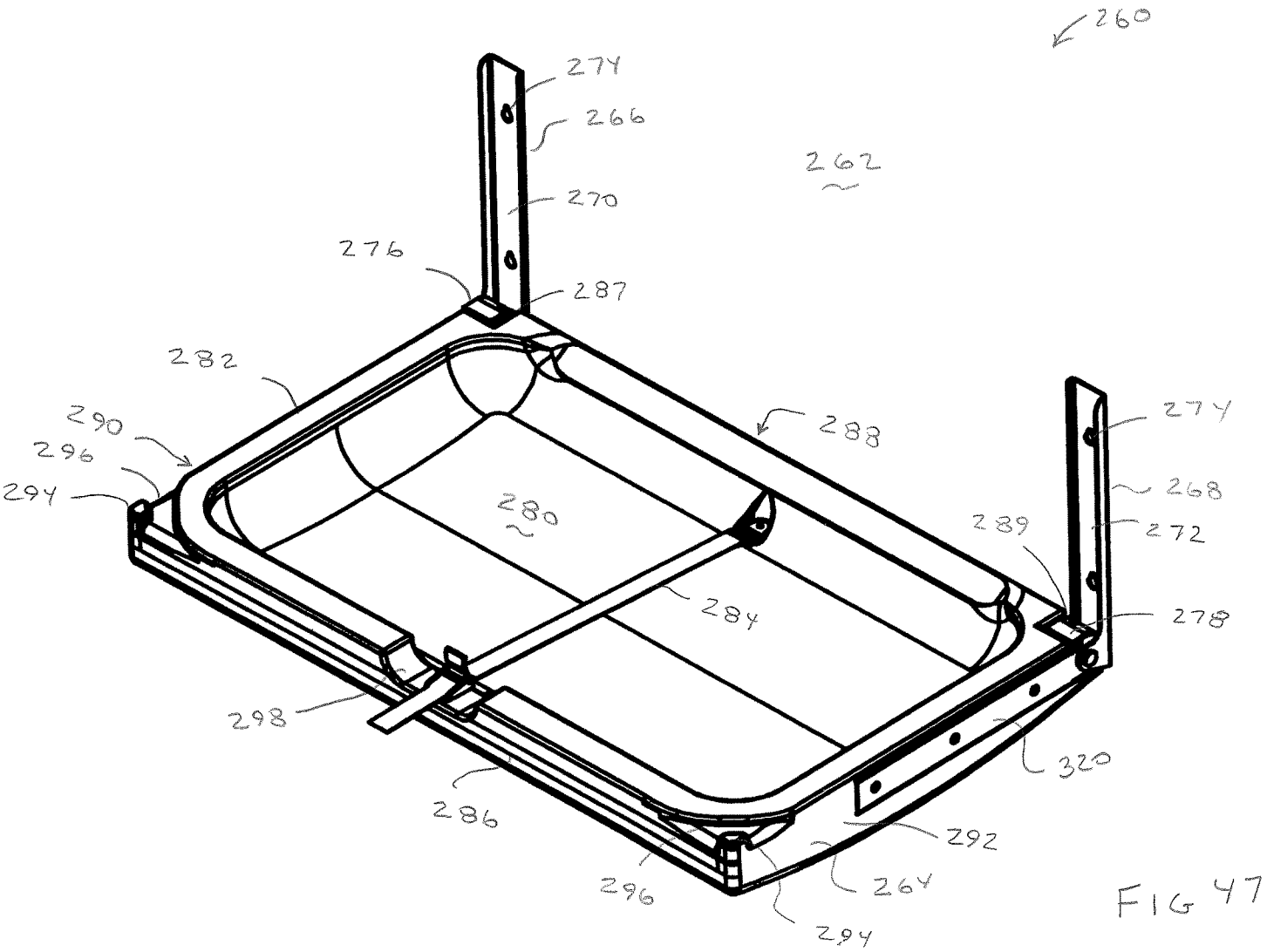
FIG. 47 is a top front right perspective view of the alternative baby changing station of FIG. 46 shown in a use position.
Figure 49:
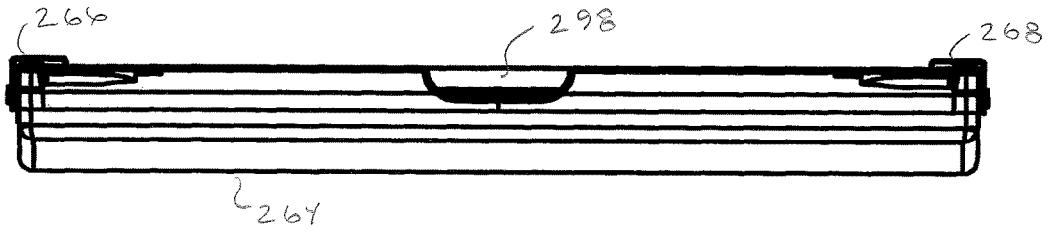
FIG. 49 is a top view of the alternative baby changing station in the stored position.
Figure 48:
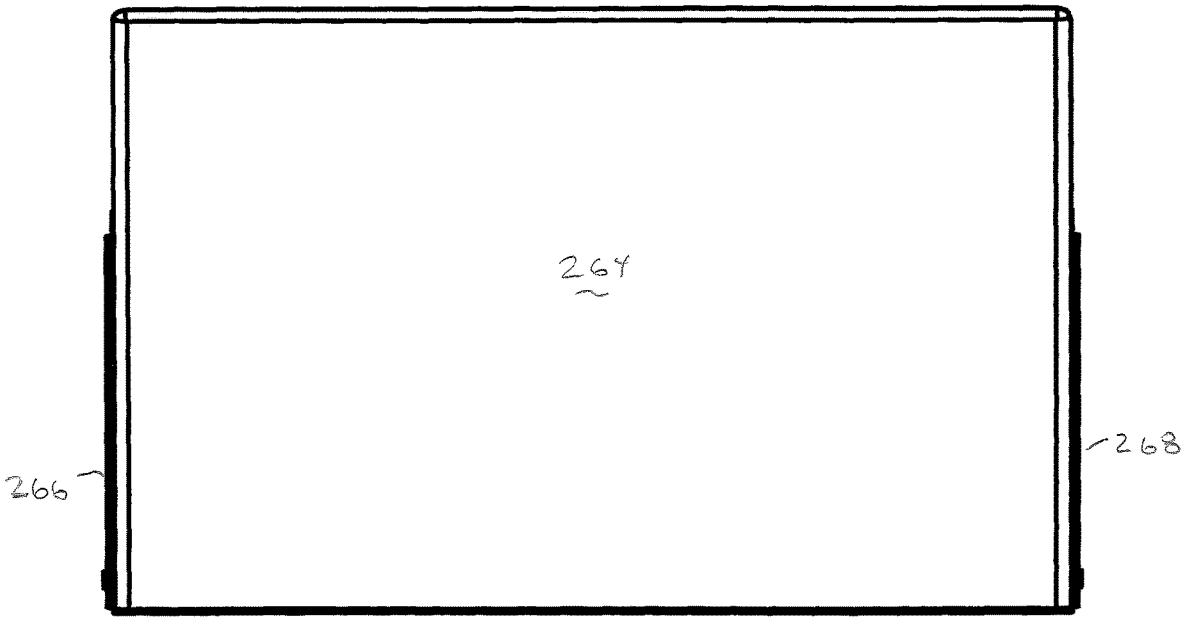
FIG. 48 is a front view of the alternative baby station as shown in the stored position as in FIG. 46.

In the exemplary arrangement the table includes a substantially planar changing surface 280. As shown in FIG. 47 the table of the exemplary arrangement in the use position extends substantially horizontally and outward in a direction normal to the wall. The exemplary changing surface 280 is recessed in the table 264 and in the exemplary arrangement is surrounded on all sides by a rim 282. In the use position, the rim 282 extends vertically above the changing surface 280. In the exemplary arrangement the table includes a strap assembly 284. The strap assembly may include one or more straps similar to those previously discussed that can be used to secure a baby in engagement with the table.

The exemplary table 264 includes an outer end wall portion 286. The outer end wall portion includes one or more wall surfaces that bound the table along a side of the table that extends the furthest away from the supporting wall 262 when the table is in the use position. The table further includes an inner end wall portion 288. Inner end wall portion 288 includes one or more wall surfaces that bound the table along a side that extends closer to the wall than the outer end wall portion 286 when the table is in the use position. The exemplary inner end wall portion and the rim 282 include a pair of transversely disposed notches 287, 289. In the exemplary arrangement the joint 276 extends in notch 287 and the joint 278 extends in notch 289.

The exemplary table further includes a pair of transversely disposed side wall portions 290, 292. The exemplary side wall portions include one or more wall surfaces that bound the table on the respective lateral side. Each side wall portion extends intermediate of the inner end wall portion and the outer end wall portion. In the exemplary arrangement respective pegs 294 that are surrounded within the rim by recesses 296 are positioned at the respective corners at which the side wall portions 290, 292 are engaged with the outer end wall portion 286. As shown in FIG. 47, the exemplary pegs 294 extends upwardly in the use position of the table to engage straps or other handles of bags or other containers in a manner similar to pegs 32 previously discussed. The exemplary table further includes a recess 298. The exemplary recess 298 extends in the outer end wall portion 286 and the rim 282. The exemplary recess 298 facilitates manual engagement of the strap assembly 284. In the exemplary arrangement the table 264 is comprised of molded plastic material. However this approach is exemplary and in other arrangements other materials and structures may be used.

In the exemplary arrangement when the table 264 is in the use position as shown in FIG. 47, the table extends substantially horizontally and in an outward direction generally normal to the wall 262. In this position the changing surface 280 faces substantially upward. When the table 264 is moved to the stored position as shown in FIG. 46, the changing surface 280 is positioned in facing relation with the wall 262. The changing surface in the stored position extends substantially vertical and parallel to the wall 262. In the exemplary arrangement, when the table is in the stored position the table outwardly overlies both of the mounting brackets 266, 268. By outwardly overlies it is meant that the table visually covers up at least a portion of the mounting bracket when viewed from a location horizontally disposed away from the table. Further as can be appreciated, the exemplary arrangement provides a horizontally extending space between the vertically extending wall 262 and the changing surface 280 when the table is in the stored position. Thus in some exemplary arrangements a storage container or other similar structure for holding liners, wipes or other materials may be in operatively attached relation with the wall such that it occupies the horizontal space when the table is in the closed position. Of course it should be understood that this configuration is exemplary and in other arrangements other approaches may be used.

As the mounting brackets and joints of the exemplary arrangement are mirror images of one another only the structures associated with mounting bracket 266 and joint 276 are described herein in detail. FIGS. 54-57 show the exemplary mounting bracket 266, joint 276 and the related structural features. In the exemplary arrangement bracket 266 includes front facing surface 270 which has the wall fastener openings 274 that extend therein. In the exemplary arrangement the wall fastener openings are key slot openings that enable extending a head or other enlarged outer portion of a fastener through the larger portion of the key slot opening. A smaller diameter shank of the fastener that extends into the wall or other support is then enabled to be moved into the smaller vertically extending portion of the key slot opening. The fastener can then be tightened to more securely hold the bracket in operative attached engagement with the wall or other supporting structure. Of course this approach is exemplary and in other arrangements other approaches may be used.

Figure 51:
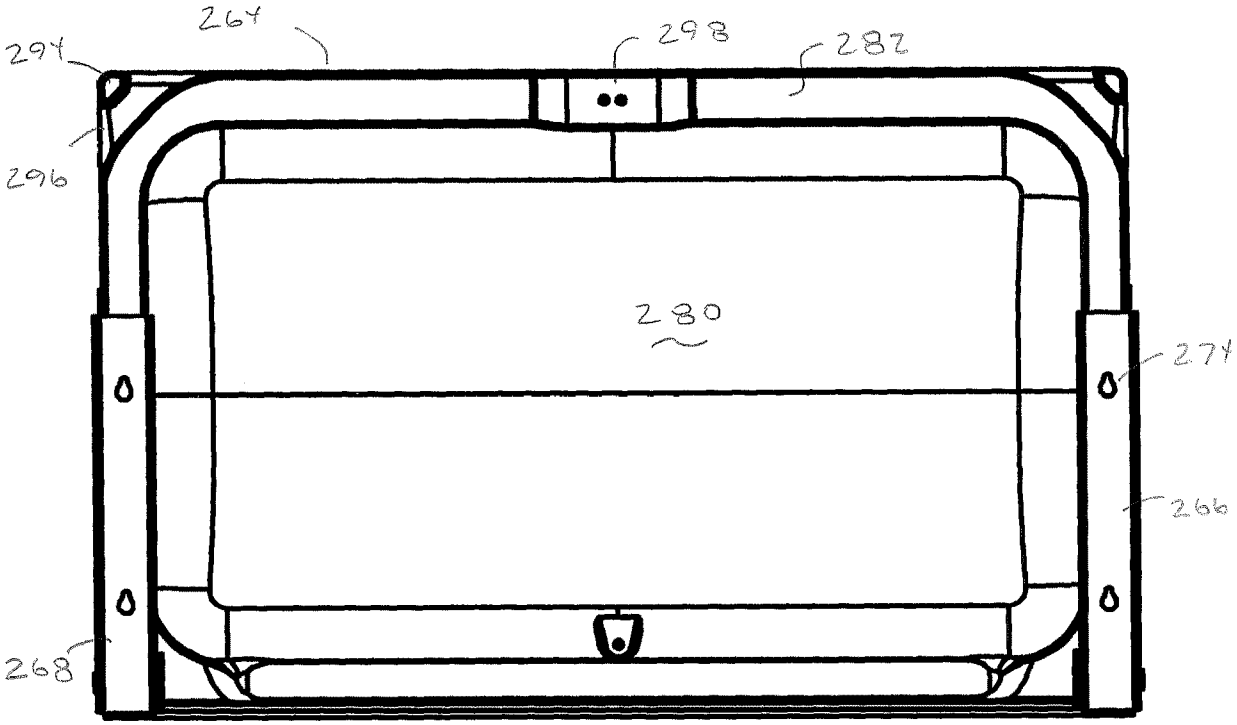
FIG. 51 is a back view of the alternative baby changing station in the stored position.
Figure 50:
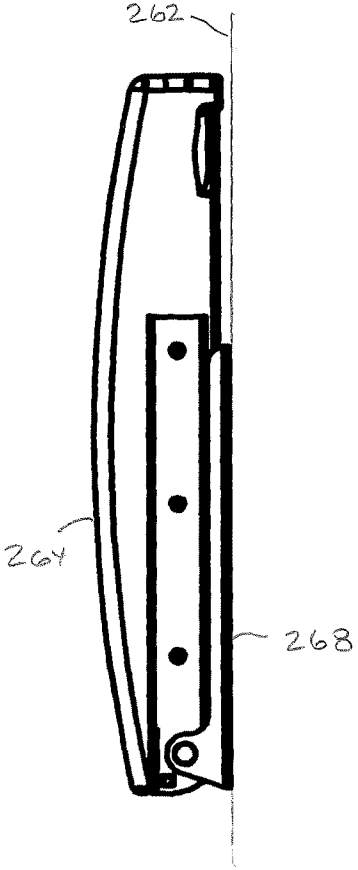
FIG. 50 is a right side view of the alternative baby changing station in the stored position.
Figure 52:
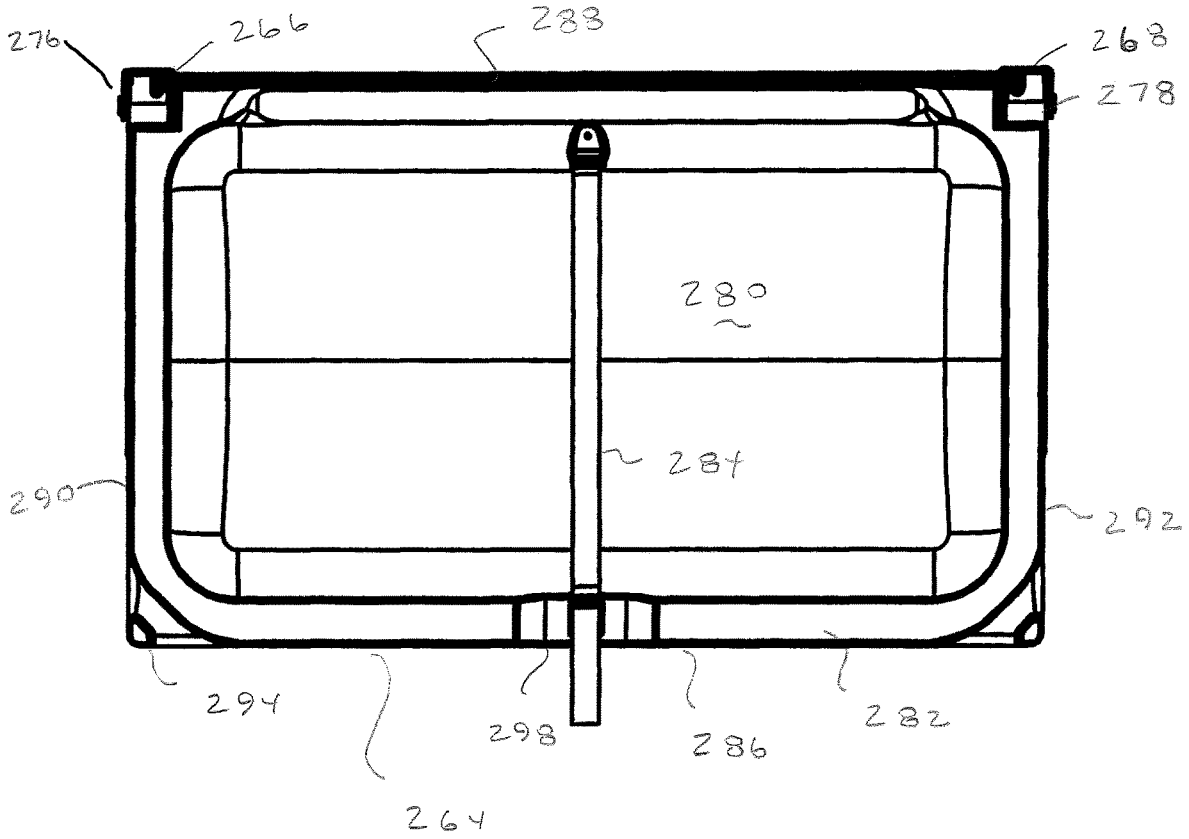
FIG. 52 is a top view of the alternative baby changing station of FIG. 47 shown in the use position.
Figure 53:
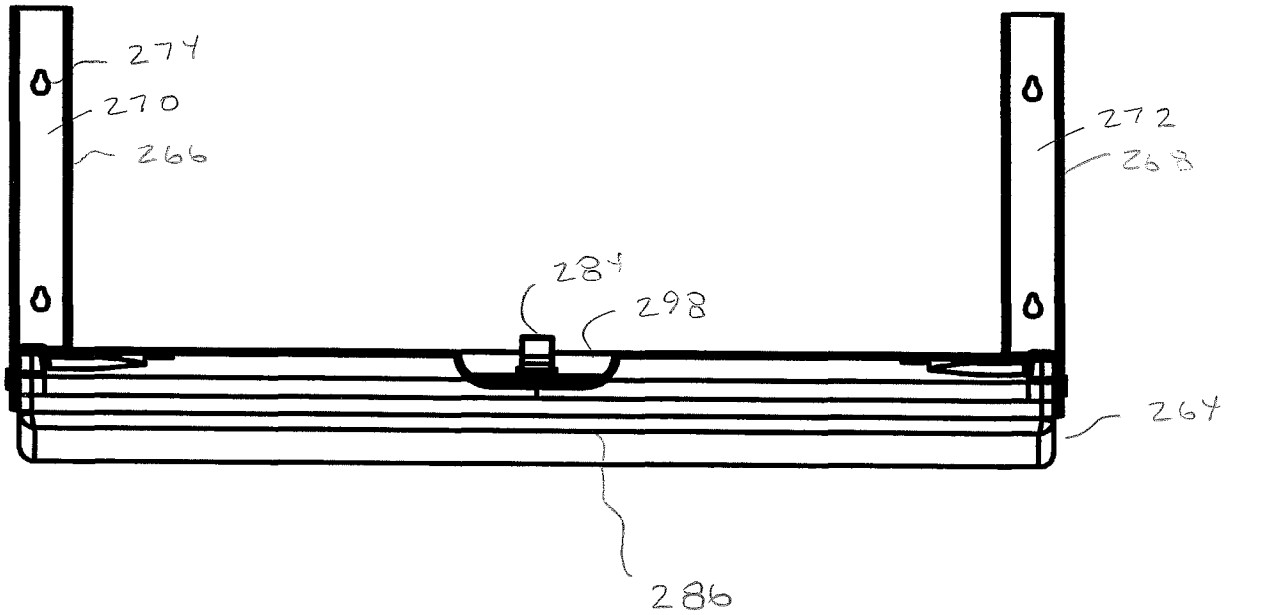
FIG. 53 is a front view of the alternative baby changing station shown in the use position.

In the exemplary arrangement the front facing surface 270 of the bracket 266 is bounded on the outboard side by an outboard flange 300. The exemplary outboard flange 300 extends forward of and substantially perpendicular to the front facing surface 270. An inboard flange 302 extends at an opposed transverse side of the surface 270. The inboard flange 302 also extends forward of and substantially perpendicular to the surface 270. In the exemplary arrangement the inboard flange 300 and the outboard flange 302 bound a pocket 304 therebetween. As shown in FIG. 51 in the exemplary arrangement the rim 282 of the table 264 extends in the pocket 304 of each mounting bracket when the table is in the stored position.

In the exemplary arrangement the outboard flange 300 extends further outward away from the wall than the inboard flange 302. This enables the outboard flange to transversely overlie the side wall portion 290 of the table and the structures attached thereto when the table is in the stored position. Thus the exemplary outboard flange 300 provides protection against side impacts when the table is in the stored position. Of course it should be understood that this configuration is exemplary and in other arrangements other approaches and configurations may be used.

The exemplary bracket 266 further includes at least one forward facing projection generally indicated 306. In the exemplary arrangement the at least one projection 306 includes a pair of transversely disposed parallel extending ears 308, 310. In the exemplary arrangement the ears 308, 310 are integrally formed with the outboard flange 300 and the inboard flange 302 respectively. Each of the ears 308, 310 include respective openings 312, 314 therein. Openings 312, 314 are in aligned relation along an axis 316. The axis 316 through openings 312, 314 is a common axis with the corresponding openings in similar ears of mounting bracket 268. In the exemplary arrangement the table 264 is rotatable about this common axis. Of course it should be understood that this approach is exemplary and in other arrangements other approaches may be used.

A side rail 318 is in attached connection with side wall portion 290. In the exemplary arrangement a side rail 320 which is the mirror image of side rail 318, is in attached engagement with side wall portion 292. Side rail 318 includes a plurality of longitudinally spaced openings 322 therein. Openings 322 are configured to accept fasteners 324. Each of the fasteners 324 extend through a respective opening 322 and hold the side rail in fixed attached engagement with the immediately adjacent side wall portion 290 of the table 264. In the exemplary arrangement the side wall portions of the table, including the side wall portion 290, include bosses 326 in the interior area thereof that are configured to engage the threads of fasteners 324. This enables the side rails 318, 320 to be held in fixed attached engagement with the respective immediately adjacent side wall portion. Of course this approach is exemplary and in other arrangements other approaches may be used.

The exemplary joint 276 further includes a clevis 328. The exemplary clevis includes a side rail end 330. The side rail end 330 in the exemplary arrangement includes the longitudinal end of side rail 318 immediately adjacent to mounting bracket 266. The side rail end has a curved contour. The exemplary clevis 328 further includes an inboard end 332. The exemplary inboard end is similarly shaped to the side rail end 330. The inboard end 332 is axially spaced from the side rail end 330 in the inboard direction therefrom. The exemplary clevis further includes a clevis bridge 334. The exemplary clevis bridge extends transversely between the side rail end 330 and the inboard end 332, and is in fixed operative connection with both the side rail end and the inboard end. In the operative position of the joint 276 the clevis bridge 334 extends parallel to the axis 316.

In the exemplary arrangement the side rail end 330 includes an opening 336. The inboard end 332 includes an opening 338. In the exemplary arrangement when the clevis 328 is in the operative position in the joint 276, the openings 336, 338 are aligned with the axis 316. A pin 340 extends along the axis 316 and through openings 312, 314, 336 and 338. In the exemplary arrangement the pin 340 holds the mounting bracket 266 and the table 264 in rotatable operatively engaged relation so that the table is rotatably movable about the axis between the use and stored positions. Of course it should be understood that this approach is exemplary and in other arrangements other approaches may be used.

In the exemplary arrangement the rotation of the table 264 relative to the mounting brackets 266, 268 is limited so that the table cannot be rotated from the stored position in a first rotational direction toward the use position, beyond the use position. This is achieved in the exemplary arrangement by a stop 342. The exemplary stop 342 includes respective surfaces that bound the clevis bridge 334 and the lower inward portions of the side rail end 330 and the inboard end 332. In the exemplary arrangement when the table is moved in the first rotational direction to the use position, the surfaces which comprise the stop 342 engage a stop surface 344 of the mounting bracket. In the exemplary arrangement the stop surface 344 includes a portion of front facing surface 270 that is disposed between the ears 308, 310.

Figure 54:
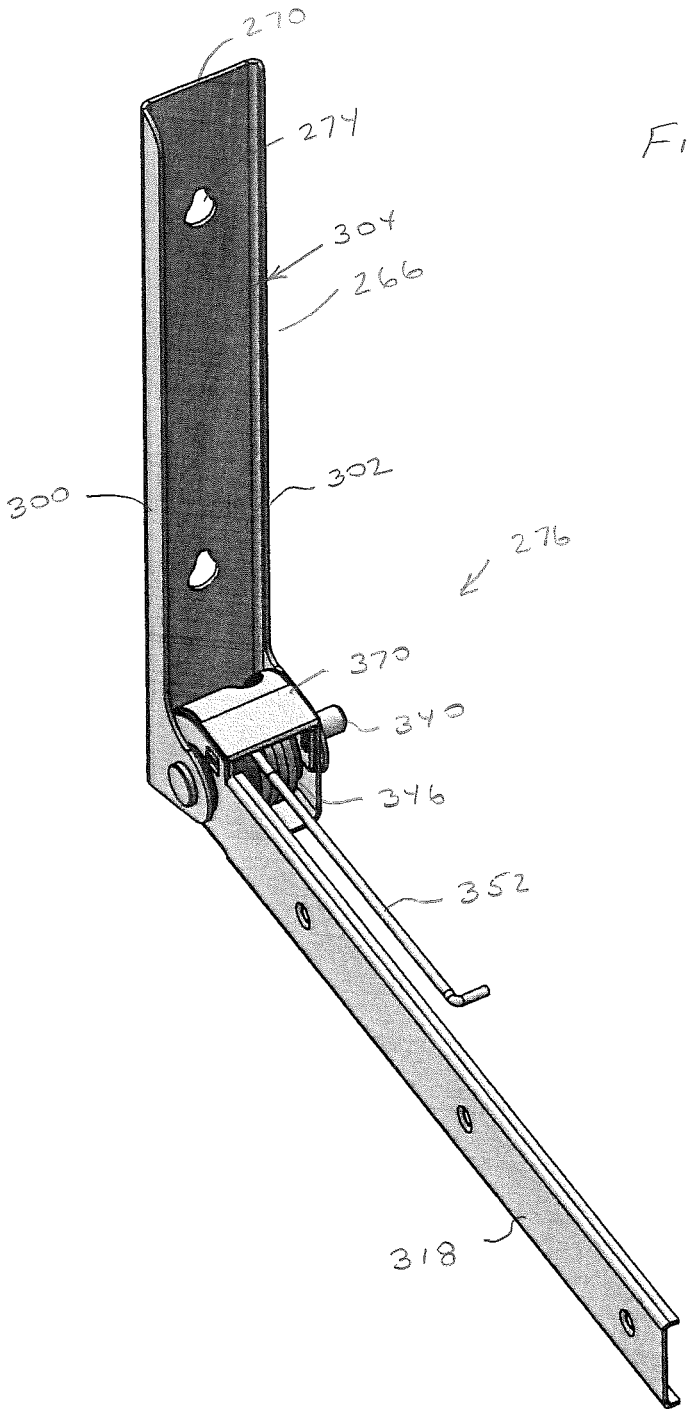
FIG. 54 is a front top left perspective view of an assembly including an exemplary mounting bracket, joint, side rail and torsion spring of the alternative baby changing station.
Figure 55:
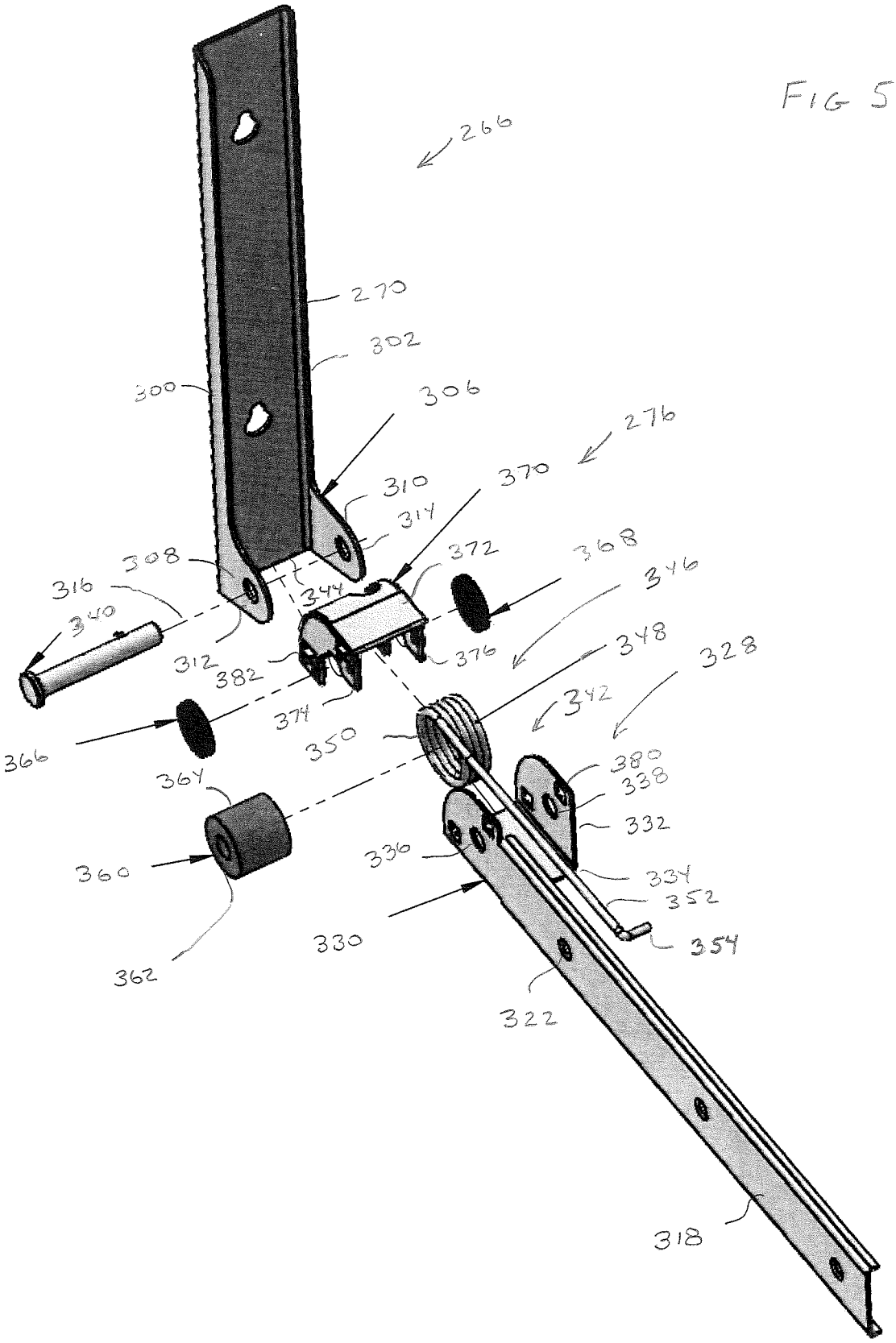
FIG. 55 is an exploded view of the assembly shown in FIG. 54.
Figure 57:
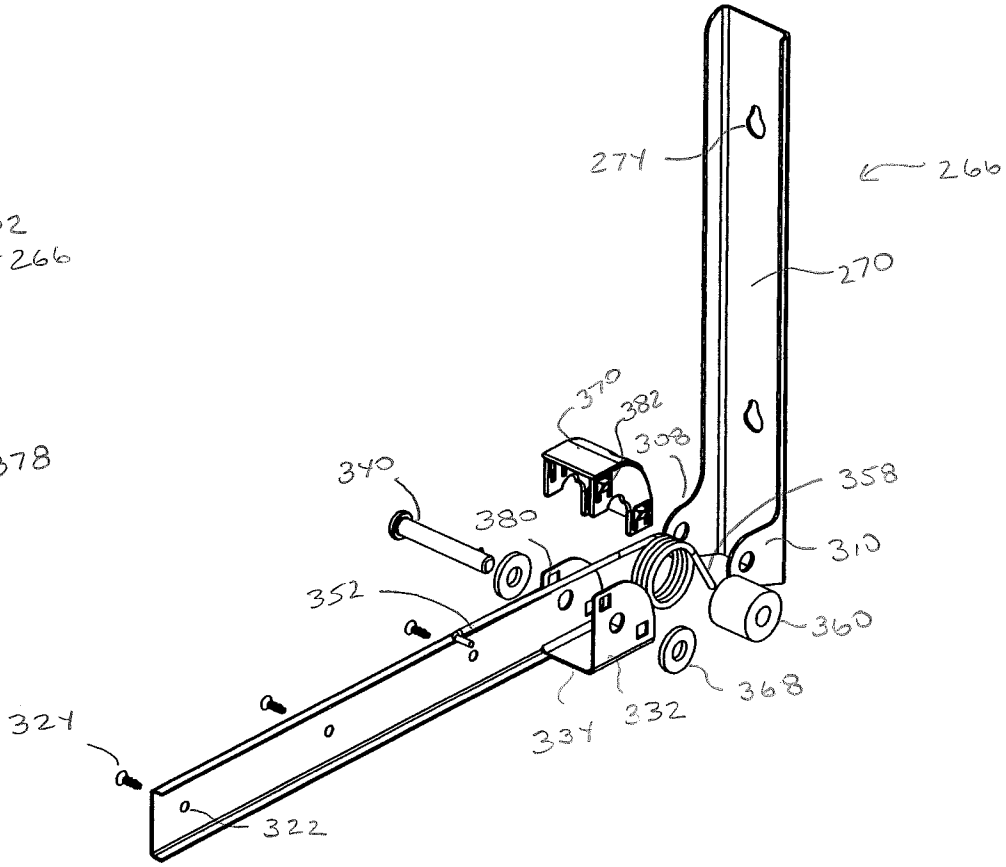
FIG. 57 is an exploded view of the assembly shown in FIG. 56.
Figure 56:
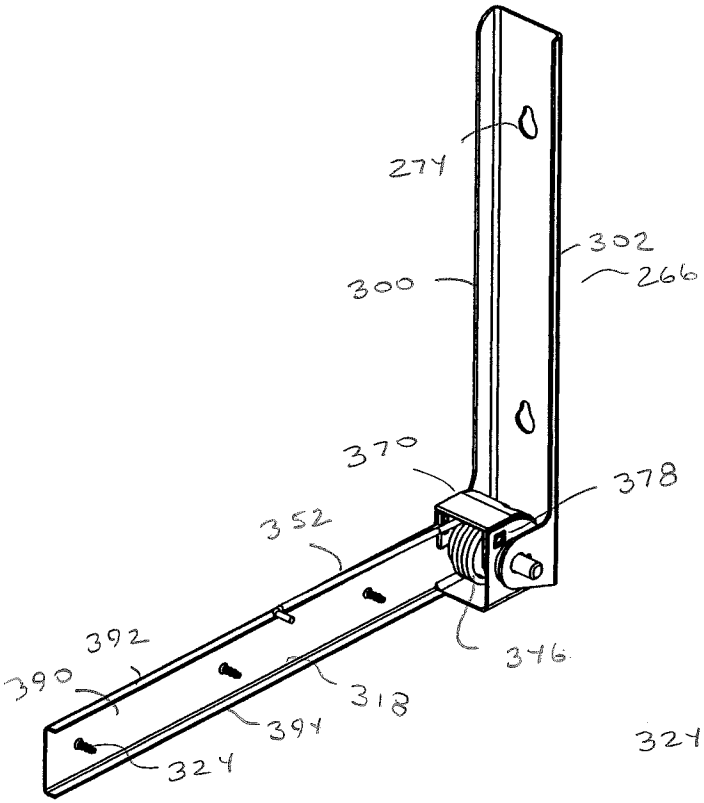
FIG. 56 is a top front right perspective view of the assembly shown in FIG. 54.

As can be appreciated from FIGS. 54 and 56 for example, when the table 264 is in the use position the inner surfaces of the side rail end 330, the inboard end 332 and the clevis bridge 334 come into abutting engagement with the stop surface 344. In this position the abutting engagement of the stop 342 of the clevis and the stop surface 344 of the mounting bracket prevent further rotation of the table in the first rotational direction beyond the use position. Due to the structure and substantial area of abutting engagement in the exemplary arrangement between the stop and stop surfaces, substantial loading of the table in the use position is achieved without damage to the joint or the mounting brackets. However in alternative arrangements frangible pins having features like those of the stop pins 154 previously discussed or other frangible features may be utilized. Such features may facilitate controlled breakage of the pins 340 in an overload condition to avoid possible damage to the other changing station structures. Of course it should be understood that these approaches are exemplary and in other arrangements other approaches may be used.

At least one torsion spring operates to apply a biasing force operatively between the table and at least one mounting bracket. In the exemplary arrangement each of the joints has a respective torsion spring associated therewith. Each of the torsion springs is operative to apply a spring force operatively between the respective mounting bracket and the adjacent area of the table so as to apply a biasing spring torque that biases the table in a second rotational direction that is opposed of the first rotational direction. The spring torque is operative to bias the table toward the closed position to facilitate the ability of a user to place the table in the closed position after use.

Figure 60:
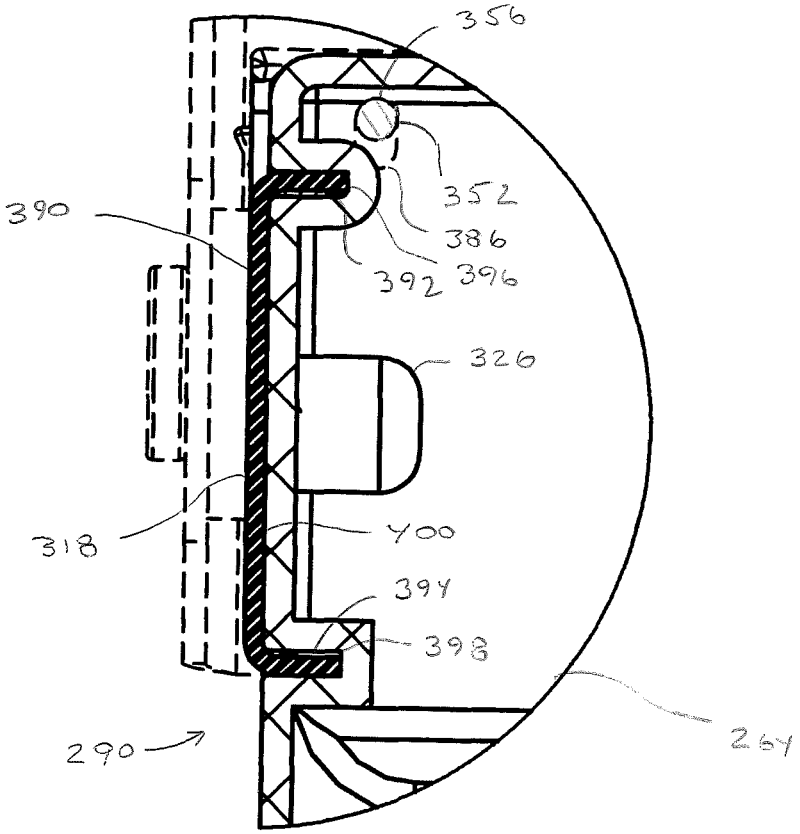
FIG. 60 is a transverse cross-sectional view of the table and side rail of the alternative baby changing station.

An exemplary torsion spring 346 is associated with joint 276. Exemplary torsion spring 346 includes a cylindrical coil 348. Coil 348 comprises a plurality of spring coil turns which extend about a cylindrical opening 350. In the operative position of the spring 346 the cylindrical opening 350 is aligned with the axis 316. The exemplary torsion spring includes an elongated table spring leg 352. The exemplary table spring leg 352 extends generally perpendicular of the axis 316 and terminates forwardly at a turned end 354. The exemplary table spring leg 352 is round in transverse cross-section as shown in FIG. 60. Further the exemplary table spring leg includes a continuous upper surface 356 that extends in a single plane, which surface in the exemplary arrangement comprises the radially outer upper surface of the table spring leg.

The exemplary torsion spring 346 further includes a back spring leg 358. The exemplary back spring leg 358 extends at an opposed axial end and in an opposed direction from the coil 348 than table spring leg 352. Back spring leg 358 is in operatively engaged relation with the front facing surface 270 of mounting bracket 266. In the exemplary arrangement the back spring leg 358 engages front facing surface 270 in the area transversely between ears 308 and 310 and intermediate of the area of surface 270 that serves as the stop surface 344. Of course it should be understood that this arrangement is exemplary and other arrangements other approaches may be used.

In the exemplary arrangement a cylindrical bushing 360 extends in the cylindrical opening 350 of coil 348 of the torsion spring. The bushing extends axially intermediate of side rail end 330 and inboard end 332. Bushing 360 includes an opening 362 that extends axially therethrough. Opening 362 is sized to accept the cylindrical body of pin 340 therein. Bushing 360 includes a cylindrical outer surface 364. In the operative position of the bushing 360, the pin 340 extending through the opening 362 holds the bushing and the cylindrical outer surface 364 thereof in axially aligned relation with the axis 316.

In the exemplary arrangement the exemplary cylindrical outer surface 364 of the bushing 360 is sized so as to be in close adjacent relation and/or in abutting relation with the inside surfaces of torsion spring coil 348 in the cylindrical opening 350. As can be appreciated, in the exemplary arrangement because the spring torque is applied to urge the table 264 to move toward the stored position, the spring torque is at its highest level when the table is in the use position. When the spring is exerting the greatest spring torque, the legs of the spring which extend from axially disposed opposite ends of the coil, exert a twisting force which is generally normal to the axis 316. In this condition the spring coils are in abutting engagement with the cylindrical outer surface so that the bushing holds the spring in generally axially aligned relation. By generally axially aligned relation it is meant that the axis of the coil of the torsion spring is within 20° of the axial direction. Of course this approach is exemplary and in other arrangements other approaches may be used.

In the exemplary joint 276 an outboard washer 366 is positioned axially intermediate of ear 308 and the outboard face of side rail end 330. An inboard washer 368 extends axially intermediate of inboard end 332 and ear 310. Washers 366 and 368 each include a central opening through which pin 340 extends in the operative position of the joint. In the exemplary arrangement outboard washer 366 maintains a first axial space between side rail end 330 and ear 308. Inboard washer 368 maintains a second axial space between inboard end 332 and ear 310. The washers maintain the clevis 328 in centered relation between the ears of the mounting bracket throughout the range of movement of the table between the use position and the stored position.

The exemplary joint further includes a cover 370. The exemplary cover includes a curved outer cover surface 372 that extends in outwardly overlying relation of torsion spring 346. The exemplary cover 370 includes a pair of radially extending, axially disposed cover side walls 374, 376. In the operative position of the cover 370 the cover side wall 374 extends in engagement with the inboard face of side rail end 330. Likewise cover side wall 376 extends in engagement with the outboard face of the inboard end 332.

In the exemplary arrangement the cover 370 includes at least one releasable cover detent 378. In the exemplary arrangement the cover detents comprise openings 380 that extend in each of the side rail end 330 and the inboard end 332. The cover detents further include projections 382. The openings 380 releasably engage the projections 382. The projections 382 extend outward on each of the cover sidewalls 374 and 376. This exemplary configuration enables the cover to be securely held in place by the detents 378, but to be removable by authorized persons when desired. Of course it should be understood that this approach is exemplary and in other arrangements other approaches may be used.

In the exemplary arrangement the table 264 includes a pair of respective spring channels 384 therein. Each spring channel extends generally perpendicular to the axis 316 and forwardly within the interior area of the table adjacent to each of side wall portions 290 and 292. Each spring channel extends inwardly in the interior area of the table from a respective spring channel opening that is within a respective notch of the inner end wall portion. Each respective spring channel is configured to receive therein a respective table spring leg of a respective torsion spring and to extend in surrounding relation thereof. Each respective torsion spring leg operates to apply the spring torque to the table which operates to bias the table in the second rotational direction toward the closed position.

Figure 58:
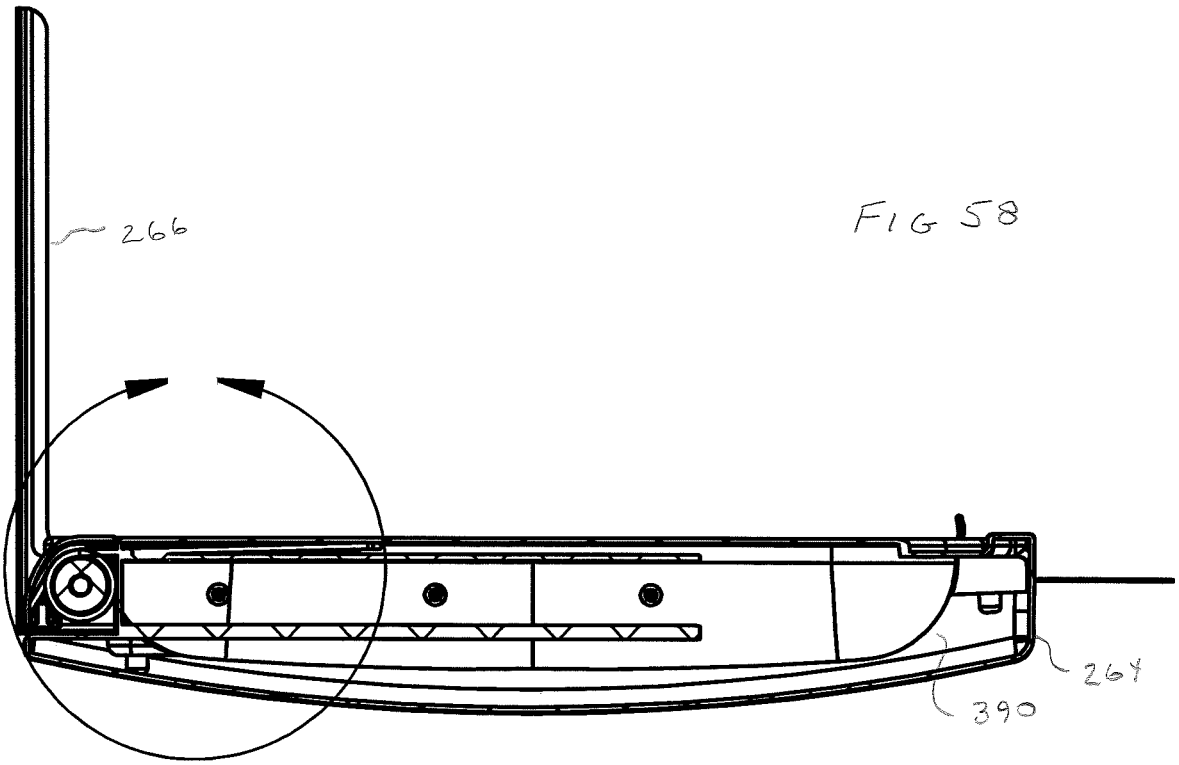
FIG. 58 is a cross-sectional view of the table of the alternative baby changing station.
Figure 59:
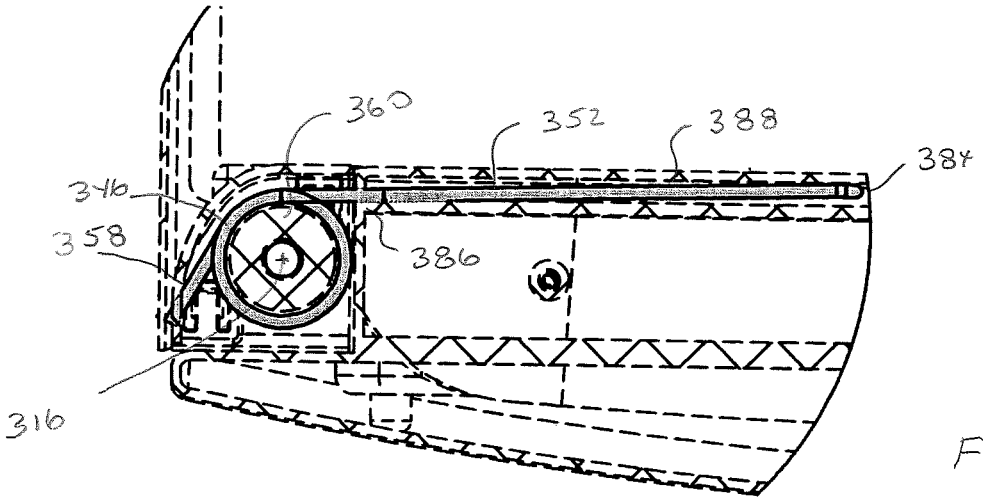
FIG. 59 is an enlarged view of the circled portion in FIG. 58.

As shown in FIGS. 58-60 the exemplary table spring leg 352 extends in a spring channel 384 through a spring channel opening 386 in the inner end wall portion 288. The exemplary spring channel extends substantially perpendicular to the axis and linearly straight. The exemplary spring channel 384 is disposed transversely inward from the immediately adjacent side wall portion 290 of the table. In the exemplary arrangement in the use position of the table, the spring channel 384 is bounded vertically inward from the outside surface of the rim 282 by a spring leg engaging surface 388. The spring leg engaging surface includes a planar portion that extends in a single plane.

In the exemplary arrangement when the table is in the use position, the upper surface 356 of the table spring leg 352 which comprises a continuous planar surface portion that extends on the upper side of the leg, is in continuous abutting engagement with the spring leg engaging surface which bounds the upper surface of spring channel 384. In this exemplary arrangement the planar spring engaging surface of the spring channel extends coplanar and in continuous abutting engagement along the entire length of the upper surface of the table spring leg. This exemplary configuration operates to spread the force of the spring torque acting on the table along substantially the entire length of the table spring leg and the spring leg engaging surface. In this exemplary arrangement the uniform application of the force spread across both abutting engaged surfaces avoids areas of substantially higher force that might otherwise cause excess wear or deformation of the spring leg engaging surface. Of course it should be understood that this configuration which is used in the example arrangement, is but one approach that may be taken to assuring that the application of torsional force by the springs is accomplished in a manner that does not cause wear, deformation or damage to the area in which the force is applied. In other exemplary arrangements different numbers, types and configurations of torsion springs and/or torsion spring legs and spring leg engaging surfaces may be employed, as well as different types of materials and material properties to achieve reliable operation over a suitable number of cycles during the useful life of the changing station.

In an exemplary arrangement each of the side rails 318, 320 of the changing station provide suitable strength to support the table portion 264 in engaged relation with the wall 262 through the mounting brackets 266, 270. The exemplary configurations of the side rails that are in fixed attached engagement with the respective side wall portions of the table 264, provide resistance to deformation and separation when subject to downward force in excess of that which would be normally expected when the table is in the use position.

As shown in FIG. 60 with regard to side rail 318 which is in engagement with mounting bracket 266, the side rail extends externally of and parallel to the immediately adjacent side wall portion 290. The exemplary side rail 318 includes in transverse cross-section a central portion 390. The central portion 390 is bounded at each transverse end by an inturned flange 392, 394. Each inturned flange extends generally perpendicular to the central portion 390 and extends from the central portion toward the immediately adjacent side wall portion 290. Side wall portion 290 includes a pair of disposed slots 396, 398. Inturned flange 392 extends in engaged relation in slot 396. Inturned flange 394 extends in engaged relation in slot 398.

In the exemplary arrangement a side bridge portion 400 of the surface of side wall portion 290 extends transversely between slots 396 and 398. Side bridge portion 400 is engaged with the central portion 390 of side rail 318. Side bridge portion 400 extends in abutting underlying relation with central portion 390. Further in the exemplary arrangement the central portion 390 is held in fixed engagement with the side bridge portion 400 through the fasteners 324 which extend through side rail 318 and the side bridge portion and into the bosses 326 on the inside of the side wall portion 290.

In this exemplary arrangement the application of downward force on the table 264 when the table is in the use position is spread across the pair of side rails 318 and 320. The inturned flanges of the respective side rails engaged in the respective slots, spread the force that is applied across the length of the slots which extend from the respective notches at the inner end wall portion of the table to the outward end of the side rails. The exemplary inturned flange configuration further provides compressive engagement between the slots and the flanges which further helps to maintain the side rails and the table in engagement despite the application of excessive force. The U-shaped cross-section of the exemplary side rails further helps to avoid deformation of the side rails and the side wall portions of the table under excessive loading conditions. Of course these configurations are exemplary and in other arrangements the approaches, principles, structures and arrangements that have been described herein, as well as other structures and arrangements may be employed to provide resistance to unusually high load conditions.

In some alternative exemplary arrangements a detent may be provided to releasably hold the table in the use position. A detent may be provided in exemplary arrangements to avoid a limited upward force acting on the table from advertently causing the table to move to the closed position when such movement is not desired. The detent operates to maintain the table in the use position until a deliberate force is applied to move the table toward the stored position which will release the detent and enable the table to move in response to the spring torque toward the closed position.

Figure 61:
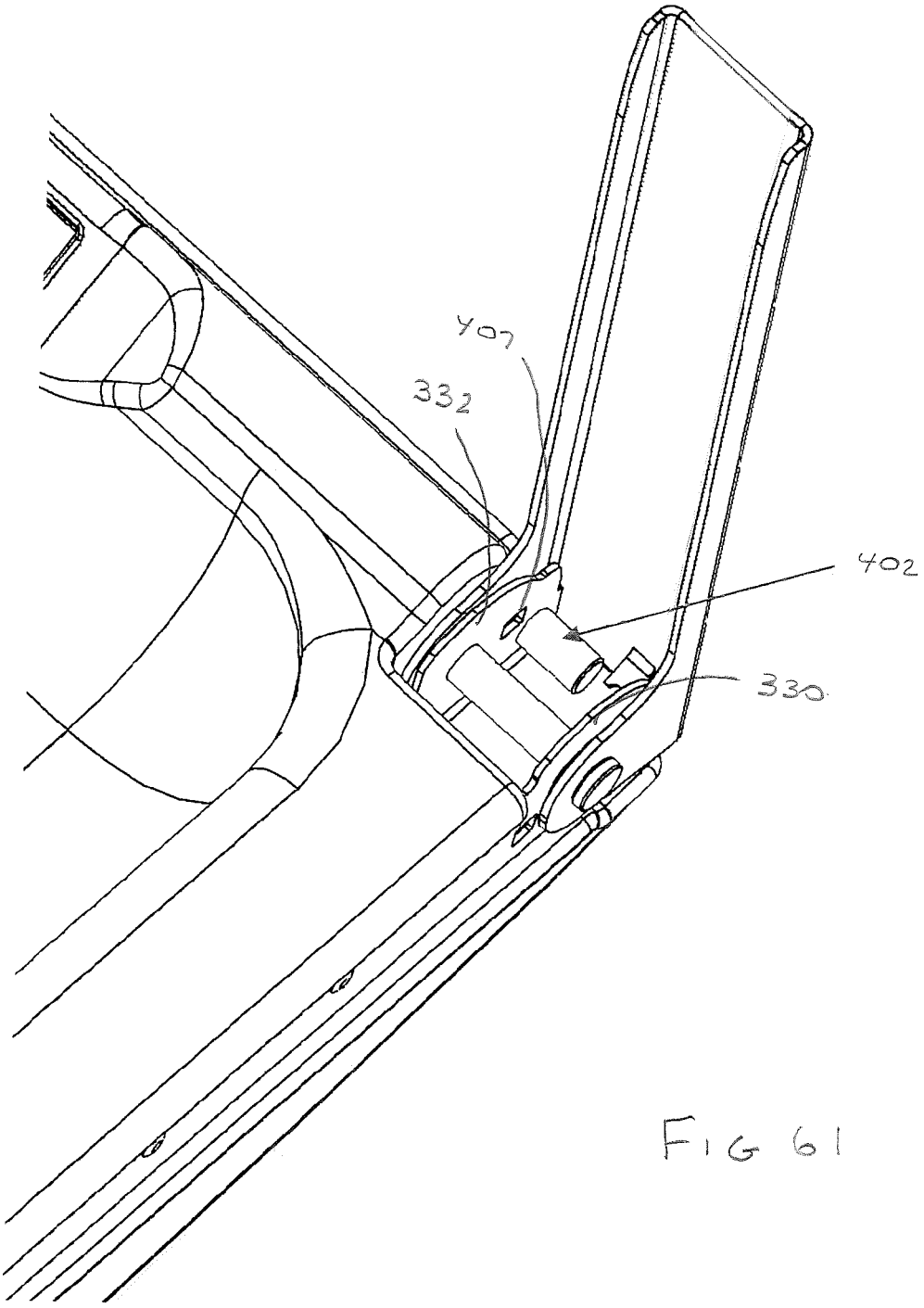
FIG. 61 is a top right perspective view of an alternative arrangement which includes a detent which releasably holds the table in the use position.
Figure 62:
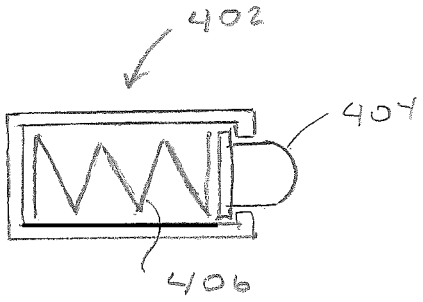
FIGS. 62 and 63 are schematic views showing an exemplary detent including a spring loaded projection in an extended and retracted position respectively.
Figure 63:
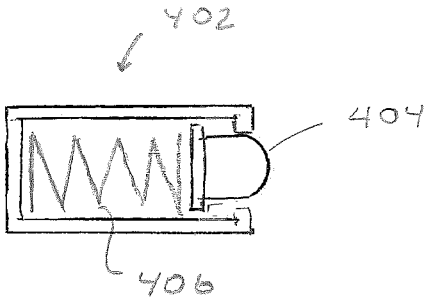

In an exemplary arrangement the detent is associated with the joint on each lateral side of the changing station. As represented in FIG. 61 an exemplary joint detent 402 is mounted in attached connection with the inboard end 332 that is in operative attached connection with the side rail end 330. As can be appreciated, in FIG. 61 the torsion spring is not shown for purposes of clarity. As shown in FIGS. 62 and 63 the exemplary detent 402 includes a spring loaded projection 404. The projection 404 is biased outwardly by a spring 406. The spring loaded projection 404 is biased outwardly toward the position shown in FIG. 62. The projection is movable against the force of the spring 406 to a retracted position which is shown in FIG. 63.

Figure 64:
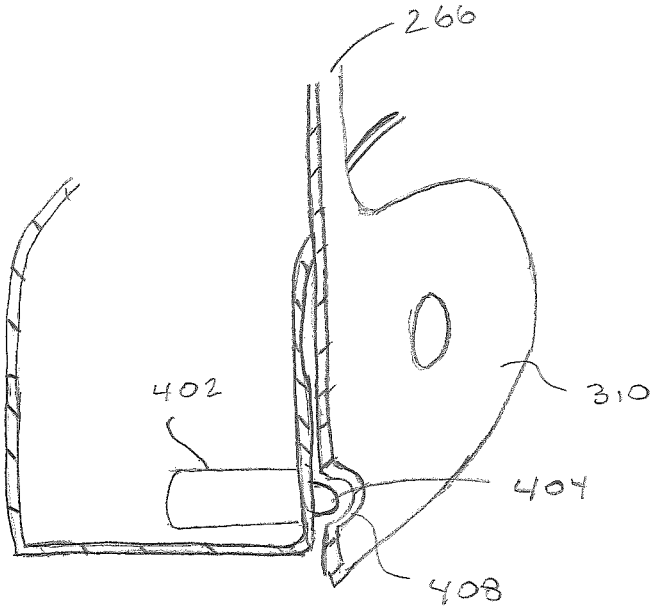
FIG. 64 is a partial cross-sectional view showing the detent with the spring loaded projection engaged in a recess to releasably hold the table in the use position.

As represented in FIG. 61 the projection is movable in an opening 407 that extends through the inboard end 332. As shown in FIG. 64 the immediately adjacent ear 310 of the mounting bracket 266 includes a recess 408. The recess 408 is configured to engage the projection 404 when the table is in the use position. The projection is configured to extend into the recess. The recess 408 and the projection are contoured so that when a force is applied to manually move the table from the use position toward the stored position, a modest but deliberate upward applied force on the table causes the spring loaded projection 404 to disengage from the recess. As a result the spring force of the torsion springs cause the table to move toward and into the stored position as the spring loaded projection moves in engagement with the inside face surface of the ear away from the recess. Likewise when the table is moved from the stored position to the use position, the spring loaded projection 404 moves smoothly in engagement with the face surface of the ear 310 until the use position of the table is reached. In this position the spring loaded projection 404 extends further outward and engages the recess 408 to hold the table in the use position.

Of course it should be understood that this configuration of the detent 402 is exemplary and in other arrangements other approaches may be used. For example, while in the exemplary arrangement the detent is in operative fixed connection with the side rail and the projection engages a recess in the bracket, this arrangement may be reversed. For example the spring loaded projection may be in fixed operative attachment with the mounting bracket and may engage a recess or similar structure that is in fixed operative connection with the side rail. In some arrangements the detent may be a ball type detent. In some arrangements a detent may be included in only one of the joints rather than in both joints. In other exemplary arrangements the detent may be associated with other components of the joint or other structures that are included in the table or the mounting bracket. Further in other exemplary arrangements other types of detents may be utilized.

These may include for example, detents that include leaf springs or other biasing structures that can releasably hold structures in relative positions and then release the structures to move responsive to releasing movement or force. Further other exemplary detents may engage projections rather than recesses or other comparable engaging structures that can hold the structures in relative positions, and then release the structures to enable movement. Further in other exemplary arrangements multiple detents may be utilized in connection with the exemplary structures. This may include multiple detents that hold the table in the use position. Alternatively or in addition detents may be utilized to hold the table in each of the stored and use positions. For example as can be appreciated, a further recess may be included in ear structure 310 in which the spring loaded projection can be engaged when the table is in the stored position. Of course it should be understood that these approaches are exemplary and in other arrangements other structures and approaches may be used.

In operation of the exemplary changing station 260 the pair of transversely disposed torsion springs operate to apply a spring torque to the table 264. The spring torque which is applied through the table spring legs of the torsion springs acting within the spring channels, biases the table to rotate about the axis 216 in the second rotational direction toward the closed position. In the exemplary arrangement the table 264 includes sufficient mass that is sufficiently in proximity to the outer end wall portion so that the center of gravity of the table is sufficiently disposed from the axis, that gravity acting on the table produces a gravitational torque when the table is in the use position. This gravitational torque acts to bias the table about the axis 216 in the first rotational direction which is opposite to the direction in which the table is biased by the spring torque. In an exemplary arrangement with the table in the use position, the gravitational torque is of a magnitude that is sufficiently greater than the spring torque so that the table remains in the use position when no forces other than gravity and the spring torque act on the table. As a result in the exemplary arrangement when the user rotationally moves the table in the first rotational direction from the stored position to the use position, the table will stay in the use position so that the table can be used to securely support the baby regardless of the location in which the baby is placed on the table. Alternatively in arrangements that include a detent such as a detent associated with at least one joint, the detent may further help to hold the table in the use position until the user deliberately moves the table from the use position toward the stored position.

The exemplary arrangement is configured such that once the changing station no longer needs to be used, the user may manually engage and rotate the table toward the stored position. Once the table is rotationally disposed away from the use position in the second rotational direction, the spring torque becomes greater than the gravitational torque acting on the table. This occurs because the distance between the center of gravity of the table and the axis decreases as the table is moved toward the stored position, which in turn reduces the gravitational torque. As a result the spring torque exceeds the gravitational torque acting on the table and causes the table to automatically move toward the stored position. In exemplary arrangements the magnitude of the spring torque and the configuration of the joints are arranged so that the maximum rotational velocity in the second rotational direction as a result of the spring torque avoids high impact stopping forces or other undesirable conditions. Further the configuration of the exemplary rim 282 which engages the front facing surfaces 370 within the pockets of the respective mounting brackets spreads the force that results from the application of the spring torque as it moves the table to the stored position. Further in some exemplary arrangements a detent may be used to releasably hold the table in the stored position. Of course it should be understood that these approaches are exemplary and in other arrangements other approaches may be used.

Thus the exemplary arrangements of the baby diaper changing station described herein achieve improved operation, eliminate difficulties encountered in the use of prior devices and systems, and attain the useful results described herein.

Further it should be understood that the features and/or relationships associated with one of the exemplary arrangements described may be combined with features and/or relationships from another exemplary arrangement. That is, various features and/or relationships from various arrangements can be combined to produce further arrangements. The inventive scope of this disclosure is not limited only to the exact arrangements that have been shown and/or described herein.

In the foregoing description certain terms have been used for brevity, clarity and understanding. However, no unnecessary limitations are to be implied therefrom because such terms are used for descriptive purposes and are intended to be broadly construed. Moreover, the descriptions and illustrations herein are by way of examples and the new and useful features are not limited to the exact features shown and described.

Having described the features, discoveries and principles of the exemplary arrangements, the manner in which they are constructed and operated, and the advantages and useful results attained, the new and useful structures, devices, elements, arrangements, parts, combinations, systems, equipment, operations, methods, processes and relationships are set forth in the appended claims.

We claim:

1. Apparatus comprising:

a baby diaper changing station including
- a table,
  - wherein the table includes a substantially planar changing surface,
- a pair of transversely spaced mounting brackets,
  - wherein each mounting bracket is configured to be attached in fixed operative engagement with a vertically extending wall,
- wherein the table is movably mounted in operative connection with each of the mounting brackets of the pair,
- wherein the table is rotatable via manual engagement between
  - a use position, wherein in the use position the changing surface extends substantially horizontally and outward in a direction normal to the wall, wherein in the use position the changing surface faces substantially upward, and
  - a stored position, wherein in the stored position the changing surface extends substantially vertically and parallel to the wall, and
  - wherein in the stored position the table outwardly overlies both of the mounting brackets,
- wherein the table is bounded by
  - an outer end wall portion, wherein the outer end wall portion extends furthest away from the wall when the table is in the use position,
  - an inner end wall portion, wherein the inner end wall portion extends closer to the wall than the outer end wall portion when the table is in the use position,
  - a pair of transversely disposed external side wall portions, wherein each respective side wall portion
    - extends intermediate of the inner end wall portion and the outer end wall portion, and
    - includes at least one elongated inward extending slot that extends intermediate of the inner end wall portion and the outer end wall portion and substantially horizontally when the table is in the use position, a pair of transversely disposed side rails, wherein each respective side rail is in fixed outward overlying engagement with a respective immediately adjacent side wall portion, and includes at least one elongated flange, wherein each elongated flange extends in engaged relation within a respective elongated slot of the immediately adjacent side wall portion, wherein each respective side rail is in rotatable operatively engaged connection with a respective mounting bracket, wherein the table is rotatable relative to each of the pair of mounting brackets about a common axis, a pair of transversely disposed torsion springs, wherein each respective torsion spring is in operative biasing connection with the table and a respective mounting bracket, wherein each of the torsion springs acts to bias the table toward the stored position, wherein the table includes sufficient mass in proximity to the outer end wall portion such that when the table is in the use position, gravity acting on the table is operative to cause a gravitational torque about the axis that acts in a first rotational direction, wherein the gravitational torque is greater than a spring torque applied by the pair of torsion springs to bias the table toward the stored position and that acts about the axis in a second rotational direction opposed of the first rotational direction, whereby the table remains in the use position, wherein when the table is rotationally disposed away from the use position in the second rotational direction, the spring torque is greater than the gravitational torque whereby the spring torque is operative to bias the table toward the stored position.

2. The apparatus according to claim 1 wherein the table includes therein a pair of linearly straight transversely disposed spring channels, wherein the table extends in generally surrounding relation of each of the spring channels, and wherein each respective spring channel extends within the table from a respective spring channel opening in the inner end wall portion toward the outer end wall portion, and is positioned transversely inward of an immediately adjacent side wall portion, is bounded within the table by a respective table spring leg engaging surface, wherein each torsion spring includes a respective table spring leg, wherein each respective table spring leg extends transverse to the axis and within a respective spring channel, wherein in the use position of the table each respective table spring leg is in biasing engagement with the respective spring leg engaging surface in the respective spring channel, wherein each torsion spring biases the table in the second rotational direction.

3. The apparatus according to claim 2 wherein each respective table spring leg includes a planar portion, wherein the planar portion includes a continuous surface that extends in a single plane, wherein each respective spring leg engaging surface of each respective spring channel includes a further planar portion, wherein the further planar portion includes a further continuous surface that extends in a further single plane, wherein in the use position of the table, each respective continuous surface is in continuous co-planar abutting engagement with each further continuous surface.

4. The apparatus according to claim 1, and further including:

a pair of transversely disposed joints, wherein the table is movably mounted in operative rotatable connection with each respective mounting bracket through a respective joint, wherein at least one joint includes a detent, wherein the detent is operative to releasably hold the table in the use position, wherein the detent is releasable responsive to movement of the table from the use position toward the stored position.

5. The apparatus according to claim 1 wherein each respective torsion spring includes a respective table spring leg and a respective back spring leg, wherein each respective table spring leg extends in a respective spring channel within the table, wherein each respective spring channel extends perpendicular of the axis, and wherein each respective back spring leg is in operative engagement with the respective mounting bracket.

6. Apparatus comprising:

a baby diaper changing station including a table, wherein the table includes a substantially planar changing surface, a pair of transversely spaced mounting brackets, wherein each mounting bracket is configured to be attached in fixed operative engagement with a vertically extending wall, wherein the table is movably mounted in operative connection with each of the mounting brackets of the pair, wherein the table is rotatable via manual engagement between a use position, wherein in the use position the changing surface extends substantially horizontally and outward in a direction normal to the wall, wherein in the use position the changing surface faces substantially upward, and a stored position, wherein in the stored position the changing surface extends substantially vertically and parallel to the wall, and wherein in the stored position the table outwardly overlies both of the mounting brackets, wherein the table is bounded by an outer end wall portion, wherein the outer end wall portion extends furthest away from the wall when the table is in the use position, an inner end wall portion, wherein the inner end wall portion extends closer to the wall than the outer end wall portion when the table is in the use position, a pair of transversely disposed side wall portions, wherein each respective side wall portion extends intermediate of the inner end wall portion and the outer end wall portion, wherein the table includes therein a pair of linearly straight transversely disposed spring channels, wherein the table extends in generally surrounding relation of each of the spring channels, and wherein each respective spring channel extends within the table from a respective spring channel opening in the inner end wall portion toward the outer end wall portion, and is positioned transversely inward of an immediately adjacent side wall portion, is bounded within the table by a respective spring leg engaging surface, wherein each respective spring leg engaging surface of each respective spring channel includes a spring engaging surface planar portion, wherein the spring engaging surface planar portion includes a continuous engagement surface that extends in a single surface plane, a pair of transversely disposed side rails, wherein each respective side rail is in fixed operative engagement with a respective side wall portion, wherein each respective side rail is in rotatable operatively engaged connection with a respective mounting bracket, wherein the table is rotatable relative to each of the pair of mounting brackets about a common axis, a pair of transversely disposed torsion springs, wherein each torsion spring includes a respective table spring leg, wherein each respective table spring leg extends transverse to the axis and within a respective spring channel, wherein each respective table spring leg includes a spring leg planar portion, wherein the spring leg planar portion includes a continuous leg surface that extends in a single leg plane, wherein in the use position of the table each continuous leg surface of each respective spring leg is in continuous co-planar abutting engagement with a respective continuous engagement surface, and each of the torsion springs acts to bias the table toward the stored position, wherein the changing station is configured such that when the table is in the use position, the table remains in the use position, and wherein when the table is rotationally disposed away from the use position toward the stored position, the spring torque is operative to bias the table toward the stored position.

7. The apparatus according to claim 6 wherein each respective side rail extends externally of and parallel to a respective immediately adjacent side wall portion.

8. The apparatus according to claim 7 wherein in transverse cross-section each respective side rail includes a central portion, a pair of inturned flanges, wherein a respective inturned flange bounds a respective end of the central portion, wherein each inturned flange extends perpendicular to the central portion and toward the respective immediately adjacent side wall portion.

9. The apparatus according to claim 8 wherein in transverse cross-section each respective side wall portion includes a pair of disposed slots, wherein a respective inturned flange of an immediately adjacent side rail extends in a respective slot, a side bridge portion, wherein the side bridge portion extends between the slots and is engaged with the immediately adjacent central portion in abutting relation.

10. The apparatus according to claim 9 and further comprising:

a pair of transversely disposed joints, wherein the table is movably mounted in operative rotatable connection with each respective mounting bracket through a respective joint, wherein each joint includes a respective clevis, wherein the axis extends through each respective clevis, wherein each respective clevis includes a side rail end of the respective side rail, an inboard end, wherein the inboard end extends parallel to and is axially disposed in an axially inward direction from the respective side rail end of the clevis, a clevis bridge, wherein the clevis bridge extends parallel to the axis and is in fixed operatively attached connection with each of the side rail end and the inboard end of the respective clevis.

11. The apparatus according to claim 10 wherein each respective joint further includes at least one projection, wherein the at least one projection is in operative attached connection with the respective mounting bracket, wherein the respective at least one projection is in rotatably movable operative engagement with the respective clevis.

12. The apparatus according to claim 11 wherein in each respective joint the at least one projection includes a pair of axially disposed parallel extending ears, wherein each of the ears extends from the respective mounting bracket and outward relative to the wall, wherein each ear of the respective pair is operatively rotatably engaged with the respective clevis of the respective joint.

13. The apparatus according to claim 12 wherein each respective mounting bracket further includes a stop engaging surface, wherein the stop engaging surface extends intermediate of the ears of a respective pair, wherein each respective clevis includes a respective stop, wherein the respective stop is engaged with the respective stop engaging surface of the immediately adjacent mounting bracket when the table is in the use position, wherein engagement of each respective stop and respective stop engaging surface is operative to prevent rotation of the table in the first rotational direction beyond the use position of the table.

14. The apparatus according to claim 13 wherein each respective stop of a respective joint comprises respective surfaces bounding each of the respective side rail end, the inboard end, and the clevis bridge.

15. The apparatus according to claim 13 wherein each respective joint comprises an axially extending pin, wherein each respective pin extends in operative engagement with each of the respective pair of ears, the side rail end, and the inboard end of the respective joint.

16. The apparatus according to claim 15
wherein each respective joint includes a respective joint detent,
wherein each joint detent is operative to releasably hold the table in the use position,
wherein the joint detent is released responsive to movement of the table from the use position toward the stored position.

17. The apparatus according to claim 16
wherein each joint detent includes a respective spring loaded projection that releasably engages and disengages a recess responsive to rotational table movement.

18. The apparatus according to claim 16
wherein the inner end wall portion of the table includes a pair of axially disposed notches,
wherein a respective joint extends in each respective notch,
and wherein a respective spring channel opening extends in each respective notch.

19. The apparatus according to claim 16
wherein each torsion spring includes a respective back spring leg,
wherein each respective back spring leg is in operatively engaged relation with the respective immediately adjacent mounting bracket.

20. The apparatus according to claim 19
wherein each respective mounting bracket includes a front facing surface, wherein the front facing surface extends transversely between the ears of the respective mounting bracket,
wherein the back spring leg of the respective torsion spring is operatively engaged with the front facing surface.

21. The apparatus according to claim 19
wherein each respective torsion spring includes a respective coil, wherein the respective back spring leg and the respective table spring leg each extend radially outwardly from the respective coil,
wherein each respective coil extends in surrounding relation of the respective pin of a respective joint.

22. The apparatus according to claim 21,
wherein each joint further includes a bushing, wherein the respective bushing extends in surrounding relation of the respective pin,
wherein the respective bushing extends radially intermediate of the respective pin and the respective coil of a respective torsion spring,
wherein the respective coil of a respective torsion spring is in abutting engagement with the respective bushing,
whereby the respective bushing maintains the respective torsion spring in generally axially aligned relation.

23. The apparatus according to claim 22
wherein each respective joint includes a cover,
wherein the respective cover extends in overlying relation of the respective coil of the respective torsion spring,
whereby the respective cover prevents external access to the respective torsion spring.

24. The apparatus according to claim 23
wherein each respective cover is in attached connection with a respective clevis and is rotatable about the axis therewith.

25. The apparatus according to claim 24
wherein the respective side rail end and the respective inboard end of the respective clevis extend intermediate of the pair of ears of the respective joint,
wherein each respective cover includes a pair of axially disposed radially extending cover side walls, wherein one of the pair of cover side walls is in attached connection with the respective side rail end, and the other of the pair of cover side walls is in attached connection with the respective inboard end.

26. The apparatus according to claim 25
wherein each respective joint includes a pair of washers,
wherein one washer of the respective pair is positioned axially intermediate of the respective side rail end and the immediately adjacent one ear of the pair of ears, and the other washer of the respective pair is positioned axially intermediate of the respective inboard end and the immediately adjacent other ear of the pair of ears,
wherein the one washer of the pair is operative to maintain a respective first axial space between the respective side rail end and the immediately adjacent one ear, and the other washer of the pair is operative to maintain a respective second axial space between the respective inboard end and the immediately adjacent other ear,
wherein one of the radially extending cover side walls of the respective cover is engaged with the respective side rail end on a side of the side rail end opposite the respective first axial space and the other of the radially extending cover side walls of the respective cover is engaged with the respective inboard end on a side of the inboard end opposite of the respective second axial space.

27. The apparatus according to claim 25
and wherein each joint includes at least one releasable cover detent,
wherein the respective cover of a joint is held in attached connection with at least one of the respective rail end and the respective inboard end, by the respective at least one releasable cover detent,
whereby the respective cover is removable from the respective joint through disengagement of the at least one releasable cover detent.

28. Apparatus comprising:
a baby diaper changing station including
a table,
wherein the table includes a substantially planar changing surface,
a pair of transversely spaced mounting brackets,
wherein each mounting bracket is configured to be attached in fixed operative engagement with a vertically extending wall,
a pair of transversely disposed joints
wherein the table is movably mounted in operative rotatable connection with each respective mounting bracket through a respective joint,
wherein the table is rotatable via manual engagement between
a use position, wherein in the use position the changing surface extends substantially horizontally and outward in a direction normal to the wall, wherein in the use position the changing surface faces substantially upward, and
a stored position, wherein in the stored position the changing surface extends substantially vertically and parallel to the wall, and
wherein in the stored position the table outwardly overlies both of the mounting brackets,
wherein the table is bounded by
an outer end wall portion, wherein the outer end wall portion extends furthest away from the wall when the table is in the use position, an inner end wall portion, wherein the inner end wall portion extends closer to the wall than the outer end wall portion when the table is in the use position, a pair of transversely disposed side wall portions, wherein each respective side wall portion extends intermediate of the inner end wall portion and the outer end wall portion, a pair of transversely disposed side rails, wherein each respective side rail is in fixed operative engagement with a respective side wall portion, wherein each respective side rail is in rotatable operatively engaged connection with a respective joint, wherein the table is rotatable relative to each of the pair of mounting brackets about a common axis, wherein each joint includes a respective clevis, wherein each clevis includes a side rail end of the respective immediately adjacent side rail, an inboard end, wherein the inboard end extends parallel to and is axially disposed in a transversely inward direction away from the respective side rail end of the clevis, a clevis bridge, wherein the clevis bridge extends parallel to the axis and is in fixed operatively attached connection with each of the side rail end and the inboard end of the respective clevis, a pair of transversely disposed torsion springs, wherein each respective torsion spring is in operative biasing connection with the table and a respective mounting bracket, wherein each of the torsion springs acts to bias the table toward the stored position, wherein the changing station is configured such that when the table is in the use position, the table remains in the use position, and wherein when the table is rotationally disposed away from the use position toward the stored position, the spring torque is operative to bias the table toward the stored position.

29. The apparatus according to claim 28 wherein each respective mounting bracket includes a pair of axially disposed parallel extending ears, wherein each of the ears extends from the respective mounting bracket and in an outward direction relative to the wall, wherein each ear of the respective pair is operatively rotatably movably engaged with the respective clevis of the respective joint.

30. The apparatus according to claim 29 wherein each respective mounting bracket includes a respective front facing surface, wherein the respective front facing surface extends transversely between the respective ears of the respective mounting bracket, wherein the respective clevis is in operative rotatable connection with the ears of the respective mounting bracket, wherein the respective clevis includes a stop, wherein the stop includes at least one surface of the respective clevis, wherein in the use position of the table, the respective stop is in abutting engagement with the front facing surface of the respective mounting bracket, wherein the table is prevented from moving in the first rotational direction beyond the use position.

31. The apparatus according to claim 29 wherein each joint includes a respective pin, wherein the pin extends along the axis and is in operative engagement with each ear of the respective pair of ears and the clevis, wherein a respective bushing extends within the joint in surrounding relation of the respective pin, wherein a respective torsion spring includes a coil that extends in surrounding relation of the respective bushing, wherein the coil of the respective torsion spring is in abutting engagement with the bushing, wherein the bushing maintains the coil in generally axially aligned relation.

32. The apparatus according to claim 28 wherein the inner end wall portion of the table includes a pair of axially disposed notches, wherein a respective joint extends in each respective notch.

33. Apparatus comprising:

a baby diaper changing station including a table, wherein the table includes a substantially planar changing surface, a pair of side wall portions that each bound a respective opposed side of the table, a pair of transversely disposed side rails, wherein each respective side rail is in fixed operative outwardly overlying connection with a respective side wall portion, a pair of transversely disposed mounting brackets, wherein each mounting bracket is configured to be attached in fixed operative engagement with a vertically extending wall, wherein each mounting bracket is in operatively engaged rotatably movable connection with the respective one of the side rails through a respective pin, wherein the pins extend along a single common axis, wherein the table is in rotatably movable operative connection with the pair of mounting brackets, wherein the table is manually rotatably movable about the axis between a use position, wherein in the use position the changing surface extends substantially horizontally and outward in a direction normal to the wall, wherein in the use position the changing surface faces substantially upward, and a stored position, wherein in the stored position the changing surface extends substantially vertical and parallel to the wall, wherein the table includes a pair of spring channels therein, wherein each respective spring channel extends within the table in a direction perpendicular to the axis and parallel to the immediately adjacent side rail, a pair of torsion springs, wherein each respective torsion spring includes a coil, a table spring leg and a back spring leg, wherein each respective coil extends in surrounding relation of a respective pin, wherein each table spring leg extends in a respective spring channel, and wherein each back spring leg is in operative engagement with the respective mounting bracket, wherein the pair of torsion springs is operative to apply a spring torque that biases the table in a closing rotational direction and toward the stored position, wherein in the use position of the table, gravitational force acting on the table is operative to cause a gravitational torque that biases the table in a rotational direction opposed of the closing rotational direction, that is greater than the spring torque, whereby the table is enabled to be maintained in the use position by gravity, wherein movement of the table in the closing rotational direction away from the use position is operative to cause the spring torque to exceed the gravitational torque, whereby the table is movable responsive to the spring torque to the stored position.

34. The apparatus according to claim 33 wherein each respective spring channel is bounded within the table by a continuous spring leg engaging surface, wherein each table spring leg of each respective torsion spring includes a continuous spring leg surface that extends within the respective spring channel, wherein in the use position of the table each respective continuous spring leg surface is in continuous abutting engagement with the respective spring leg engaging surface of the respective spring channel.

35. Apparatus comprising:

a baby diaper changing station including a table, wherein the table includes a substantially planar changing surface, at least one mounting bracket, wherein each mounting bracket is configured to be attached in fixed operative engagement with a vertically extending wall, wherein the table is movably mounted in operative connection with each mounting bracket, wherein the table is rotatable via manual engagement between a use position, wherein in the use position the changing surface extends substantially horizontally and outward in a direction normal to the wall, wherein in the use position the changing surface faces substantially upward, and a stored position, wherein in the stored position the changing surface extends substantially vertically and parallel to the wall, and wherein in the stored position the table outwardly overlies the at least one mounting bracket, wherein the table is bounded by an outer end wall portion, wherein the outer end wall portion extends furthest away from the wall when the table is in the use position, an inner end wall portion, wherein the inner end wall portion extends closer to the wall than the outer end wall portion when the table is in the use position, a pair of transversely disposed side wall portions, wherein each respective side wall portion extends intermediate of the inner end wall portion and the outer end wall portion, a pair of transversely disposed side rails, wherein each respective side rail is in fixed operative engagement with a respective side wall portion, wherein each respective side rail is in rotatable operatively engaged connection with the at least one mounting bracket, wherein the table is rotatable relative to each mounting bracket about a common axis, at least one torsion spring, wherein each respective torsion spring is in operative biasing connection with the table and a respective mounting bracket, wherein each torsion spring acts to bias the table toward the stored position, a detent, wherein the detent is in operative connection with at least one respective mounting bracket and in operative connection with at least one at least respective side rail, wherein the detent is operative to releasably hold the table in the use position, wherein the detent is operative to release responsive to movement of the table from the use position toward the stored position.

36. The apparatus according to claim 35 wherein each side rail includes a respective elongated flange, wherein each respective side wall portion includes a respective elongated slot, wherein the respective flange of a respective side rail is engaged in a respective slot of an immediately adjacent side wall portion.

37. The apparatus according to claim 35 wherein each respective torsion spring includes a respective table spring leg and a respective back spring leg, wherein each respective table spring leg extends in a respective spring channel within the table, wherein each respective spring channel extends perpendicular to the axis, and wherein each respective back spring leg is in operative engagement with the respective mounting bracket.

38. Apparatus comprising:

a baby diaper changing station including a table, wherein the table includes a substantially planar changing surface, a pair of transversely spaced mounting brackets, wherein each mounting bracket is configured to be attached in fixed operative engagement with a vertically extending wall, a pair of transversely disposed joints, wherein the table is movably mounted in operative rotatable connection with each respective mounting bracket through a respective joint, wherein the table is rotatable via manual engagement between a use position, wherein in the use position the changing surface extends substantially horizontally and outward in a direction normal to the wall, wherein in the use position the changing surface faces substantially upward, and a stored position, wherein in the stored position the changing surface extends substantially vertically and parallel to the wall, and wherein in the stored position the table outwardly overlies both of the mounting brackets, wherein at least one joint includes a detent, wherein the detent is operative to releasably hold the table in the use position, wherein the detent is releasable responsive to movement of the table from the use position toward the stored position, wherein the table is bounded by an outer end wall portion, wherein the outer end wall portion extends furthest away from the wall when the table is in the use position, an inner end wall portion, wherein the inner end wall portion extends closer to the wall than the outer end wall portion when the table is in the use position, a pair of transversely disposed side wall portions, wherein each respective side wall portion extends intermediate of the inner end wall portion and the outer end wall portion, a pair of transversely disposed side rails, wherein each respective side rail is in fixed operative engagement with a respective side wall portion, wherein each respective side rail is in rotatable operatively engaged connection with a respective mounting bracket, wherein the table is rotatable relative to each of the pair of mounting brackets about a common axis, a pair of transversely disposed torsion springs, wherein each respective torsion spring is in operative biasing connection with the table and a respective mounting bracket, wherein each of the torsion springs acts to bias the table toward the stored position, wherein the changing station is configured such that when the table is in the use position, the table remains in the use position, and wherein when the table is rotationally disposed away from the use position toward the stored position, the spring torque is operative to bias the table toward the stored position.

39. Apparatus comprising:

a baby diaper changing station including a table, wherein the table includes a substantially planar changing surface, a pair of transversely spaced mounting brackets, wherein each mounting bracket is configured to be attached in fixed operative engagement with a vertically extending wall, wherein the table is movably mounted in operative connection with each of the mounting brackets of the pair, wherein the table is rotatable via manual engagement between a use position, wherein in the use position the changing surface extends substantially horizontally and outward in a direction normal to the wall, wherein in the use position the changing surface faces substantially upward, and a stored position, wherein in the stored position the changing surface extends substantially vertically and parallel to the wall, and wherein in the stored position the table outwardly overlies both of the mounting brackets, wherein the table is bounded by an outer end wall portion, wherein the outer end wall portion extends furthest away from the wall when the table is in the use position, an inner end wall portion, wherein the inner end wall portion extends closer to the wall than the outer end wall portion when the table is in the use position, a pair of transversely disposed side wall portions, wherein each respective side wall portion extends intermediate of the inner end wall portion and the outer end wall portion, and in transverse cross section includes a pair of disposed slots, a pair of transversely disposed side rails, wherein each respective side rail extends parallel to, externally of and is in fixed operative engagement with a respective immediately adjacent side wall portion, wherein in transverse cross section each side rail includes a pair of inturned flanges, wherein each inturned flange extends in a respective slot of the respective immediately adjacent side wall portion, wherein each respective side rail is in rotatable operatively engaged connection with a respective mounting bracket, wherein the table is rotatable relative to each of the pair of mounting brackets about a common axis, a pair of transversely disposed torsion springs, wherein each respective torsion spring is in operative biasing connection with the table and a respective mounting bracket, wherein each of the torsion springs acts to bias the table toward the stored position, wherein the changing station is configured such that when the table is in the use position, the table remains in the use position, and wherein when the table is rotationally disposed away from the use position toward the stored position, the spring torque is operative to bias the table toward the stored position.

40. Apparatus comprising:

a baby diaper changing station including a table, wherein the table includes a substantially planar changing surface, a pair of transversely spaced mounting brackets, wherein each mounting bracket is configured to be attached in fixed operative engagement with a vertically extending wall, wherein the table is movably mounted in operative connection with each of the mounting brackets of the pair, wherein the table is rotatable via manual engagement between a use position, wherein in the use position the changing surface extends substantially horizontally and outward in a direction normal to the wall, wherein in the use position the changing surface faces substantially upward, and a stored position, wherein in the stored position the changing surface extends substantially vertically and parallel to the wall, and wherein in the stored position the table outwardly overlies both of the mounting brackets, wherein the table is bounded by an outer end wall portion, wherein the outer end wall portion extends furthest away from the wall when the table is in the use position, an inner end wall portion, wherein the inner end wall portion extends closer to the wall than the outer end wall portion when the table is in the use position, a pair of transversely disposed side wall portions, wherein each respective side wall portion extends intermediate of the inner end wall portion and the outer end wall portion, wherein the table includes therein a pair of linearly straight transversely disposed spring channels, wherein the table extends in generally surrounding relation of each of the spring channels, and wherein each respective spring channel extends within the table from a respective spring channel opening in the inner end wall portion toward the outer end wall portion, and is positioned transversely inward of an immediately adjacent side wall portion, is bounded within the table by a respective spring leg engaging surface, wherein each respective spring leg engaging surface of each respective spring channel includes a spring engaging surface planar portion, wherein the spring engaging surface planar portion includes a continuous engagement surface that extends in a single surface plane, a pair of transversely disposed side rails, wherein each respective side rail is in fixed operative engagement with a respective side wall portion, wherein each respective side rail is in rotatable operatively engaged connection with a respective mounting bracket, wherein the table is rotatable relative to each of the pair of mounting brackets about a common axis, a pair of transversely disposed torsion springs, wherein each torsion spring includes a respective table spring leg, wherein each respective table spring leg includes a leg planar portion, wherein the leg planar portion includes a continuous leg surface that extends in a single leg plane, wherein each leg planar portion comprises an outer surface of a respective table spring leg having a round cross-section, that extends linearly straight within the respective spring channel and terminates at a turned end, wherein in the use position of the table, each respective continuous leg surface is in continuous co-planar abutting engagement with each continuous engagement surface, wherein each respective torsion spring is in operative biasing connection with the table and a respective mounting bracket, wherein each of the torsion springs acts to bias the table toward the stored position, wherein the changing station is configured such that when the table is in the use position, the table remains in the use position, and wherein when the table is rotationally disposed away from the use position toward the stored position, the spring torque is operative to bias the table toward the stored position.

41. Apparatus comprising:

a baby diaper changing station including a table, wherein the table includes a substantially planar changing surface, a pair of side wall portions that each bound a respective opposed side of the table, wherein in transverse cross-section each respective side wall portion includes a bridge portion and a pair of disposed slots, a pair of transversely disposed side rails, wherein each respective side rail is in fixed operative outwardly overlying connection with a respective side wall portion, wherein each side rail in transverse cross-section includes a central portion and a pair of transversely disposed flanges, wherein each flange extends generally perpendicular to the central portion, wherein a respective bridge portion of a respective side wall portion extends in underlying abutting engagement with the central portion of a respective side rail, and each flange of the respective side rail extends in engaged relation within a respective slot of the respective side wall portion, a pair of transversely disposed mounting brackets, wherein each mounting bracket is configured to be attached in fixed operative engagement with a vertically extending wall, wherein each mounting bracket is in operatively engaged rotatably movable connection with the respective one of the side rails through a respective pin, wherein the pins extend along a single common axis, wherein the table is in rotatably movable operative connection with the pair of mounting brackets, wherein the table is manually rotatably movable about the axis between a use position, wherein in the use position the changing surface extends substantially horizontally and outward in a direction normal to the wall, wherein in the use position the changing surface faces substantially upward, and a stored position, wherein in the stored position the changing surface extends substantially vertical and parallel to the wall, wherein the table includes a pair of spring channels therein, wherein each respective spring channel extends within the table in a direction perpendicular to the axis and parallel to the immediately adjacent side rail, a pair of torsion springs, wherein each respective torsion spring includes a coil, a table spring leg and a back spring leg, wherein each respective coil extends in surrounding relation of a respective pin, wherein each table spring leg extends in a respective spring channel, and wherein each back spring leg is in operative engagement with the respective mounting bracket, wherein the pair of torsion springs is operative to apply a spring torque that biases the table in a closing rotational direction and toward the stored position, wherein the changing station is configured such that when the table is in the use position the table is enabled to be maintained in the use position, and wherein movement of the table in the closing rotational direction away from the use position is operative to cause the table to be moved responsive to the spring torque toward the stored position.

42. Apparatus comprising:

a baby diaper changing station including a table, wherein the table includes a substantially planar changing surface, a pair of side wall portions that each bound a respective opposed side of the table, a pair of transversely disposed side rails, wherein each respective side rail is in fixed operative outwardly overlying connection with a respective side wall portion, a pair of transversely disposed mounting brackets, wherein each mounting bracket is configured to be attached in fixed operative engagement with a vertically extending wall, wherein each mounting bracket is in operatively engaged rotatably movable connection with the respective one of the side rails through a respective pin, wherein the pins extend along a single common axis, wherein the table is in rotatably movable operative connection with the pair of mounting brackets, wherein the table is manually rotatably movable about the axis between a use position, wherein in the use position the changing surface extends substantially horizontally and outward in a direction normal to the wall, wherein in the use position the changing surface faces substantially upward, and a stored position, wherein in the stored position the changing surface extends substantially vertical and parallel to the wall, wherein the table includes a pair of spring channels therein, wherein each respective spring channel extends within the table in a direction perpendicular to the axis and parallel to the immediately adjacent side rail, a pair of torsion springs, wherein each respective torsion spring includes a coil, a table spring leg and a back spring leg, wherein each respective coil extends in surrounding relation of a respective pin, wherein each table spring leg extends in a respective spring channel, and wherein each back spring leg is in operative engagement with the respective mounting bracket, wherein the pair of torsion springs is operative to apply a spring torque that biases the table in a closing rotational direction and toward the stored position, a detent, wherein the detent is in operative connection with at least one respective mounting bracket and in operative connection with at least one respective side rail, wherein the detent is operative to releasably hold the table in the use position, wherein the detent is operative to release responsive to movement of the table from the use position toward the stored position.

43. Apparatus comprising:

a baby diaper changing station including a table, wherein the table includes a substantially planar changing surface, at least one mounting bracket, wherein each mounting bracket is configured to be attached in fixed operative engagement with a vertically extending wall, at least one joint, wherein the table is movably mounted in operative rotatable connection with each respective mounting bracket through a respective joint, wherein the table is rotatable via manual engagement between a use position, wherein in the use position the changing surface extends substantially horizontally and outward in a direction normal to the wall, wherein in the use position the changing surface faces substantially upward, and a stored position, wherein in the stored position the changing surface extends substantially vertically and parallel to the wall, and wherein in the stored position the table outwardly overlies the at least one mounting bracket, wherein the table is bounded by an outer end wall portion, wherein the outer end wall portion extends furthest away from the wall when the table is in the use position, an inner end wall portion, wherein the inner end wall portion extends closer to the wall than the outer end wall portion when the table is in the use position, a pair of transversely disposed side wall portions, wherein each respective side wall portion extends intermediate of the inner end wall portion and the outer end wall portion, a pair of transversely disposed side rails, wherein each respective side rail is in fixed operative engagement with a respective side wall portion, wherein each respective side rail is in rotatable operatively engaged connection with the at least one mounting bracket, wherein the table is rotatable relative to each mounting bracket about a common axis, wherein each joint includes a respective clevis, wherein each clevis includes a side rail end of the respective immediately adjacent side rail, an inboard end, wherein the inboard end extends parallel to and is axially disposed in a transversely inward direction from the respective side rail end of the clevis, a clevis bridge, wherein the clevis bridge extends parallel to the axis and is in fixed operatively attached connection with each of the side rail end and the inboard end of the respective clevis, at least one torsion spring, wherein each respective torsion spring is in operative biasing connection with the table and a respective mounting bracket, wherein each torsion spring acts to bias the table toward the stored position, wherein the changing station is configured such that when the table is in the use position, the table remains in the use position, and wherein when the table is rotationally disposed away from the use position toward the stored position, the spring torque is operative to bias the table toward the stored position.

* * * * *